US007630884B2

(12) United States Patent
Murashima

(10) Patent No.: US 7,630,884 B2
(45) Date of Patent: Dec. 8, 2009

(54) CODE CONVERSION METHOD, APPARATUS, PROGRAM, AND STORAGE MEDIUM

(75) Inventor: Atsushi Murashima, Tokyo (JP)

(73) Assignee: NEC Corporation, Tokyo (JP)

( * ) Notice: Subject to any disclaimer, the term of this patent is extended or adjusted under 35 U.S.C. 154(b) by 822 days.

(21) Appl. No.: 10/495,273

(22) PCT Filed: Nov. 12, 2002

(86) PCT No.: PCT/JP02/11783

§ 371 (c)(1),
(2), (4) Date: May 11, 2004

(87) PCT Pub. No.: WO03/042977

PCT Pub. Date: May 22, 2003

(65) Prior Publication Data

US 2005/0010400 A1 Jan. 13, 2005

(30) Foreign Application Priority Data

Nov. 13, 2001 (JP) ..... 2001-346987

(51) Int. Cl.
*G10L 19/08* (2006.01)
*G10L 19/12* (2006.01)

(52) U.S. Cl. ..... 704/219; 704/221; 704/223; 370/466

(58) Field of Classification Search ..... 704/201, 704/219, 220, 221, 223, 225, 203, 207; 370/466
See application file for complete search history.

(56) References Cited

U.S. PATENT DOCUMENTS 5,664,055 A * 9/1997 Kroon ..... 704/223

(Continued)

FOREIGN PATENT DOCUMENTS

EP 0 820 052 A2 1/1998

(Continued)

OTHER PUBLICATIONS

Code-Excited Linear Prediction (CELP): High-Quality Speech at Very Low Bit Rates, by Manfred Scroeder et al., et al., 1985 IEEE, pp. 937-940.

(Continued)

*Primary Examiner*—Martin Lerner
(74) *Attorney, Agent, or Firm*—Foley & Lardner LLP

(57) ABSTRACT

The object of this invention is converting a code that has been obtained by encoding speech by one particular system is converted to code that can be decoded by another system with high speech quality, and moreover, with a low computational load in transmitting speech signal between different systems. This invention comprising an adaptive codebook (ACB) delay search range control circuit (1250 in FIG. 7) for calculating a search range control value from first adaptive codebook delay that is stored and held and said second adaptive codebook delay that is stored and held, and an adaptive codebook encoding circuit (1220 in FIG. 7) for calculating autocorrelation using speech signal from ACB delay including excitation signal and delay that is within a range stipulated by said search range control value, and selects the maximum autocorrelation as second adaptive codebook delay, and supplying code that corresponds to said second adaptive codebook delay as code of an adaptive codebook delay in said second code string.

6 Claims, 28 Drawing Sheets

U.S. PATENT DOCUMENTS

| | | | | | |
|---|---|---|---|---|---|
| 5,699,485 | A | * | 12/1997 | Shoham | 704/223 |
| 5,704,003 | A | * | 12/1997 | Kleijn et al. | 704/220 |
| 5,778,334 | A | | 7/1998 | Ozawa et al. | |
| 5,873,058 | A | | 2/1999 | Yajima et al. | |
| 5,884,252 | A | | 3/1999 | Ozawa | |
| 5,995,923 | A | * | 11/1999 | Mermelstein et al. | 704/219 |
| 6,584,441 | B1 | * | 6/2003 | Ojala et al. | 704/500 |
| 6,829,579 | B2 | * | 12/2004 | Jabri et al. | 704/221 |
| 7,016,831 | B2 | * | 3/2006 | Suzuki et al. | 704/219 |
| 7,092,875 | B2 | * | 8/2006 | Tsuchinaga et al. | 704/221 |
| 7,142,559 | B2 | * | 11/2006 | Choi et al. | 370/466 |
| 7,184,953 | B2 | * | 2/2007 | Jabri et al. | 704/221 |
| 7,263,481 | B2 | * | 8/2007 | Jabri et al. | 704/219 |
| 7,315,814 | B2 | * | 1/2008 | Vainio et al. | 704/221 |
| 7,318,024 | B2 | * | 1/2008 | Murashima | 704/219 |
| 7,433,815 | B2 | * | 10/2008 | Jabri et al. | 704/203 |
| 2002/0196762 | A1 | * | 12/2002 | Choi et al. | 370/338 |

FOREIGN PATENT DOCUMENTS

| | | |
|---|---|---|
| JP | 61-180299 | 8/1986 |
| JP | 01-152894 | 6/1989 |
| JP | 04-048239 | 8/1992 |
| JP | 08-046646 | 2/1996 |
| JP | 08-146997 | 6/1996 |
| JP | 8-185199 | 7/1996 |
| JP | 8-328597 | 12/1996 |
| JP | 9-321783 | 12/1997 |
| JP | 09-321783 | 12/1997 |
| JP | 11-041286 | 2/1999 |
| JP | 2000-332749 | 11/2000 |
| KR | WO 99/65017 | 12/1999 |
| KR | 2001-0022714 | 3/2001 |
| WO | WO 00/48170 A1 | 8/2000 |

OTHER PUBLICATIONS

Improving Capability of Speech Codes in Clean and Frame Erasured Channel Environments, by Hong-Goo Kang et al., 2000 IEEE, pp. 78-80.

ITU-T, Coding of Speech at 8 kbit/s Using Conjugate-Structure Algebraic-Code-Excited Linear-Prediction (CS-ACELP), ITU-Recommendation G.729, Mar. 1996, pp. 10-14.

Kyung Tae Kim, et al., "An Efficient Transcoding Algorithm for G.723.1 and EVRC Speech Coders," 2001 IEEE 54$^{th}$ Vehicular Technology Conference, Proceedings, vol. 1 of 4, Conf. 54, XP010562224.

* cited by examiner

CODE CONVERSION METHOD, APPARATUS, PROGRAM, AND STORAGE MEDIUM

TECHNICAL FIELD

The present invention relates to an encoding and decoding technique for transmitting or storing a speech signal at a low bit rate, and particularly to a code conversion method and device as well as a program and recording medium for use when implementing speech communication using different encoding/decoding systems whereby code that has been obtained by encoding speech by one particular system is converted to code that can be decoded by another system with high speech quality, and moreover, with a low computational load.

BACKGROUND ART

One widely used method of encoding a speech signal at a medium or low bit rate and with high efficiency involves first separating the speech signal into a Linear Prediction (hereinbelow abbreviated "LP") filter and an excitation signal for driving this filter and then encoding.

A representative example of such a method is Code Excited Linear Prediction (hereinbelow abbreviated as "CELP").

In CELP, a linear prediction filter in which a linear prediction coefficient has been set that indicates the frequency characteristic of input speech is driven by an excitation signal that is represented by the sum of an Adaptive Codebook (hereinbelow abbreviated "ACB") that indicates the pitch cycle of the input speech and a Fixed Codebook (hereinbelow abbreviated as "FCB") that is constituted by a random number or pulses to obtain a synthesized speech signal. Here, the ACB component and FCB component are each multiplied by gain, i.e., ACB gain and FCB gain, respectively. Regarding CELP, reference may be made to M. R. Schroeder and B. S. Atal, "Code-excited linear prediction: High-quality speech at very low bit rates" (1985), Proceedings of the IEEE International Conference on Acoustics, Speech and Signal Processing (ICASSP), pp. 937-940 (Hereinbelow referred to as "Reference 1").

However, assuming interconnection between, for example, a 3G (Third-Generation) Mobile network and a wire packet network, the problem arises that a direct connection between the two networks cannot be established because the standard speech encoding systems used in the two networks are different.

The easiest solution for this problem is a tandem connection. In a tandem connection, a code string that has been obtained by encoding speech by means of one standard system is first decoded using that standard system to obtain speech signals, and these decoded speech signals are then re-encoded using the other standard system.

A tandem connection therefore entails such problems as a general loss in sound quality, an increase in delay, and an increase in computational load when compared to a case in which coding and encoding are each performed only once by each speech coding/decoding system.

In contrast, an effective solution to the above-described problems can be provided by a code conversion system in which code that is obtained by encoding speech using one standard system is converted to code that can be decoded by the other standard system within encoding regions or encoding parameter regions.

For information regarding methods of converting code, reference can be made to the paper by Hong-Goo Kang et al. entitled "Improving Transcoding Capability of Speech Coders in Clean and Frame Erasured Channel Environments" and published in the Proceedings of the IEEE Workshop on Speech Coding 2000, pp. 78-80, 2000 (Hereinbelow referred to as "Reference 2").

FIG. 1 shows an example of the configuration of a code conversion device for converting code that has been obtained by encoding speech using a first speech encoding system (referred to as "System A") to code that can be converted by a second system (referred to as "System B"). Referring to FIG. 1, LP coefficient code conversion circuit 100, ACB code conversion circuit 200, FCB code conversion circuit 300, and gain code conversion circuit 400 are provided for receiving as input LP coefficient code, ACB code, FCB code, and gain code, respectively, of System A that have been separated by code separation circuit 1010, and then supplying as output LP coefficient code, ACB code, FCB code, and gain code, respectively, of System B to code multiplexing circuit 1020.

In System A, encoding of the linear prediction coefficient is carried out for each $T^{(A)}fr$ msec period (frame), and encoding of the components of excitation signals, i.e., ACB, FCB and gain, is carried out for each $T^{(A)}sfr=T^{(A)}fr/N^{(A)}sfr$ msec period (sub-frame).

In Method B, on the other hand, encoding of the linear prediction coefficient is carried out for each $T^{(B)}fr$ msec period (frame), and encoding of the components of the excitation signal is carried out for each $T^{(B)}sfr=T^{(B)}fr/N^{(B)}sfr$ msec period (sub-frame).

In addition, the frame length, number of sub-frames, and sub-frame length of System A are $L^{(A)}fr$, $N^{(A)}sfr$, and $L^{(A)}sfr=L^{(A)}fr/N^{(A)}sfr$, respectively.

The frame length, number of sub-frames, and sub-frame length of System B are $L^{(B)}fr$, $N^{(B)}sfr$, and $L^{(B)}sfr=L^{(B)}fr/N^{(B)}sfr$, respectively.

To simplify the explanation:

$$L^{(A)}fr=L^{(B)}fr$$

$$N^{(A)}sfr=N^{(B)}sfr=2$$

$$L^{(A)}sfr=L^{(B)}sfr$$

As an example, if the sampling frequency is 8000 Hz (8 KHz), and $T^{(A)}fr$ and $T^{(B)}fr$ are 10 msec, then $L^{(A)}fr$ and $L^{(B)}fr$ will be 160 samples, and $L^{(A)}sfr$ and $L^{(B)}sfr$ will be 80 samples.

Each component of a code conversion device of the prior art is next described with reference to FIG. 1.

A first code string that has been obtained by encoding speech by System A is received as input from input terminal 10.

From the first code string (multiplexed signal) that has been received as input from input terminal 10, code separation circuit 1010 separates codes that correspond to the linear prediction coefficient (LP coefficient), ACB, FCB, ACB gain, and FCB gain, i.e., LP coefficient code, ACB code, FCB code, and gain code.

In this case, the ACB gain and FCB gain are encoded and decoded together, and in the interest of simplifying the explanation, these are referred to as "gain" and the associated code is referred to as "gain code."

In addition, the LP coefficient code, ACB code, FCB code, and gain code are each referred to as "first LP coefficient code," "first ACB code," "first FCB code," and "first gain code."

The first LP coefficient code is then supplied as output to LP coefficient code conversion circuit 100, the first ACB code is supplied as output to ACB code conversion circuit 200, the first FCB code is supplied as output to FCB code conversion circuit 300, and the first gain code is supplied as output to gain code conversion circuit 400.

LP coefficient code conversion circuit 100 receives the first LP coefficient code that is supplied as output from code separation circuit 1010 and converts the first LP coefficient code to a code that can be decoded by means of System B. This converted LP coefficient code is supplied as second LP coefficient code to code multiplexing circuit 1020.

ACB code conversion circuit 200 receives the first ACB code that is supplied as output from code separation circuit 1010, converts the first ACB code to code that can be decoded by System B, and then supplies this converted ACB code as second ACB code to code multiplexing circuit 1020.

FCB code conversion circuit 300 receives the first FCB code that is supplied as output from code separation circuit 1010, converts the first FCB code to code that can be decoded by System B, and then supplies this converted FCB code as second FCB code to code multiplexing circuit 1020.

Gain code conversion circuit 400 receives the first gain code that is supplied as output from code separation circuit 1010, converts this first gain code to code that can be decoded by System B, and then supplies this converted gain code as second gain code to code multiplexing circuit 1020.

The following explanation regards a more specific description of the operations of each of the conversion circuits.

LP coefficient code conversion circuit 100 decodes the first LP coefficient code that has been received from code separation circuit 1010 by means of the LP coefficient decoding system in System A to obtain the first LP coefficient.

LP coefficient code conversion circuit 100 next quantizes and encodes the first LP coefficient by means of the LP coefficient quantization method and encoding method in System B to obtain second LP coefficient code.

LP coefficient code conversion circuit 100 then supplies this second LP coefficient code to code multiplexing circuit 1020 as code that can be decoded by means of the LP coefficient decoding method in System B.

ACB code conversion circuit 200 obtains second ACB code by using the correlation between code in System A and code in System B to convert first ACB code that is received from code separation circuit 1010.

ACB code conversion circuit 200 then supplies second ACB code to code multiplexing circuit 1020 as code that can be decoded by the ACB decoding method in System B.

The conversion of code is next explained with reference to FIG. 2. When ACB code $i^{(A)}T$ in System A is, for example, "56," the corresponding ACB delay $T^{(A)}$ is "76." In System B, if the corresponding ACB delay $T^{(B)}$ is "76" when ACB code $i^{(B)}T$ is "53," ACB code "56" in System A should be placed in correspondence with ACB code "53," in System B when converting ACB code from System A to System B such that the values of the ACB delay are identical (in this case, "76"). This completes the explanation of the conversion of code, and explanation next returns to FIG. 1.

FCB code conversion circuit 300 converts the first FCB code that has been received as input from code separation circuit 1010 using the correlation between code in System A and code in System B to obtain the second FCB code.

This second FCB code is then supplied to code multiplexing circuit 1020 as code that can be decoded by the FCB decoding method in System B.

The conversion of code can be realized by the same System as the previously described conversion of ACB code. Alternatively, this conversion can be realized by a method similar to the conversion of LP coefficient code that is to be explained hereinbelow.

Gain code conversion circuit 400 decodes the first gain code that has been received as input from code separation circuit 1010 by means of the gain decoding method in System A and thus obtains the first gain.

Gain code conversion circuit 400 next quantizes and encodes the first gain by means of the quantization method and encoding method of gain in System B to obtain the second gain code.

Gain code conversion circuit 400 then supplies the second gain code to code multiplexing circuit 1020 as code that can be decoded by the gain decoding method in System B.

This conversion of the gain code can be realized by a method similar to that of the conversion of the LP coefficient code, and to simplify the following explanation, attention is directed only to the conversion of the LP coefficient code, which will be explained in detail.

Each of the components of LP coefficient code conversion circuit 100 is next explained with reference to FIG. 3.

In many standard systems such as the previously described ITU-T Standard G.729, the LP coefficient is often represented by a Line Spectral Pair (hereinbelow abbreviated as "LSP") and the LSP then encoded and decoded. The LP coefficient in the following explanation is therefore represented by an LSP.

In this case, regarding the conversion from LP coefficient to LSP and the conversion from LSP to LP coefficient, reference may be made to well-known methods such as the method described in Section 3.2.3 and Section 3.2.6 in "Coding of Speech at 8 kbits/s using Conjugate-Structure Algebraic-Code-Excited Linear Prediction (CS-ACELP)" (ITU-T Recommendation G.729)(hereinbelow referred to as "Reference 3").

LP coefficient decoding circuit 110 decodes the corresponding LSP from the LP coefficient code. LP coefficient decoding circuit 110 is provided with first LSP codebook 111 in which are stored a plurality of sets of LSP, receives the first LP coefficient code that has been supplied as output from code separation circuit 1010 by way of input terminal 31, reads the LSP that corresponds to the first LP coefficient code from first LSP codebook 111, and supplies the LSP that has been read as the first LSP to LP coefficient encoding circuit 130.

The decoding of LSP from the LP coefficient code follows the method of decoding an LP coefficient in System A (LSP decoding is necessary in this case because the LP coefficient is represented by an LSP) and employs the LSP codebook of System A.

LP coefficient encoding circuit 130 receives the first LSP that has been supplied as output from LP coefficient decoding circuit 110, successively reads each of the second LSP and the corresponding LP coefficient code from second LSP codebook 131 that stores a plurality of sets of LSP, selects the second LSP that has the minimum error with first LSP, and supplies the LP coefficient code that corresponds to this second LSP as the second LP coefficient code to code multiplexing circuit 1020 by way of output terminal 32.

In this case, the method of selecting the second LSP, i.e., the method of quantizing and encoding the LSP, follows the LSP quantization method and encoding method in System B and employs the LSP codebook in System B.

Regarding the quantization and encoding of the LSP, reference may be made to, for example, the description in Section 3.2.4 of Reference 3.

This completes the explanation of LP coefficient code conversion circuit 100, and the explanation next returns to FIG. 1.

Code multiplexing circuit 1020 receives the second LP coefficient code that has been supplied from LP coefficient code conversion circuit 100, the second ACB code that has been supplied from ACB code conversion circuit 200, the second FCB code that has been supplied from FCB code conversion circuit 300, and the second gain code that has been supplied from gain code conversion circuit 400, and supplies the code string that is obtained by multiplexing these codes as the second code string by way of output terminal 20. This completes all explanation referring to FIG. 1.

The configuration of a device that is relevant to the above-described code conversion device of the prior art is disclosed in, for example, Japanese Patent Laid-Open Publication No. 146997 (1996). This reference discloses a configuration that is used when a first speech encoding method and a second speech encoding method perform encoding using different quantization values or quantization methods. This configuration is a code conversion device for converting code that has been multiplexed by the first speech encoding method to code that is multiplexed by the second speech encoding method. In the disclosed configuration, multiplexed code that has been encoded by means of the first speech encoding method is applied as input to a code separation device whereby each code is separated; each of the codes that have been separated by the code separator are converted to the codes according to the second speech encoding method in accordance with the correlation between code according to the first speech encoding method and code according to the second speech encoding method, and in which a multiplexing device multiplexes each of the codes of the second speech encoding method that have been converted by the conversion device.

The inventors of the present invention have found that, when converting ACB code that corresponds to an ACB delay in the prior-art code conversion device that was explained with reference to FIG. 1, there is the problem that, allophones may at times occur in the decoded speech of System B that is generated using an ACB delay that is obtained from the ACB code after code conversion.

This problem occurs due to the mismatching between the ACB delay and the linear prediction coefficient (LP coefficient) and gain in System B. This mismatching occurs because the above-described code conversion device of the prior art directly uses the ACB delay that is found in System A as the ACB delay of System B, even though the interposition of quantization according to System B in the conversion of code for the linear prediction coefficient and gain causes the values of the linear prediction coefficient and gain to differ for System A and System B.

DISCLOSURE OF THE INVENTION

The present invention was realized in view of the above-described problem and has as its principal object the provision of a device, a method, and a recording medium that records the program of such a method, the device, method and program being capable of, when converting ACB code that corresponds to ACB delay in the conversion from a first system to a second system, suppressing the occurrence of allophones in the decoded speech of the second system that is generated using ACB delay that is obtained from ACB code following code conversion.

Other objects, characteristics, and advantages of the present invention will be immediately clear to those who are knowledgeable in the art based on the following explanation.

The first invention of the present application for realizing the above-described object is a code conversion method for converting a first code string to a second code string, the method including steps of:

obtaining a first linear prediction coefficient and excitation signal information from the first code string and generating a speech signal by using an excitation signal that is obtained from the excitation signal information to drive a filter having the first linear prediction coefficient; and using the speech signal and a first adaptive codebook delay that is contained in the excitation signal information to select a second adaptive codebook delay, and supplying code that corresponds to the second adaptive codebook delay as code of an adaptive codebook delay in the second code string.

The second invention of the present application is a code conversion method for converting a first code string to a second code string, the method including:

a first step of obtaining a first linear prediction coefficient from the first code string;

a second step of obtaining excitation signal information from the first code string;

a third step of obtaining an excitation signal from the excitation signal information;

a fourth step of driving a filter having the first linear prediction coefficient by means of the excitation signal to generate a speech signal;

a fifth step of storing and holding a first adaptive codebook delay that is included in the excitation signal information;

a sixth step of storing and holding a second adaptive codebook delay that corresponds to code of an adaptive codebook delay in the second code string;

a seventh step of calculating a search range control value based on the first adaptive codebook delay that has been stored and held and the second adaptive codebook delay that has been stored and held; and an eighth step of using the speech signal to select a second adaptive codebook delay from delay that is within a range stipulated by a search range control value and the first adaptive codebook delay, and supplying code that corresponds to the second adaptive codebook delay as code of an adaptive codebook delay in the second code string.

The third invention of the present application is a code conversion method according to the above-described second invention, in which:

the fifth step includes successively storing the first adaptive codebook delay for each of subframes, which are divisions of frames that are the time units for converting code strings, and holding the first adaptive codebook delay of a predetermined number of subframes;

the sixth step includes successively storing the second adaptive codebook delays for each of the subframes and holding the second adaptive codebook delay of a predetermined number of subframes; and the seventh step includes calculating the absolute value of the difference between the first adaptive codebook delay that has been stored and held and the second adaptive codebook delay that has been stored and held that correspond to the same subframe for all of the first adaptive codebook delays and second adaptive codebook delays that are held, and taking as the search range control value a value that is obtained by adding, for the number of subframes, values obtained by multiplying the absolute values by a weighting coefficient.

The fourth invention of the present application is a code conversion method for converting a first code string to a second code string, the method including:

a first step of obtaining a first linear prediction coefficient from the first code string;

a second step of obtaining excitation signal information from the first code string;

a third step of obtaining an excitation signal from the excitation signal information;

a fourth step of driving a filter having the first linear prediction coefficient by means of the excitation signal to generate a speech signal;

a fifth step of, for each of subframes, which are divisions of frames that are the time units for converting code strings, successively storing a first adaptive codebook delay that is contained in the excitation signal information, and holding the first adaptive codebook delays of a predetermined number of subframes;

a sixth step of, for each of the subframes, successively storing a second adaptive codebook delay that corresponds to code of an adaptive codebook delay in the second code string, and holding the second adaptive codebook delay of a predetermined number of subframes;

a seventh step of calculating the absolute value of the difference between a first adaptive codebook delay that has been stored and held and a second adaptive codebook delay that has been stored and held that correspond to the same subframe for all of the first adaptive codebook delays and second adaptive codebook delays that are held, and taking as a search range control value a value that is obtained by adding, for the number of subframes, values obtained by multiplying the absolute values by a weighting coefficient;

an eighth step of, in at least one subframe in the frame, using the speech signal to select a second adaptive codebook delay from delay that is within a range stipulated by the search range control value and the first adaptive codebook delay, and supplying code that corresponds to the second adaptive codebook delay as code of an adaptive codebook delay in the second code string; and a ninth step of, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string.

The fifth invention of the present application is a code conversion method for converting a first code string to a second code string, the method including:

a first step of obtaining a first linear prediction coefficient from the first code string;

a second step of obtaining excitation signal information from the first code string;

a third step of obtaining an excitation signal from the excitation signal information;

a fourth step of driving a filter having the first linear prediction coefficient by means of the excitation signal to generate a speech signal;

a fifth step of, for each of subframes, which are divisions of frames that are the time units for converting code strings, successively storing a first adaptive codebook delay that is contained in the excitation signal information, and holding the first adaptive codebook delay of a predetermined number of subframes;

a sixth step of, for each of the subframes, successively storing a second adaptive codebook delay that corresponds to code of an adaptive codebook delays in the second code string, and holding the second adaptive codebook delay of a predetermined number of subframes;

a seventh step of calculating difference between the first adaptive codebook delay of consecutive subframes for the first adaptive codebook delays that have been stored and held and the first adaptive codebook delay of the current subframe, calculating absolute value of the difference, and taking as a search range control value a value that is obtained by adding, for the number of subframes, values obtained by multiplying the absolute values by a weighting coefficient;

an eighth step of, in at least one subframe in the frame, using the speech signal to select a second adaptive codebook delay from delay that is within a range stipulated by the search range control value and the second adaptive codebook delay that has been previously found, stored and held, and supplying code that corresponds to the second adaptive codebook delay as code of an adaptive codebook delay in the second code string; and a ninth step of, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first-adaptive codebook delay in correspondence with the second adaptive codebook delay and thus convert from the first delay code to the second delay code, and supplying the second delay code as code of an adaptive codebook delay in the second code string.

The sixth invention of the present application is a code conversion method for converting a first code string to a second code string, the method including:

a first step of obtaining a first linear prediction coefficient from the first code string;

a second step of obtaining excitation signal information from the first code string;

a third step of obtaining an excitation signal from the excitation signal information;

a fourth step of driving a filter having the first linear prediction coefficient by means of the excitation signal to generate a speech signal;

a fifth step of, for each of subframes, which are divisions of frames that are the time units for converting code strings, successively storing first adaptive codebook delays that are contained in the excitation signal information; and holding the first adaptive codebook delays for a predetermined number of subframes;

a sixth step of, for each of the subframes, successively storing a second adaptive codebook delay that corresponds to code of an adaptive codebook delay in the second code string, and holding the second adaptive codebook delay of a predetermined number of subframes;

a seventh step of, in at least one subframe in the frame, calculating absolute value of the difference between the first adaptive codebook delay that has been stored and held and the second adaptive codebook delay that has stored and held that correspond to the same subframe for all of the first adaptive codebook delays and second adaptive codebook delays that have been held, and taking as a search range control value a value that is obtained by adding, for the number of subframes, values obtained by multiplying the absolute values by a weighting coefficient; and in other subframes, calculating differences between the first adaptive codebook delays of consecutive subframes for the first adaptive codebook delays that have been stored and held and the first adaptive codebook delays of the current subframe, calculating absolute values of the differences, and taking as a search range control value a value that is obtained by adding, for the number of subframes, values obtained by multiplying the absolute values by a weighting coefficient;

an eighth step of, in at least one subframe in the frame, using the speech signal to select a second adaptive codebook delay from delay that is within a range stipulated by the search range control value and the first adaptive codebook delay, and supplying code that corresponds to the second adaptive codebook delay as code of an adaptive codebook delay in the second code string; and in other subframes, using the speech signal to select a second adaptive codebook delay from delay that is within a range stipulated by the search range control value and the second adaptive codebook delay that has been previously found, stored, and held, and supplying code that corresponds to the second adaptive codebook delay as code of an adaptive codebook delay in the second code string.

The seventh invention of the present application is a code conversion method according to the second to sixth inventions in which the eighth step includes:

for delay that is within the range, calculating an autocorrelation or a normalized autocorrelation from the speech signal and selecting the delay for which the autocorrelation or the normalized autocorrelation is a maximum as the second adaptive codebook delay.

The eighth invention of the present application is a code conversion method for converting a first code string to a second code string, the method including steps of:

obtaining a first linear prediction coefficient and excitation signal information from the first code string and driving a filter having the first linear prediction coefficient by means of a first excitation signal that has been obtained from the excitation signal information to generate a speech signal;

obtaining a second linear prediction coefficient from the first linear prediction coefficient;

using a first adaptive codebook delay that is contained in the excitation signal information and a second excitation signal that has been previously calculated, stored, and held to successively generate adaptive codebook signals, using the speech signal and a first reconstructed speech signal that has been successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

obtaining a second excitation signal from the selected adaptive codebook signal; and storing and holding the second excitation signal.

The ninth invention of the present application is a code conversion method for converting a first code string to a second code string, the method including:

a first step of obtaining a first linear prediction coefficient from the first code string;

a second step of obtaining excitation signal information from the first code string;

a third step of obtaining a first excitation signal from the excitation signal information;

a fourth step of driving a filter having the first linear prediction coefficient by means of the first excitation signal to generate a speech signal;

a fifth step of obtaining a second linear prediction coefficient from the first linear prediction coefficient;

a sixth step of storing and holding a first adaptive codebook delay that is contained in the excitation signal information;

a seventh step of storing and holding a second adaptive codebook delay that corresponds to code of an adaptive codebook delay in the second code string;

an eighth step of calculating a search range control value from the first adaptive codebook delay that has been stored and held and the second adaptive codebook delay that has been stored and held;

a ninth step of, for delay that is within a range stipulated by the search range control value and the first adaptive codebook delay, successively generating an adaptive codebook signal from the second excitation signal that has been previously calculated, stored and held, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

a tenth step of obtaining a second excitation signal from the selected adaptive codebook signal; and an eleventh step of storing and holding the second excitation signal.

The tenth invention of the present application is a code conversion method according to the ninth invention in which:

the sixth step includes, for each of subframes, which are divisions of frames that are the time units for converting code strings, successively storing the first adaptive codebook delay and holding the first adaptive codebook delay for a predetermined number of subframes;

the seventh step includes, for each of the subframes, successively storing the second adaptive codebook delay and holding the second adaptive codebook delay for a predetermined number of subframes; and the eighth step includes calculating the absolute value of the difference between the first adaptive codebook delay that has been stored and held and the second adaptive codebook delay that has been stored and held that correspond to the same subframe for all of the first adaptive codebook delays and second adaptive codebook delays that are held, and taking as the search range control value a value that is obtained by adding, for the number of subframes, values obtained by multiplying the absolute values by a weighting coefficient.

The eleventh invention of the present application is a code conversion method for converting a first code string to a second code string, the method including:

a first step of obtaining a first linear prediction coefficient from the first code string;

a second step of obtaining excitation signal information from the first code string;

a third step of obtaining a first excitation signal from the excitation signal information;

a fourth step of driving a filter having the first linear prediction coefficient by means of the first excitation signal to generate a speech signal;

a fifth step of obtaining a second linear prediction coefficient from the first linear prediction coefficient;

a sixth step of, for each of subframes, which are divisions of frames that are the time units for converting code strings, successively storing a first adaptive codebook delay that is contained in the excitation signal information and holding the first adaptive codebook delay for a predetermined number of subframes;

a seventh step of, for each of the subframes, successively storing a second adaptive codebook delay that corresponds to code of an adaptive codebook delay in the second code string and holding the second adaptive codebook delay of a predetermined number of subframes;

an eighth step of calculating the absolute value of the difference between the first adaptive codebook delay that has been stored and held and the second adaptive codebook delay that has been stored and held that correspond to the same subframe for all of the first adaptive codebook delays and second adaptive codebook delays that have been held, and taking as the search range control value a value that is obtained by adding, for the number of subframes, values obtained by multiplying the absolute values by a weighting coefficient;

a ninth step of, in at least one subframe in the frame, successively generating an adaptive codebook signal from the second excitation signal that has been previously calculated, stored and held for delay that is within a range stipulated by the search range control value and the first adaptive codebook delay, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

a tenth step of, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string;

an eleventh step of obtaining a second excitation signal from the selected adaptive codebook signal; and a twelfth step of storing and holding the second excitation signal.

The twelfth invention of the present application is a code conversion method for converting a first code string to a second code string, the method including:

a first step of obtaining a first linear prediction coefficient from the first code string;

a second step of obtaining excitation signal information from the first code string;

a third step of obtaining a first excitation signal from the excitation signal information;

a fourth step of driving a filter having the first linear prediction coefficient by means of the first excitation signal to generate a speech signal;

a fifth step of obtaining a second linear prediction coefficient from the first linear prediction coefficient;

a sixth step of, for each of subframes, which are divisions of frames that are the time units for converting code strings, successively storing a first adaptive codebook delay that is contained in the excitation signal information, and holding the first adaptive codebook delay for a predetermined number of subframes;

a seventh step of, for each of the subframes, successively storing a second adaptive codebook delay that corresponds to code of an adaptive codebook delay in the second code string and holding the second adaptive codebook delay of a predetermined number of subframes;

an eighth step of calculating the difference between the first adaptive codebook delays of consecutive subframes for a first adaptive codebook delay that has been stored and held and the first adaptive codebook delay of the current subframe, calculating absolute value of the difference, and taking as the search range control value a value that is obtained by adding, for the number of subframes, values obtained by multiplying the absolute values by a weighting coefficient;

a ninth step of, in at least one subframe in the frame, successively generating an adaptive codebook signal from a second excitation signal that has been previously calculated, stored and held for delay that is within a range stipulated by the search range control value and the second adaptive codebook delay that has been previously found, stored, and held, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

a tenth step of, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string;

an eleventh step of obtaining a second excitation signal from the selected adaptive codebook signal; and a twelfth step of storing and holding the second excitation signal.

The thirteenth invention of the present application is a code conversion method for converting a first code string to a second code string, the method including:

a first step of obtaining a first linear prediction coefficient from the first code string;

a second step of obtaining excitation signal information from the first code string;

a third step of obtaining a first excitation signal from the excitation signal information;

a fourth step of driving a filter having the first linear prediction coefficient by means of the first excitation signal to generate a speech signal;

a fifth step of obtaining a second linear prediction coefficient from the first linear prediction coefficient;

a sixth step of, for each of subframes, which are divisions of frames that are the time units for converting code strings, successively storing a first adaptive codebook delay that is contained in the excitation signal information, and holding the first adaptive codebook delay for a predetermined number of subframes;

a seventh step of, for each of the subframes, successively storing a second adaptive codebook delay that corresponds to code of an adaptive codebook delay in the second code string and holding the second adaptive codebook delay of a predetermined number of subframes;

an eighth step of calculating, in at least one subframe in the frame, the absolute value of the difference between the first adaptive codebook delay that has been stored and held and the second adaptive codebook delay that has been stored and held that correspond to the same subframe for all of the first adaptive codebook delays and second adaptive codebook delays that have been held, and taking as a search range control value a value that is obtained by adding, for the number of subframes, values obtained by multiplying the absolute values by a weighting coefficient; and in other subframes, calculating the difference between the first adaptive codebook delay of consecutive subframes for the first adaptive codebook delay that has been stored and held and the first adaptive codebook delay of the current subframe, calculating absolute value of the difference, and taking as a search range control value a value obtained by adding, for the number of subframes, values obtained by multiplying the absolute values by a weighting coefficient;

a ninth step of, in at least one subframe in the frame, successively generating an adaptive codebook signal from a second excitation signal that has been previously calculated, stored and held for delay that is within a range stipulated by the search range control value and the first adaptive codebook delay, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string; and in other subframes, successively generating an adaptive codebook signal from a second excitation signal that has been previously calculated, stored, and held for delay that is within a range stipulated by a search range control value and the second adaptive codebook delay that has been previously found, stored and held, and using the speech signal and a first reconstructed speech signal that has been successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

a tenth step of obtaining a second excitation signal from the selected adaptive codebook signal; and an eleventh step of storing and holding the second excitation signal.

The fourteenth invention of the present application is a code conversion method according to the ninth to thirteenth inventions in which the ninth step includes:

for delays that are within the range, selecting the adaptive codebook signals and delays such that the squared error between the first reconstructed speech signals and the speech signals is a minimum, and taking the selected delays as the second adaptive codebook delays.

The fifteenth invention of the present application is a code conversion device for converting a first code string to a second code string, the code conversion device including:

a speech decoding circuit for obtaining a first linear prediction coefficient and excitation signal information from the first code string and driving a filter having the first linear prediction coefficient by means of an excitation signal that is obtained from the excitation signal information to generate a speech signal; and an adaptive codebook code generation circuit for using the speech signal and a first adaptive codebook delay that is contained in the excitation signal information to select a second adaptive codebook delay, and supplying code that corresponds to the second adaptive codebook delay as code of an adaptive codebook delay in the second code string.

The sixteenth invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining an excitation signal from the excitation signal information;

a compound filter for generating a speech signal by driving a filter having the first linear prediction coefficient by means of the excitation signal;

an adaptive codebook delay storage circuit for storing and holding a first adaptive codebook delay that is contained in the excitation signal information;

a second adaptive codebook delay storage circuit for storing and holding a second adaptive codebook delay that corresponds to code of an adaptive codebook delay in the second code string;

an adaptive codebook delay search range control circuit for calculating a search range control value from the first adaptive codebook delay that is stored and held and the second adaptive codebook delay that is stored and held; and an adaptive codebook encoding circuit for using the speech signal to select a second adaptive codebook delay from delay that is within the range stipulated by the search range control value and the first adaptive codebook delay, and supplying code that corresponds to the second adaptive codebook delay as code of an adaptive codebook delay in the second code string.

The seventeenth invention of the present application is a code conversion device according to the sixteenth invention, in which:

the adaptive codebook delay storage circuit successively stores the first adaptive codebook delays for each of subframes, which are divisions of frames that are the time units for converting code strings, and holds the first adaptive codebook delays for a predetermined number of subframes;

the second adaptive codebook delay storage circuit successively stores the second adaptive codebook delays for each of the subframes and holds the second adaptive codebook delays for a predetermined number of subframes; and the adaptive codebook delay search range control circuit calculates the absolute values of the differences between the first adaptive codebook delays that have been stored and held and the second adaptive codebook delays that have been stored and held that correspond to the same subframe for each of the first adaptive codebook delays and second adaptive codebook delays that are being held, and takes as the search range control value a value that is obtained by adding, for the number of subframes, values that are obtained by multiplying the absolute values by a weighting coefficient.

The eighteenth invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining an excitation signal from the excitation signal information;

a compound filter for generating a speech signal by driving a filter having the first linear prediction coefficient by means of the excitation signal;

an adaptive codebook delay storage circuit for, for each of subframes, which are divisions of frames that are the time units of converting code strings, successively storing a first adaptive codebook delay that is contained in the excitation signal information, and holding the first adaptive codebook delay for a predetermined number of subframes;

a second adaptive codebook delay storage circuit for, for each of the subframes, successively storing a second adaptive codebook delay that correspond to codes of adaptive codebook delays in the second code string, and holding the second adaptive codebook delays for each of a predetermined number of subframes;

an adaptive codebook delay search range control circuit for calculating the absolute value of the difference between the first adaptive codebook delay that has been stored and held and the second adaptive codebook delay that has been stored and held that correspond to the same subframe for all of the first adaptive codebook delays and second adaptive codebook delays that are held, and taking as a search range control value a value that is obtained by adding, for the number of subframes, values obtained by multiplying the absolute values by a weighting coefficient;

an adaptive codebook encoding circuit for, in at least one subframe in the frame, using the speech signal to select a second adaptive codebook delay from delay that is within a range stipulated by the search range control value and the first adaptive codebook delay, and supplying code that corresponds to the second adaptive codebook delay as code of an adaptive codebook delay in the second code string; and an adaptive codebook code conversion circuit for, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string.

The nineteenth invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining an excitation signal from the excitation signal information;

a compound filter for generating a speech signal by driving a filter having the first linear prediction coefficient by means of the excitation signal;

an adaptive codebook delay storage circuit for, for each of subframes, which are divisions of frames that are the time units of converting code strings, successively storing a first adaptive codebook delay that is contained in the excitation signal information, and holding the first adaptive codebook delay for a predetermined number of subframes;

a second adaptive codebook delay storage circuit for, for each of the subframes, successively storing a second adaptive codebook delay that corresponds to code of an adaptive codebook delay in the second code string, and holding the second adaptive codebook delay for each of a predetermined number of subframes;

an adaptive codebook delay search range control circuit for calculating the difference between the first adaptive codebook delay of consecutive subframes for the first adaptive codebook delay that have been stored and held and the first adaptive codebook delay of the current subframe, calculating the absolute value of the difference, and taking as a search range control value a value that is obtained by adding, for the number of subframes, values obtained by multiplying the absolute values by a weighting coefficient;

an adaptive codebook encoding circuit for, in at least one subframe in the frame, using the speech signal to select a second adaptive codebook delay from delay that is within a range stipulated by the search range control value and the second adaptive codebook delay that has been previously found, stored, and held, and supplying code that corresponds to the second adaptive codebook delay as code of an adaptive codebook delay in the second code string; and an adaptive codebook code conversion circuit for, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string.

The twentieth invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining an excitation signal from the excitation signal information;

a compound filter for generating a speech signal by driving a filter having the first linear prediction coefficient by means of the excitation signal;

an adaptive codebook delay storage circuit for, for each of subframes, which are divisions of frames that are the time units of converting code strings, successively storing a first adaptive codebook delay that is contained in the excitation signal information, and holding the first adaptive codebook delay for a predetermined number of subframes;

a second adaptive codebook delay storage circuit for, for each of the subframes, successively storing a second adaptive codebook delay that corresponds to code of an adaptive codebook delay in the second code string, and holding the second adaptive codebook delay for each of a predetermined number of subframes;

an adaptive codebook delay search range control circuit for calculating, in at least one subframe in the frame, the absolute value of the difference between the first adaptive codebook delay that has been stored and held and the second adaptive codebook delay that has been stored and held that correspond to the same subframe for all of the first adaptive codebook delays and second adaptive codebook delays that are held, and taking as a search range control value a value that is obtained by adding, for the number of subframes, values obtained by multiplying the absolute values by a weighting coefficient; and in other subframes, calculating the difference between the first adaptive codebook delay of consecutive subframes for the first adaptive codebook delay that has been stored and held and the first adaptive codebook delay of the current subframe, calculating. the absolute value of the difference, and taking as a search range control value a value obtained by adding, for the number of subframes, values obtained by multiplying the absolute values by a weighting coefficient; and an adaptive codebook encoding circuit for, in at least one subframe in the frame, using the speech signal to select a second adaptive codebook delay from delay that is within a range stipulated by the search range control value and the first adaptive codebook delay, and taking code that corresponds to the second adaptive codebook delay as code of an adaptive codebook delay in the second code string; and in other subframes, using the speech signal to select a second adaptive codebook delay from delay that is within a range stipulated by the search range control value and the second adaptive codebook delay that has been previously found, stored, and held, and supplying code that corresponds to the second adaptive codebook delay as code of an adaptive codebook delay in the second code string.

The twenty-first invention of the present application is a code conversion device according to the sixteenth to the twentieth inventions in which:

the adaptive codebook encoding circuit, for delay within the range, calculates an autocorrelation or a normalized autocorrelation from the speech signal, and selects the delay for which the autocorrelation or normalized autocorrelation is a maximum as the second adaptive codebook delay.

The twenty-second invention of the present application is a code conversion device for converting a first code string to a second code string, the code conversion device including:

a speech decoding circuit for obtaining a first linear prediction coefficient and excitation signal information from the first code string, and driving a filter having the first linear prediction coefficient by means of a first excitation signal that is obtained from the excitation signal information to generate a speech signal;

a linear prediction coefficient code conversion circuit for obtaining a second linear prediction coefficient from the first linear prediction coefficient;

an adaptive codebook code generation circuit for using a first adaptive codebook delay that is contained in the excitation signal information and a second excitation signal that has been previously calculated, stored, and held to successively generate an adaptive codebook signal, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

a second excitation signal calculation circuit for obtaining a second excitation signal from the selected adaptive codebook signal; and a second excitation signal storage circuit for storing and holding the second excitation signal.

The twenty-third invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining a first excitation signal from the excitation signal information;

a compound filter for generating a speech signal by driving a filter having the first linear prediction coefficient by means of the first excitation signal;

a linear prediction coefficient encoding circuit for obtaining a second linear prediction coefficient from the first linear prediction coefficient;

an adaptive codebook delay storage circuit for storing and holding a first adaptive codebook delay that is contained in the excitation signal information;

a second adaptive codebook delay storage circuit for storing and holding a second adaptive codebook delay that corresponds to code of an adaptive codebook delay in the second code string;

an adaptive codebook delay search range control circuit for calculating a search range control value from the first adaptive codebook delay that has been stored and held and the second adaptive codebook delay that has been stored and held;

an adaptive codebook encoding circuit for, for delay that is within a range that is stipulated by the search range control value and the first adaptive codebook delay, successively generating an adaptive codebook signal from a second excitation signal that has been previously calculated, stored, and held, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

a second excitation signal calculation circuit for obtaining a second excitation signal from the selected adaptive codebook signal; and a second excitation signal storage circuit for storing and holding the second excitation signal.

The twenty-fourth invention of the present application is a code conversion device according to the twenty-third invention, in which:

the adaptive codebook delay storage circuit, for each of subframes, which are divisions of frames that are the time units for converting code strings, successively stores the first adaptive codebook delay and holds the first adaptive codebook delay for a predetermined number of subframes;

the second adaptive codebook delay storage unit successively stores the second adaptive codebook delay for each of the subframes and holds the second adaptive codebook delay for a predetermined number of subframes; and the adaptive codebook delay search range control circuit calculates the absolute value of difference between the first adaptive codebook delay that has been stored and held and the second adaptive codebook delay that has been stored and held and that correspond to the same subframe for all of the first adaptive codebook delays and the second adaptive codebook delays that are held, and takes as the search range control value a value that is obtained by adding, for the number of subframes, values that are obtained by multiplying the absolute values by a weighting coefficient.

The twenty-fifth invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining a first excitation signal from the excitation signal information;

a compound filter for generating a speech signal by driving a filter having the first linear prediction coefficient by means of the first excitation signal;

a linear prediction coefficient encoding circuit for obtaining a second linear prediction coefficient from the first linear prediction coefficient;

an adaptive codebook delay storage circuit for, for each of subframes, which are divisions of frames that are the time units of converting code strings, successively storing a first adaptive codebook delay that is contained in the excitation signal information and holding the first adaptive codebook delay for a predetermined number of subframes;

a second adaptive codebook delay storage circuit for, for each subframe, successively storing a second adaptive codebook delay that corresponds to code of an adaptive codebook delay in the second code string, and holding the second adaptive codebook delay for a predetermined number of subframes;

an adaptive codebook delay search range control circuit for calculating the absolute value of the difference between the first adaptive codebook delay that has been stored and held and the second adaptive codebook delay that has been stored and held that correspond to the same subframe for all of the first adaptive codebook delays and the second adaptive codebook delays that are held, and taking as the search range control value a value that is obtained by adding, for the number of subframes, values that are obtained by multiplying the absolute values by a weighting coefficient;

an adaptive codebook encoding circuit for, for at least one subframe in the frame, successively generating an adaptive codebook signal from the second excitation signal that has been previously calculated, stored, and held for delay that is within a range that is stipulated by the search range control value and the first adaptive codebook delay, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

an adaptive codebook code conversion circuit for, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string;

a second excitation signal calculation circuit for obtaining a second excitation signal from the selected adaptive codebook signal; and a second excitation signal storage circuit for storing and holding the second excitation signal.

The twenty-sixth invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining a first excitation signal from the excitation signal information;

a compound filter for generating a speech signal by driving a filter having the first linear prediction coefficient by means of the first excitation signal;

a linear prediction coefficient encoding circuit for obtaining a second linear prediction coefficient from the first linear prediction coefficient;

an adaptive codebook delay storage circuit for, for each of subframes, which are divisions of frames that are the time units of converting code strings, successively storing a first adaptive codebook delay that is contained in the excitation signal information, and holding the first adaptive codebook delay for a predetermined number of subframes;

a second adaptive codebook delay storage circuit for, for each of the subframes, successively storing a second adaptive codebook delay that corresponds to code of an adaptive codebook delay in the second code string, and holding the second adaptive codebook delay for a predetermined number of subframes;

an adaptive codebook delay search range control circuit for calculating the difference between the first adaptive codebook delay of consecutive subframes for the first adaptive codebook delay that has been stored and held and the first adaptive codebook delay of the current subframe, calculating the absolute value of the difference, and taking as search range control value a value that is obtained by adding, for the number of subframes, values that are obtained by multiplying the absolute values by a weighting coefficient;

an adaptive codebook encoding circuit for, in at least one subframe in the frame,. successively generating an adaptive codebook signal from a second excitation signal that has been previously calculated, stored, and held for delay that is within a range that is stipulated by the search range control value and the second adaptive codebook delay that has been previously found, stored, and held, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

an adaptive codebook code conversion circuit for, in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code; and supplying the second delay code as code of an adaptive codebook delay in the second code string;

a second excitation signal calculation circuit for obtaining a second excitation signal from the selected adaptive codebook signal; and a second excitation signal storage circuit for storing and holding the second excitation signal.

The twenty-seventh invention of the present application is a code conversion device for converting a first code string to a second code string, the code conversion device including:

a linear prediction coefficient decoding circuit for obtaining a first linear prediction coefficient from the first code string;

an excitation signal information decoding circuit for obtaining excitation signal information from the first code string;

an excitation signal calculation circuit for obtaining a first excitation signal from the excitation signal information;

a compound filter for generating a speech signal by driving a filter having the first linear prediction coefficient by means of the first excitation signal;

a linear prediction coefficient encoding circuit for obtaining a second linear prediction coefficient from the first linear prediction coefficient;

an adaptive codebook delay storage circuit for, for each of subframes, which are divisions of frames that are the time units of converting code strings, successively storing a first adaptive codebook delay that is contained in the excitation signal information, and holding the first adaptive codebook delay for a predetermined number of subframes;

a second adaptive codebook delay storage circuit for, for each of the subframes, successively storing a second adaptive codebook delay that corresponds to code of an adaptive codebook delay in the second code string, and holding the second adaptive codebook delay for a predetermined number of subframes;

an adaptive codebook delay search range control circuit for, in at least one subframe in the frame, calculating the absolute value of the difference between the first adaptive codebook delay that has been stored and held and the second adaptive codebook delay that has been stored and held that correspond to the same subframe for all of the first adaptive codebook delays and second adaptive codebook delays that have been held, and taking as a search range control value a value that is obtained by adding, for the number of subframes, values obtained by multiplying the absolute values by a weighting coefficient; and in other subframes, calculating the difference between the first adaptive codebook delay of consecutive subframes for the first adaptive codebook delay that has been stored and held and the first adaptive codebook delay of the current subframe, calculating the absolute value of the difference, and taking as a search range control value a value obtained by adding, for the number of subframes, values obtained by multiplying the absolute values by a weighting coefficient;

an adaptive codebook encoding circuit for, in at least one subframe in the frame, successively generating an adaptive codebook signal from a second excitation signal that has been previously calculated, stored, and held for delay that is within a range that is stipulated by the search range control value and the first adaptive codebook delay, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delays the second code string; and in other subframes, successively generating an adaptive codebook signal from a second excitation signal that has been previously calculated, stored, and held for delay that is within a range stipulated by a search range control value and the second adaptive codebook delay that has been previously found, stored, and held, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

a second excitation signal calculation circuit for obtaining a second excitation signal from the selected adaptive codebook signal; and a second excitation signal storage circuit for storing and holding the second excitation signal.

The twenty-eighth invention of the present application is a code conversion device according to the twenty-third and twenty-fourth inventions, in which:

the adaptive codebook encoding circuit, for delay that is within the previously described range, selects the adaptive codebook signal and delay such that the squared error between said first reconstructed speech signal and said speech signal is a minimum, and takes the selected delay as second adaptive codebook delay.

The twenty-ninth invention of the present application provides a program for causing a computer, which constitutes a code conversion device for converting a first code string to a second code string, to execute processes of:

(1) obtaining a first linear prediction coefficient and excitation signal information from the first code string, and driving a filter having the first linear prediction coefficient by means of an excitation signal that has been obtained from the excitation signal information to generate a speech signal; and (2) using the speech signal and a first adaptive codebook delay that is contained in the excitation signal information to select a second adaptive codebook delay, and supplying code that corresponds to the second adaptive codebook delay as code of an adaptive codebook delay in the second code string.

The thirtieth invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining an excitation signal from the excitation signal information;

(d) driving a filter having the first linear prediction coefficient by means of the excitation signal to generate a speech signal;

(e) storing and holding a first adaptive codebook delay that is contained in the excitation signal information;

(f) storing and holding a second adaptive codebook delay that corresponds to code of an adaptive codebook delay in the second code string;

(g) calculating a search range control value based on the first adaptive codebook delay that has been stored and held and the second adaptive codebook delay that has been stored and held; and (h) using the speech signal to select a second adaptive codebook delay from delay that is within a range stipulated by the search range control value and the first adaptive codebook delay, and supplying code that corresponds to the second adaptive codebook delay as code of an adaptive codebook delay in the second code string.

The thirty-first invention of the present application provides a program according to the thirtieth invention for causing a computer to execute processes of:

(e) successively storing the first adaptive codebook delays for each of subframes, which are divisions of frames that are the time units for converting code strings, and holding the first adaptive codebook delays of a predetermined number of subframes;

(f) successively storing the second adaptive codebook delays for each of the subframes and holding the second adaptive codebook delays of a predetermined number of subframes; and (g) calculating the absolute values of the differences between the first adaptive codebook delays that have been stored and held and the second adaptive codebook delays that have been stored and held that correspond to the same subframes for all of the first adaptive codebook delays and second adaptive codebook delays that are being held, and taking as the search range control value a value that is obtained by adding, for the number of subframes, values obtained by multiplying the absolute values by a weighting coefficient.

The thirty-second invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining an excitation signal from the excitation signal information;

(d) driving a filter having the first linear prediction coefficient by means of the excitation signal to generate a speech signal;

(e) for each of subframes, which are divisions of frames that are the time units for converting code strings, successively storing a first adaptive codebook delay that is contained in the excitation signal information, and holding the first adaptive codebook delay for a predetermined number of subframes;

(f) for each of the subframes, successively storing a second adaptive codebook delay that corresponds to code of an adaptive codebook delay in the second code string, and holding the second adaptive codebook delay of a predetermined number of subframes;

(g) calculating absolute value of the difference between the first adaptive codebook delay that has been stored and held and the second adaptive codebook delay that has been stored and held that correspond to the same subframe for all of the first adaptive codebook delays and second adaptive codebook delays that are held, and taking as a search range control value a value that is obtained by adding, for the number of subframes, values obtained by multiplying the absolute values by a weighting coefficient;

(h) in at least one subframe of the frame, using the speech signal to select a second adaptive codebook delay from delay that is within a range stipulated by the search range control value and the first adaptive codebook delay, and supplying code that corresponds to the second adaptive codebook delay as code of an adaptive codebook delay in the second code string; and (i) in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string.

The thirty-third invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining an excitation signal from the excitation signal information;

(d) driving a filter having the first linear prediction coefficient by means of the excitation signal to generate a speech signal;

(e) for each of subframes, which are divisions of frames that are the time units for converting code strings, successively storing a first adaptive codebook delay that is contained in the excitation signal information, and holding the first adaptive codebook delay for a predetermined number of subframes;

(f) for each of the subframes, successively storing a second adaptive codebook delay that corresponds to code of an adaptive codebook delay in the second code string, and holding the second adaptive codebook delay of a predetermined number of subframes;

(g) calculating the difference between the first adaptive codebook delay of consecutive subframes for the first adaptive codebook delays that have been stored and held and the first adaptive codebook delay of the current subframe, calculating absolute values of the differences, and taking as a search range control value a value that is obtained by adding, for the number of subframes, values obtained by multiplying the absolute values by a weighting coefficient;

(h) in at least one subframe in the frame, using the speech signal to select a second adaptive codebook delay from delay that is within a range stipulated by the search range control value and the second adaptive codebook delay that has been previously found, stored and held, and supplying code that corresponds to the second adaptive codebook delay as code of an adaptive codebook delay in the second code string; and (i) in at least one subframe of the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string.

The thirty-fourth invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining an excitation signal from the excitation signal information;

(d) driving a filter having the first linear prediction coefficient by means of the excitation signal to generate a speech signal;

(e) for each of subframes, which are divisions of frames that are the time units for converting code strings, successively storing a first adaptive codebook delay that is contained in the excitation signal information; and holding the first adaptive codebook delay for a predetermined number of subframes;

(f) for each of the subframes, successively storing a second adaptive codebook delay that corresponds to code of an adaptive codebook delay in the second code string, and holding the second adaptive codebook delay of a predetermined number of subframes;

(g) in at least one subframe in the frame, calculating the absolute value of the difference between the first adaptive codebook delay that has been stored and held and the second adaptive codebook delay that has been stored and held that correspond to the same subframe for all of the first adaptive codebook delays and second adaptive codebook delays that have been held, and taking as a search range control value a value that is obtained by adding, for the number of subframes, values obtained by multiplying the absolute values by a weighting coefficient; and in other subframes, calculating differences between the first adaptive codebook delays of consecutive subframes for the first adaptive codebook delays that have been stored and held and the first adaptive codebook delays of the current subframe, calculating absolute values of the differences, and taking as a search range control value a value that is obtained by adding, for the number of subframes, values obtained by multiplying the absolute values by a weighting coefficient; and (h) in at least one subframe in the frame, using the speech signal to select a second adaptive codebook delay from delay that is within a range stipulated by the search range control value and the first adaptive codebook delay, and supplying code that corresponds to the second adaptive codebook delay as code of adaptive codebook delay in the second code string; and in other subframes, using the speech signal to select a second adaptive codebook delay from delay that is within a range stipulated by the search range control value and the second adaptive codebook delay that has been previously found, stored, and held, and supplying code that corresponds to the second adaptive codebook delay as code of an adaptive codebook delay in the second code string.

The thirty-fifth invention of the present application provides a program according to the thirtieth to thirty-fourth inventions for causing a computer to execute processes of:

(h) for delay that is within the range, calculating an autocorrelation or a normalized autocorrelation from the speech signal and selecting the delay for which the autocorrelation or the normalized autocorrelation is a maximum as the second adaptive codebook delay.

The thirty-sixth invention of the present application provides a program for causing a computer, which constitutes a code conversion device for converting a first code string to a second code string, to execute processes of:

(1) obtaining a first linear prediction coefficient and excitation signal information from the first code string and driving a filter having the first linear prediction coefficient by means of a first excitation signal that has been obtained from the excitation signal information to generate a speech signal;

(2) obtaining a second linear prediction coefficient from the first linear prediction coefficient;

(3) using the first adaptive codebook delay that is contained in the excitation signal information and a second excitation signal that has been previously calculated, stored, and held to successively generate an adaptive codebook signal, using the speech signal and a first reconstructed speech signal that has been successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

(4) obtaining a second excitation signal from the selected adaptive codebook signal; and (5) storing and holding the second excitation signal.

The thirty-seventh invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining a first excitation signal from the excitation signal information;

(d) driving a filter having the first linear prediction coefficient by means of the first excitation signal to generate a speech signal;

(e) obtaining a second linear prediction coefficient from the first linear prediction coefficient;

(f) storing and holding a first adaptive codebook delay that is contained in the excitation signal information;

(g) storing and holding a second adaptive codebook delay that corresponds to code of an adaptive codebook delay in the second code string;

(h) calculating a search range control value from the first adaptive codebook delay that has been stored and held and the second adaptive codebook delay that has been stored and held;

(i) for delay that is within a range stipulated by the search range control value and the first adaptive codebook delay, successively generating an adaptive codebook signal from the second excitation signal that has been previously calculated, stored and held, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

(j) obtaining a second excitation signal from the selected adaptive codebook signal; and (k) storing and holding the second excitation signal.

The thirty-eighth invention of the present application provides a program according to the thirty-seventh invention for causing a computer to execute processes of:

(f) for each of subframes, which are divisions of frames that are the time units for converting code strings, successively storing the first adaptive codebook delay and holding the first adaptive codebook delay for a predetermined number of subframes;

(g) for each of the subframes, successively storing the second adaptive codebook delay and holding the second adaptive codebook delay for a predetermined number of subframes; and (h) calculating the absolute value of difference between the first adaptive codebook delay that has been stored and held and the second adaptive codebook delay that has been stored and held that correspond to the same subframe for all of the first adaptive codebook delays and second adaptive codebook delays that are held, and taking as the search range control value a value that is obtained by adding, for the number of subframes, values obtained by multiplying the absolute values by a weighting coefficient.

The thirty-ninth invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining a first excitation signal from the excitation signal information;

(d) driving a filter having the first linear prediction coefficient by means of the first excitation signal to generate a speech signal;

(e) obtaining a second linear prediction coefficient from the first linear prediction coefficient;

(f) for each of subframes, which are divisions of frames that are the time units for converting code strings, successively storing a first adaptive codebook delay that is contained in the excitation signal information, and holding the first adaptive codebook delay for a predetermined number of subframes;

(g) for each of the subframes, successively storing a second adaptive codebook delay that corresponds to code of an adaptive codebook delay in the second code string and holding the second adaptive codebook delay of a predetermined number of subframes;

(h) calculating the absolute value of the difference between the first adaptive codebook delay that has been stored and held and the second adaptive codebook delay that has been stored and held that correspond to the same subframe for all of the first adaptive codebook delays and second adaptive codebook delays that have been held, and taking as the search range control value a value that is obtained by adding, for the number of subframes, values obtained by multiplying the absolute values by a weighting coefficient;

(i) in at least one subframe in the frame, successively generating an adaptive codebook signal from the second excitation signal that has been previously calculated, stored and held for delay that is within a range stipulated by the search range control value and the first adaptive codebook delay, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

(j) in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string;

(k) obtaining a second excitation signal from the selected adaptive codebook signal; and (l) storing and holding the second excitation signal.

The fortieth invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining a first excitation signal from the excitation signal information;

(d) driving a filter having the first linear prediction coefficient by means of the first excitation signal to generate a speech signal;

(e) obtaining a second linear prediction coefficient from the first linear prediction coefficient;

(f) for each of subframes, which are divisions of frames that are the time units for converting code strings, successively storing a first adaptive codebook delay that is contained in the excitation signal information, and holding the first adaptive codebook delay for a predetermined number of subframes;

(g) for each of the subframes, successively storing a second adaptive codebook delay that corresponds to code of an adaptive codebook delay in the second code string and holding the second adaptive codebook delay of a predetermined number of subframes;

(h) calculating the difference between the first adaptive codebook delay of consecutive subframes for a first adaptive codebook delay that has been stored and held and the first adaptive codebook delay of the current subframe, calculating the absolute value of the difference, and taking as the search range control value a value that is obtained by adding, for the number of subframes, values obtained by multiplying the absolute values by a weighting coefficient;

(i) in at least one subframe in the frame, successively generating an adaptive codebook signal from a second excitation signal that has been previously calculated, stored and held for delay that is within a range stipulated by the search range control value and the second adaptive codebook delay that has been previously found, stored, and held, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

(j) in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string;

(k) obtaining a second excitation signal from the selected adaptive codebook signal; and (l) storing and holding the second excitation signal.

The forty-first invention of the present application provides a program for causing a computer, which constitutes a code conversion device for converting a first code string to a second code string, to execute processes of:

(a) obtaining a first linear prediction coefficient from the first code string;

(b) obtaining excitation signal information from the first code string;

(c) obtaining a first excitation signal from the excitation signal information;

(d) driving a filter having the first linear prediction coefficient by means of the first excitation signal to generate a speech signal;

(e) obtaining a second linear prediction coefficient from the first linear prediction coefficient;

(f) for each of subframes, which are divisions of frames that are the time units for converting code strings, successively storing a first adaptive codebook delay that is contained in the excitation signal information and holding the first adaptive codebook delay for a predetermined number of subframes;

(g) for each of the subframes, successively storing a second adaptive codebook delay that corresponds to code of an adaptive codebook delay in the second code string and holding the second adaptive codebook delay of a predetermined number of subframes;

(h) in at least one subframe in the frame, calculating the absolute value of the difference between the first adaptive codebook delay that has been stored and held and the second adaptive codebook delay that has been stored and held that correspond to the same subframe for all of the first adaptive codebook delays and second adaptive codebook delays that have been held, and taking as a search range control value a value that is obtained by adding, for the number of subframes, values obtained by multiplying the absolute values by a weighting coefficient; and in other subframes, calculating the difference between the first adaptive codebook delay of consecutive subframes for the first adaptive codebook delay that has been stored and held and the first adaptive codebook delay of the current subframe, calculating the absolute value of the difference, and taking as a search range control value a value obtained by adding, for the number of subframes, values obtained by multiplying the absolute values by a weighting coefficient;

(i) in at least one subframe in the frame, successively generating an adaptive codebook signal from a second excitation signal that has been previously calculated, stored and held for delay that is within a range stipulated by the search range control value and the first adaptive codebook delay, using the speech signal and a first reconstructed speech signal that is successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string; and in other subframes, successively generating an adaptive codebook signal from a second excitation signal that has been previously calculated, stored, and held for delay that is within a range stipulated by the search range control value and the second adaptive codebook delay that has been previously found, stored and held, and using the speech signal and a first reconstructed speech signal. that has been successively generated by driving a compound filter having the second linear prediction coefficient by means of the adaptive codebook signal to select an adaptive codebook signal and a second adaptive codebook delay, and supplying code that corresponds to the second adaptive codebook delay as code of an adaptive codebook delay in the second code string;

(j) obtaining a second excitation signal from the selected adaptive codebook signal; and (k) storing and holding the second excitation signal.

The forty-second invention of the present application provides a program according to the thirty-seventh to forty-first inventions for causing the computer to execute a process of:

(i) for delays that are within the range, selecting the adaptive codebook signals and delays such that the squared error between the first reconstructed speech signals and the speech signals is a minimum, and taking the selected delays as the second adaptive codebook delays.

The forty-third invention of the present application provides a recording medium in which the programs according to the twenty-ninth to forty-second inventions have been recorded.

The above and other objects, features, and advantages of the present invention will become apparent from the following description with reference to the accompanying drawings, which illustrate examples of the present invention.

BEST MODE FOR CARRYING OUT THE INVENTION

Figure 1:
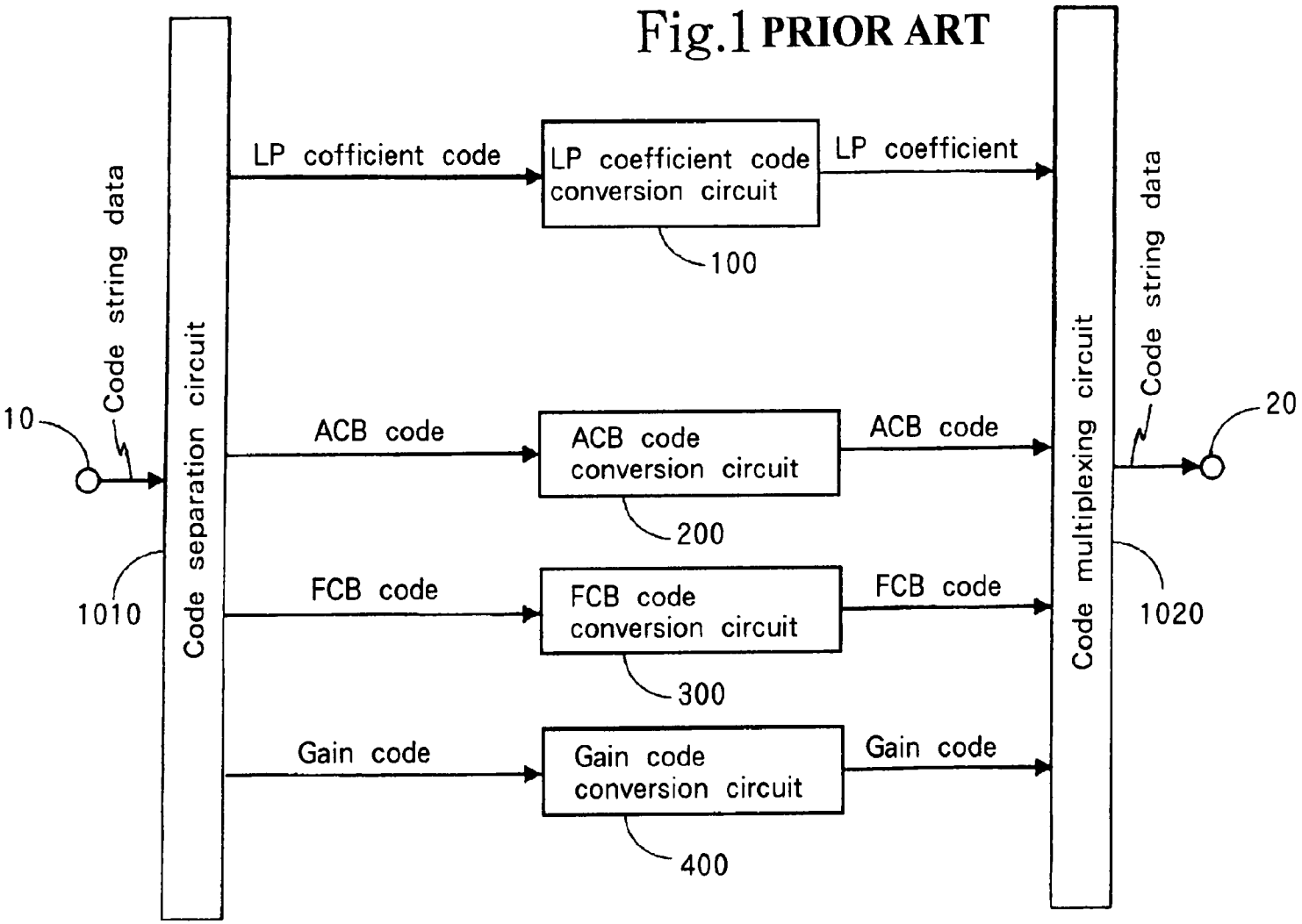
Fig.1 PRIOR ART
FIG. 1 is a view showing the configuration of a code conversion device of the prior art.

An embodiment of the present invention is next explained with reference to FIGS. 4 to 7.

The present embodiment is an example in which the present invention is applied to a code conversion device for supplying code string data output. The code conversion device subjects a speech signal to spectral analysis, resolves the speech signal into a spectral envelope component and a residual component, and uses spectrum parameters to represent the spectral envelope components. Regarding the residual component, the speech signal is encoded by a first system (A) that conforms to an encoding method in which code that corresponds to the signal component that is the closest to the residual waveform of the speech signal that is to be encoded is selected from a codebook having signal components that represent residual components. Based on code that has been separated by a code separation circuit, this code is converted to code that conforms to a second system (B) that is different from the first system; the converted code is supplied to a code multiplexing circuit; and code string data that are realized by multiplexing the converted code are then supplied as output.

In the above-described first system, a speech signal is quantized by finding the coefficient (linear prediction coefficient) of a linear prediction compound filter through linear predictive analysis in frame units; and synthesized speech is obtained by driving a linear prediction compound filter by means of an excitation signal that is represented by the sum of an adaptive codebook (ACB) that represents the pitch cycle of input speech and the drive pattern of a fixed codebook (FCB) that is composed of random numbers or pulses. Further, of patterns that are prepared as a gain codebook for each of drive sound source components that are obtained from an adaptive codebook and a fixed codebook, a pattern is selected to minimize the divergence in waveform between synthesized speech and input speech.

The code conversion device of the present embodiment is provided with: a circuit (1110 in FIG. 4) for generating at least a linear prediction coefficient (referred to as the "first LP coefficient") that is realized by decoding by means of a first system based on a linear prediction coefficient code that has been separated by a code separation circuit (1010 in FIG. 4); a speech decoding circuit (1500 in FIG. 4) for decoding excitation signal information (ACB (Adaptive Codebook) code, CB (Fixed Codebook) code, and gain code of ACB and FCB), which are separated by a code separation circuit, calculating an excitation signal from the decoded excitation signal information, and generating a speech signal s(n) by driving a compound filter (linear predictive compound filter) having the first LP coefficient by means of the excitation signal; and an ACB code generation circuit (1200/4200 in FIG. 4) for using the speech signal s(n) and the first ACB delay $T^{(A)}$lag that is contained in the excitation signal information to select a second ACB delay and supplying code (ACB code) that corresponds to the second ACB delay as code of an ACB delay in the second code string.

In the ACB code generation circuit, adaptive codebook (ACB) delay search range control circuit (1250 in FIG. 7) calculates a search range control value based on the first ACB delay that is stored and held in ACB delay storage circuit (1230 in FIG. 7) and the second ACB delay that is stored and held in second ACB delay storage circuit (1240 in FIG. 7); calculates, for example, the autocorrelation from the speech signal s(n) for delay that is within a range that is stipulated by the search range control value and a first ACB delay that is contained in the excitation signal information; selects the delay for which this autocorrelation is a maximum; takes the selected delay as the second ACB delay; and supplies code that corresponds to the second ACB delay as code that corresponds to the ACB delay of the second code string.

Another embodiment of the present invention is provided with: an adaptive codebook code conversion circuit (200 in FIG. 8) for: receiving adaptive codebook delay code that has been separated and supplied as output by a code separation circuit (1010 in FIG. 8), converting adaptive codebook delay code to code that can be decoded by the second encoding system, and supplying the converted adaptive codebook delay code as second adaptive codebook delay code to a code multiplexing circuit; and a switch (62 in FIG. 8) for receiving the output of adaptive codebook code conversion circuit (200 in FIG. 8) and the output of adaptive codebook code generation circuit (1200 in FIG. 8), selecting one of these outputs, and supplying the selected output to the code multiplexing circuit.

According to the present invention, ACB delay is found by using decoded speech that is generated from information that contains gain and an LP coefficient that corresponds to code after code conversion, i.e., gain and an LP coefficient in System B, and the code that corresponds to the ACB delay is taken as the ACB code of System B.

This approach can therefore circumvent the mismatching between the ACB delay and LP coefficient and gain in System B that occurs when ACB delay that is found by System A is used directly as the ACB delay of System B. Thus, when converting ACB code that corresponds to the ACB delay of System A to ACB code that corresponds to the ACB delay of System B, the occurrence of allophones can be avoided in decoded speech of System B that is generated using ACB delay that is obtained from ACB code after code conversion.

To explain the above-described embodiment of the present invention in greater detail and with greater specificity, working examples of the present invention are next described with reference to the accompanying drawings.

FIRST WORKING EXAMPLE

Figure 4:
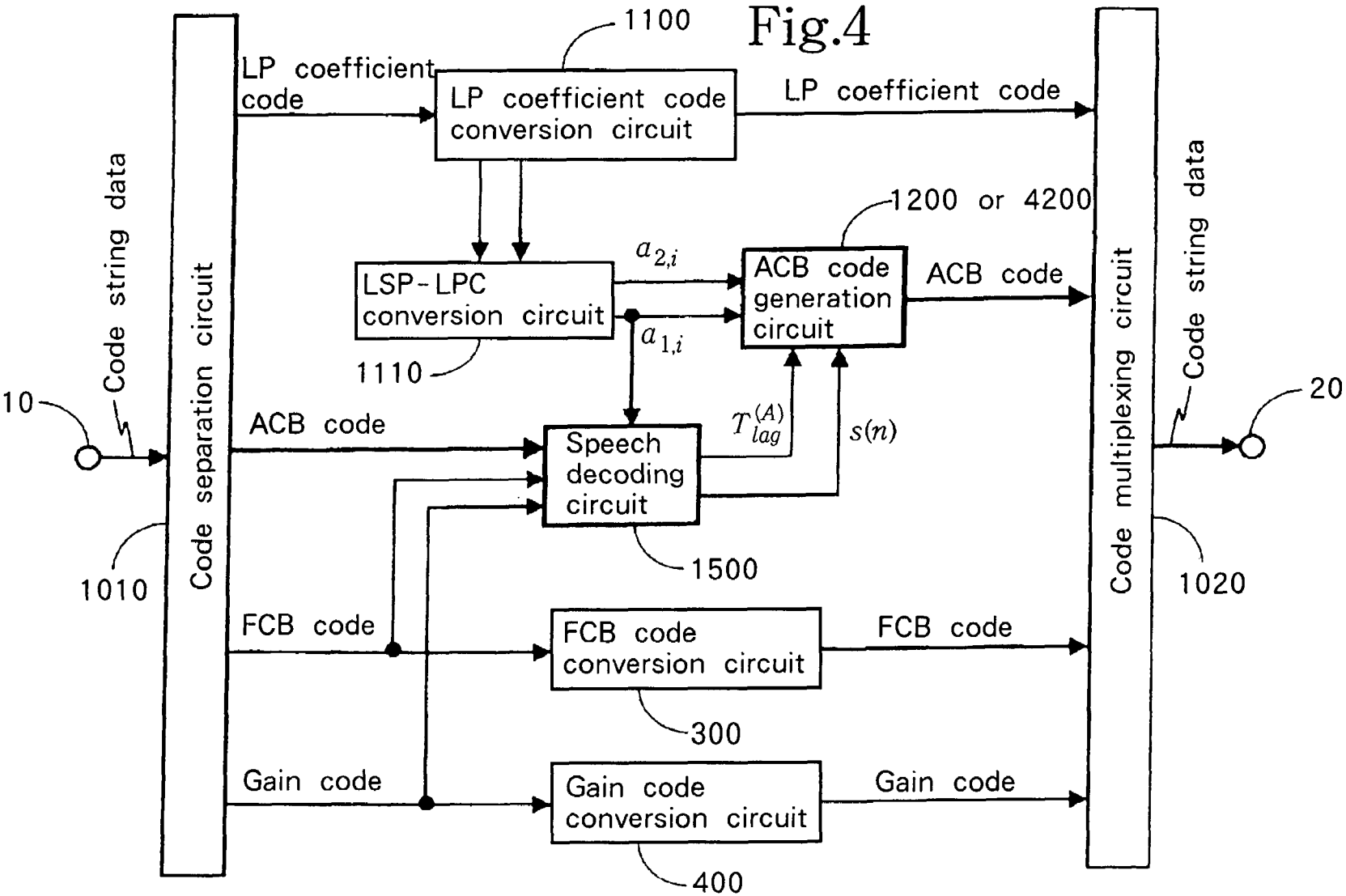
FIG. 4 is a view of the configuration of the first working example and the fourth working example of a code conversion device according to the present invention.

FIG. 4 is a view showing the configuration of the first working example of the code conversion device according to the present invention. In FIG. 4, components that are identical or equivalent to components in FIG. 1 are identified by the same reference numerals. Referring to FIG. 4, the code conversion device of the first working example is provided with input terminal 10, code separation circuit 1010, LP coefficient code conversion circuit 1100, LSP-LPC conversion circuit 1110, ACB code generation circuit 1200, speech decoding circuit 1500, FCB code conversion circuit 300, gain code conversion circuit 400, code multiplexing circuit 1020, and output terminal 20.

With the exception of branching in a portion of the connections, terminal 10, output terminal 20, code separation circuit 1010, code multiplexing circuit 1020, FCB code conversion circuit 300, and gain code conversion circuit 400 of the first working example of the present invention shown in FIG. 4 are made up by the configurations that are fundamentally identical to the corresponding components of the code conversion circuit of the prior art that is shown in FIG. 1. In addition, as in the case shown in FIG. 1, ACB gain and FCB gain are encoded and decoded as a group, this ACB gain and FCB gain are referred to as "gain," and the code of the ACB gain and FCB gain is referred to as "gain code."

The points of difference between the configurations of the device according to the first working example of the present invention and the device that is shown in FIG. 1 are the replacement of LP coefficient code conversion circuit 100 of FIG. 1 by LP coefficient code conversion circuit 1100 and the new addition of LSP-LPC conversion circuit 1110, ACB code generation circuit 1200, and speech decoding circuit 1500. In the following explanation, redundant explanation of components that are identical or equivalent is omitted, and explanation of the first working example of the present invention will principally concern the points of difference with respect to the configuration shown in FIG. 1.

In addition, ACB code generation circuit 1200 is replaced by ACB code generation circuit 4200 in the fourth working example that will be later described. This replacement is a point of difference between the two working examples, and the reference numeral 4200 is therefore shown together with reference numeral 1200 in FIG. 4, and the first working example and fourth working example are both described with reference to FIG. 4.

Still further, as with the above-described configuration of the prior art, encoding of the LP coefficient in System A is carried out for each $T^{(A)}$fr msec cycle (frame), and the encoding of the constituent elements of the excitation signal such as ACB, FCB, and gain is carried out for each $T^{(A)}$sfr= $T^{(A)}$fr/$N^{(A)}$sfr msec cycle (subframe).

On the other hand, encoding of the LP coefficient in System B is carried out for each $T^{(A)}$fr msec cycle (frame), and the encoding of the constituent elements of the excitation signal is carried out for each $T^{(B)}$sfr=$T^{(B)}$fr/$N^{(B)}$sfr msec cycle (subframe).

Figure 5:
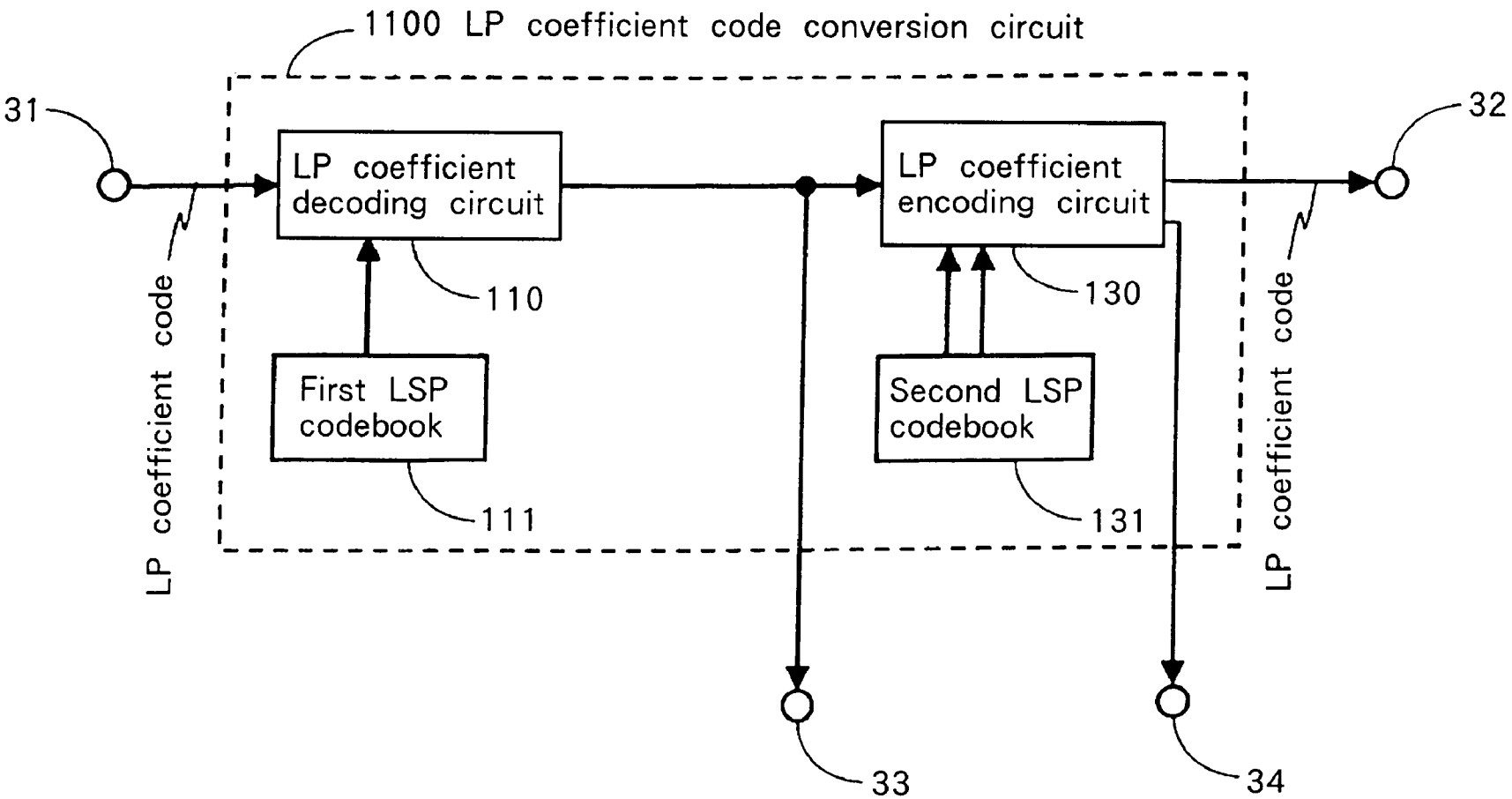
FIG. 5 is a view of the configuration of the LP coefficient code conversion circuit in the code conversion device according to the present invention.

FIG. 5 shows the configuration of LP coefficient code conversion circuit 1100. Referring to FIG. 5, LP coefficient code conversion circuit 1100 is provided with LP coefficient decoding circuit 110, first LSP codebook 111, LP coefficient encoding circuit 130, second LSP codebook 131, input terminal 31, and output terminals 32, 33, and 34.

Figure 3:
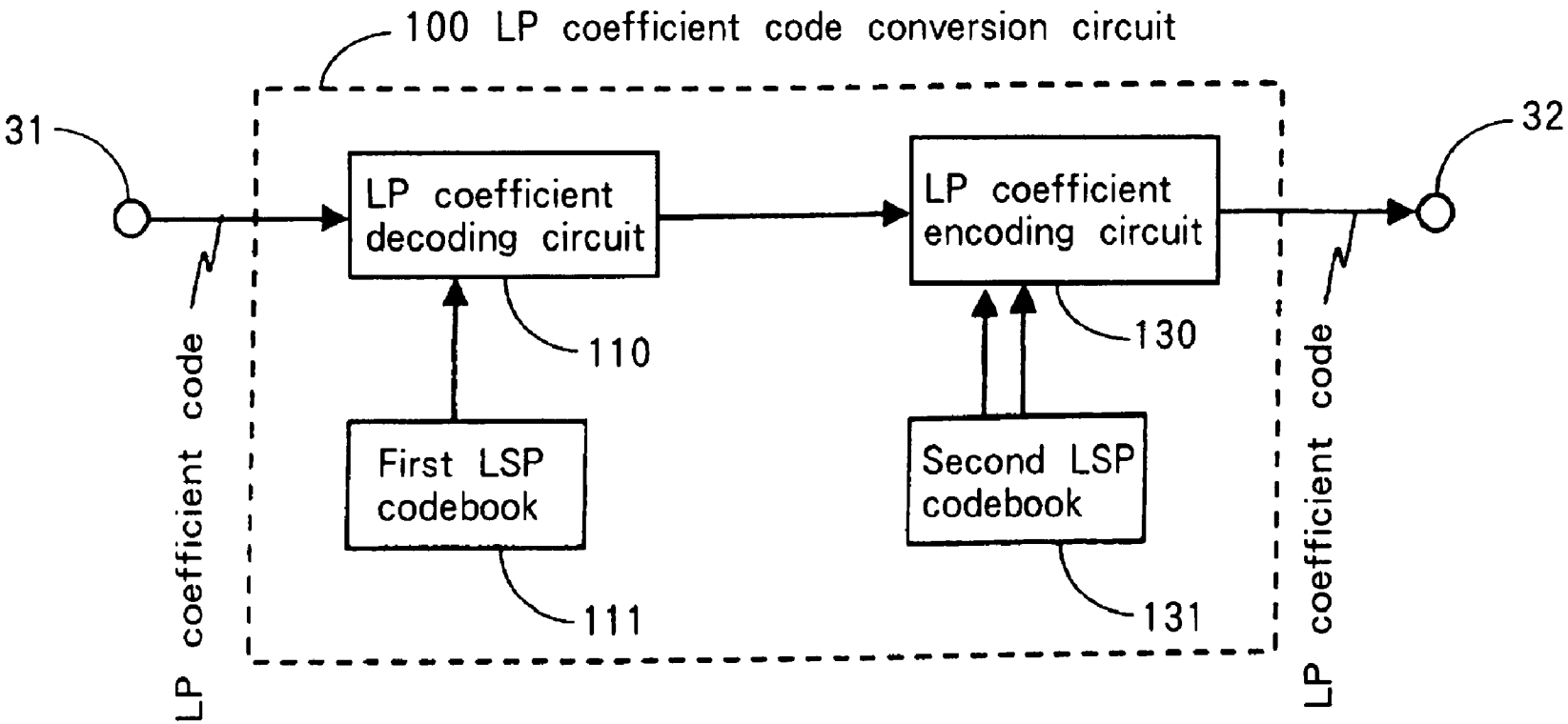
Fig.3 PRIOR ART
FIG. 3 is a view of the configuration of the LP coefficient code conversion circuit in a code conversion device of the prior art.

The points of difference between the configuration of LP coefficient code conversion circuit 1100 of the present working example and the configuration of LP coefficient code conversion circuit 100 of the prior art that is shown in FIG. 3 is the addition of the output line and output terminal 34 from LP coefficient encoding circuit 130, and the addition of output terminal 33. The constituent elements are otherwise equivalent to those of LP coefficient code conversion circuit 100 of the prior art, and the following explanation concerns the points of difference.

LP coefficient encoding circuit 130 supplies second LSP, which corresponds to the second LP coefficient code that is supplied as output by way of output terminal 32, by way of output terminal 34. The first LSP from LP coefficient decoding circuit 110 is supplied as output from output terminal 33. This completes the explanation of the LP coefficient code conversion circuit 1100.

Referring again to FIG. 4, LSP-LPC conversion circuit 1110 receives as input first LSP and second LSP that are supplied from LP coefficient code conversion circuit 1100, converts the first LSP to a first LP coefficient and converts the second LSP to a second LP coefficient, supplies first LP coefficient $a_{1,i}$ to ACB code generation circuit 1200 and speech decoding circuit 1500, and supplies second LP coefficient $a_{2,i}$ to ACB code generation circuit 1200. Regarding the conversion from the LSP to the LP coefficient, reference may be made to the description in Section 3.2.6 of Reference 3 as with the previously described prior art.

Speech decoding circuit 1500 receives first ACB code, first FCB code, and first gain code that are supplied from code separation circuit 1010, and receives first LP coefficient $a_{1,i}$ from LSP-LPC conversion circuit 1110.

Using each of the ACB signal decoding method, the FCB signal decoding method, and the gain decoding method in System A, the ACB delay, FCB signal and gain are each decoded from the first ACB code, the first FCB code, and the first gain code, respectively, and then taken as the first ACB delay, the first FCB signal, and the first gain, respectively.

Speech decoding circuit 1500 then uses the first ACB delay to generate an ACB signal and takes this signal as the first ACB signal. Speech is then generated from the first ACB signal, the first FCB signal, the first gain, and the first LP coefficient, and speech signal s(n) is supplied as output to ACB code generation circuit 1200. In addition, first ACB delay $T^{(A)}$lag is supplied as output to ACB code generation circuit 1200. In this case, a second LP coefficient can be used in place of the first LP coefficient.

ACB code generation circuit 1200 receives the first LP coefficient and the second LP coefficient from LSP-LPC conversion circuit 1110, receives decoded speech s(n) and first ACB delay $T^{(A)}$lag that corresponds to the first ACB code from speech decoding circuit 1500, and from these finds second a ACB delay, and supplies code that corresponds to the second ACB delay and that can be decoded by System B to code multiplexing circuit 1020 as second ACB code.

The explanation next regards the details of the configuration of speech decoding circuit 1500 and ACB code generation circuit 1200.

Figure 6:
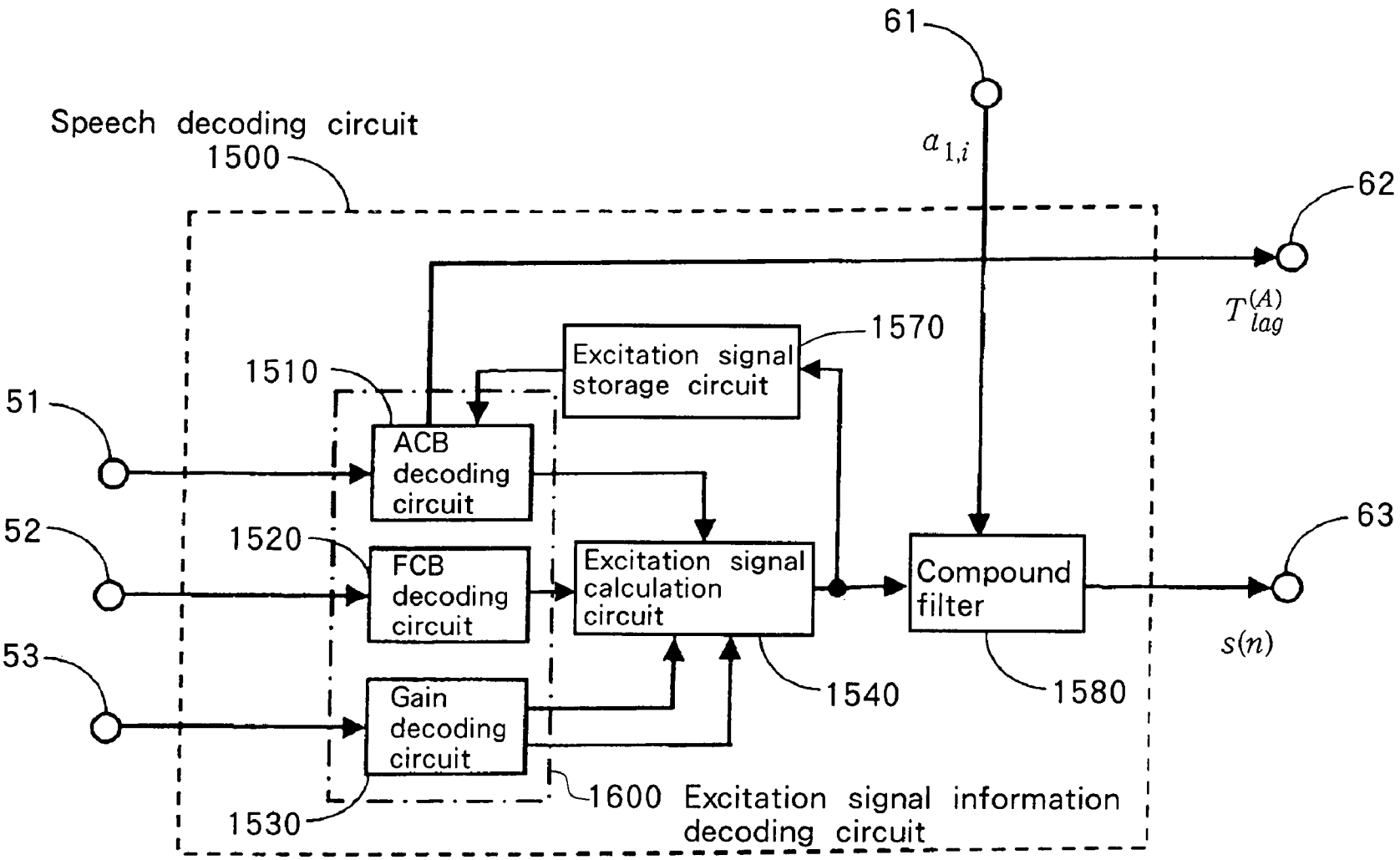
FIG. 6 is a view of the configuration of the speech decoding circuit of the code conversion device according to the present invention.

FIG. 6 shows the configuration of speech decoding circuit 1500. Referring to FIG. 6, speech decoding circuit 1500 is provided with: excitation signal information decoding circuit 1600 that is made up by ACB decoding circuit 1510, FCB decoding circuit 1520, and gain decoding circuit 1530; excitation signal calculation circuit 1540; excitation signal storage circuit 1570; and compound filter 1580.

Excitation signal information decoding circuit 1600 is a device for decoding excitation signal information from code that corresponds to the excitation signal information. Excitation signal information decoding circuit 1600 receives each of first ACB code, first FCB code, and first gain code from code separation circuit 1010 by way of input terminals 51, 52, and 53, respectively; and applies each of first ACB code, first FCB code, and first gain code as input to ACB decoding circuit 1510, FCB decoding circuit 1520, and gain decoding circuit 1530, respectively. An ACB delay, an FCB signal, and gain are each decoded in ACB decoding circuit 1510, FCB decoding circuit 1520, and gain decoding circuit 1530, respectively, and each taken as the first ACB delay, first FCB signal, and first gain, respectively. ACB gain and FCB gain are contained in the first gain, and are taken as first ACB gain and first FCB gain, respectively.

In addition, ACB decoding circuit 1510 of excitation signal information decoding circuit 1600 also receives as input past excitation signals that are supplied from excitation signal storage circuit 1570.

ACB decoding circuit 1510 uses past excitation signals and first ACB delay to generate an ACB signal, and takes this signal as the first ACB signal.

Excitation signal information decoding circuit 1600 supplies the first ACB signal, first FCB signal, first ACB gain, and first FCB gain to excitation signal calculation circuit 1540. ACB decoding circuit 1510 of excitation signal information decoding circuit 1600 further supplies the first ACB delay to ACB delay storage circuit 1230 and ACB encoding circuit 1220 of ACB code generation circuit 1200. ACB delay storage circuit 1230 and ACB encoding circuit 1220 will be explained hereinbelow.

The following explanation regards the details of ACB decoding circuit 1510, FCB decoding circuit 1520, and gain decoding circuit 1530, which are each components of excitation signal information decoding circuit 1600.

ACB decoding circuit 1510 receives the first ACB code that is supplied as output from code separation circuit 1010 by way of input terminal 51, and further, receives a past excitation signal that is supplied from excitation signal storage circuit 1570.

Figure 2:
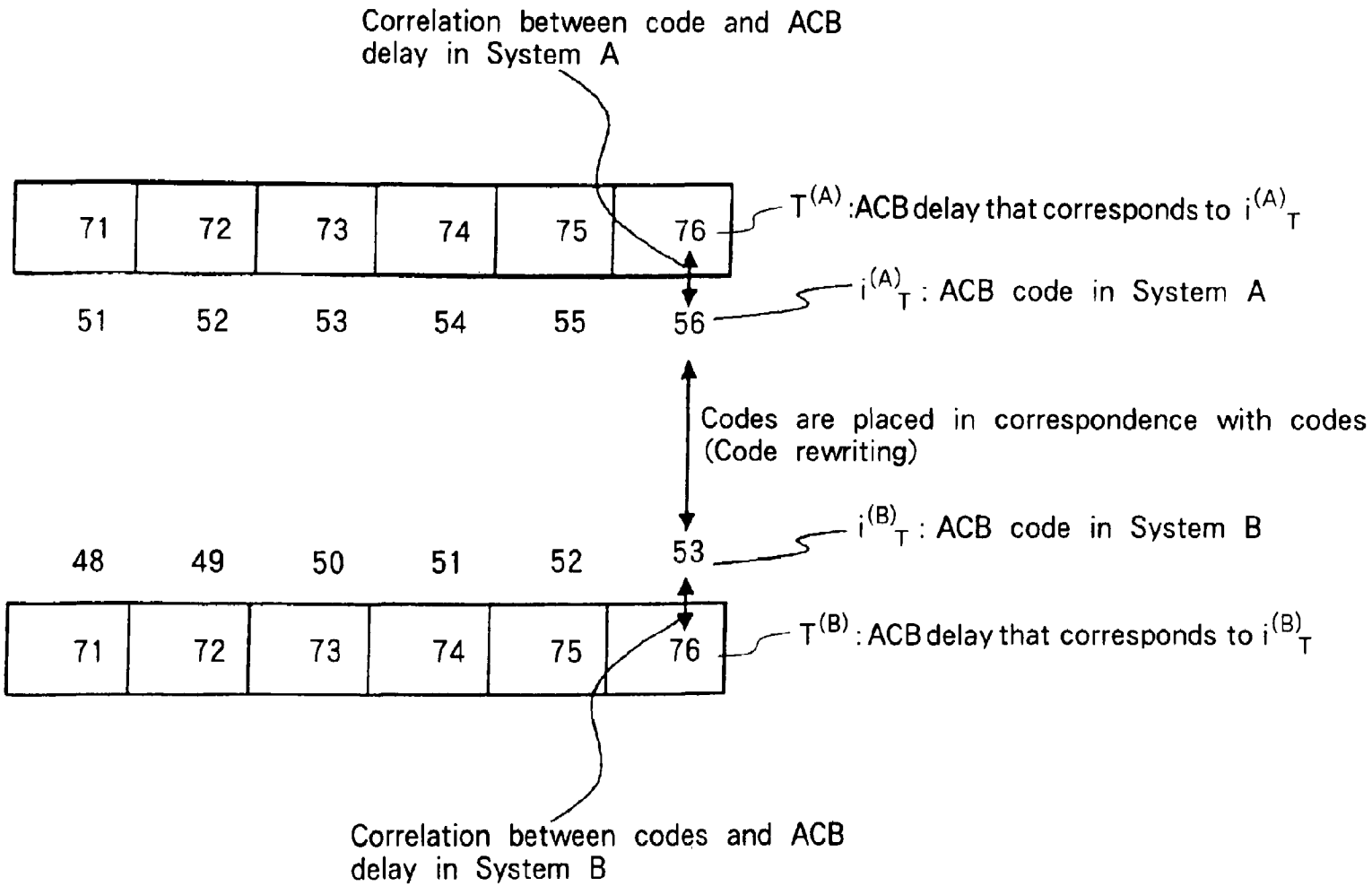
Fig.2 PRIOR ART
FIG. 2 is an explanatory view of the correlation between an ACB code and an ACB delay and the method of rewriting the ACB code.

Next, as in the above-described prior art, ACB decoding circuit 1510 uses the correlation between the ACB code and ACB delay in System A that is shown in FIG. 2 to obtain the first ACB delay $T^{(A)}$fr that corresponds to the first ACB code. ACB decoding circuit 1510 generates a first ACB signal by cutting out the signal of an $L^{(A)}$sfr sample that corresponds to the subframe length from a point that is a $T^{(A)}$ sample in the past from the starting point that is the current subframe in the excitation signal. When $T^{(A)}$ is smaller than $L^{(A)}$sfr, the vector of a $T^{(A)}$ sample portion is cut out and this vector is repeatedly connected to produce a signal having the length the $L^{(A)}$sfr sample.

ACB decoding circuit 1510 then supplies the first ACB signal to excitation signal calculation circuit 1540, and supplies the first ACB delay by way of output terminal 62 to ACB delay storage circuit 1230 and ACB encoding circuit 1220.

For details regarding the method of generating the first ACB signal, reference may be made to Section 4.1.3 of Reference 3.

FCB decoding circuit 1520 receives the first FCB code that is supplied from code separation circuit 1010 by way of input terminal 52. FCB decoding circuit 1520 incorporates a table (not shown in the figure) that stores a plurality of FCB signals, reads the first FCB signal that corresponds to the first FCB code from the table, and supplies the first FCB signal to excitation signal calculation circuit 1540.

Regarding the method of representing the FCB signal, a method can also be used in which an FCB signal is effectively represented by a multi-pulse signal that is composed of a plurality of pulses and prescribed by the positions (pulse position) and polarity (pulse polarity) of the pulses. In this case, the first FCB codes correspond to the pulse positions and pulse polarities. For details regarding the method of using multi-pulses to generate FCB signals, reference may be made to Section 4.1.4 of Reference 3.

Gain decoding circuit 1530 receives the first gain code that is supplied from code separation circuit 1010 by way of input terminal 53. Gain decoding circuit 1530 incorporates a table (not shown in the figure) that stores a plurality of gain, and reads gain that corresponds to the first gain code from the table.

Of the gain that is read, gain decoding circuit 1530 supplies first ACB gain that corresponds to the ACB gain and first FCB gain that corresponds to the FCB gain to excitation signal calculation circuit 1540.

In this case, when the first ACB gain and first FCB gain are encoded together, a plurality of two-dimensional vectors that are composed of first ACB gain and first FCB gain are stored in the table.

When the first ACB gain and the first FCB gain are encoded separately, two tables (not shown in the figure) are incorporated, a plurality of first ACB gain being stored in one table and a plurality of first FCB gain being stored in the other table.

Excitation signal calculation circuit 1540 receives as input the first ACB signal that is supplied from ACB decoding circuit 1510, the first FCB signal that is supplied from FCB decoding circuit 1520, and the first ACB gain and first FCB gain that are supplied from gain decoding circuit 1530. Excitation signal calculation circuit 1540 adds a signal that is obtained by multiplying the first ACB signal by the first ACB gain to a signal that is obtained by multiplying the first FCB signal by the first FCB gain to obtain the first excitation signal. Excitation signal calculation circuit 1540 then supplies the first excitation signal to compound filter 1580 and excitation signal storage circuit 1570.

Excitation signal storage circuit 1570 receives the first excitation signal that is supplied from excitation signal calculation circuit 1540 and stores and holds this signal. Excitation signal storage circuit 1570 then supplies a past first excitation signal that was previously received, stored, and held to ACB decoding circuit 1510.

Compound filter 1580 receives the first excitation signal that is supplied from excitation signal calculation circuit 1540, and receives a first LP coefficient that is supplied from LSP-LPC conversion circuit 1110 by way of input terminal 61. Compound filter 1580 constitutes a linear prediction filter having the first LP coefficient, and generates a speech signal by driving the linear prediction filter by means of the first excitation signal.

Compound filter 1580 supplies the speech signal to weighting signal calculation circuit 1210 of ACB code generation circuit 1200 by way of output terminal 63. In this case, a second LP coefficient can be used in place of the first LP coefficient.

Figure 7:
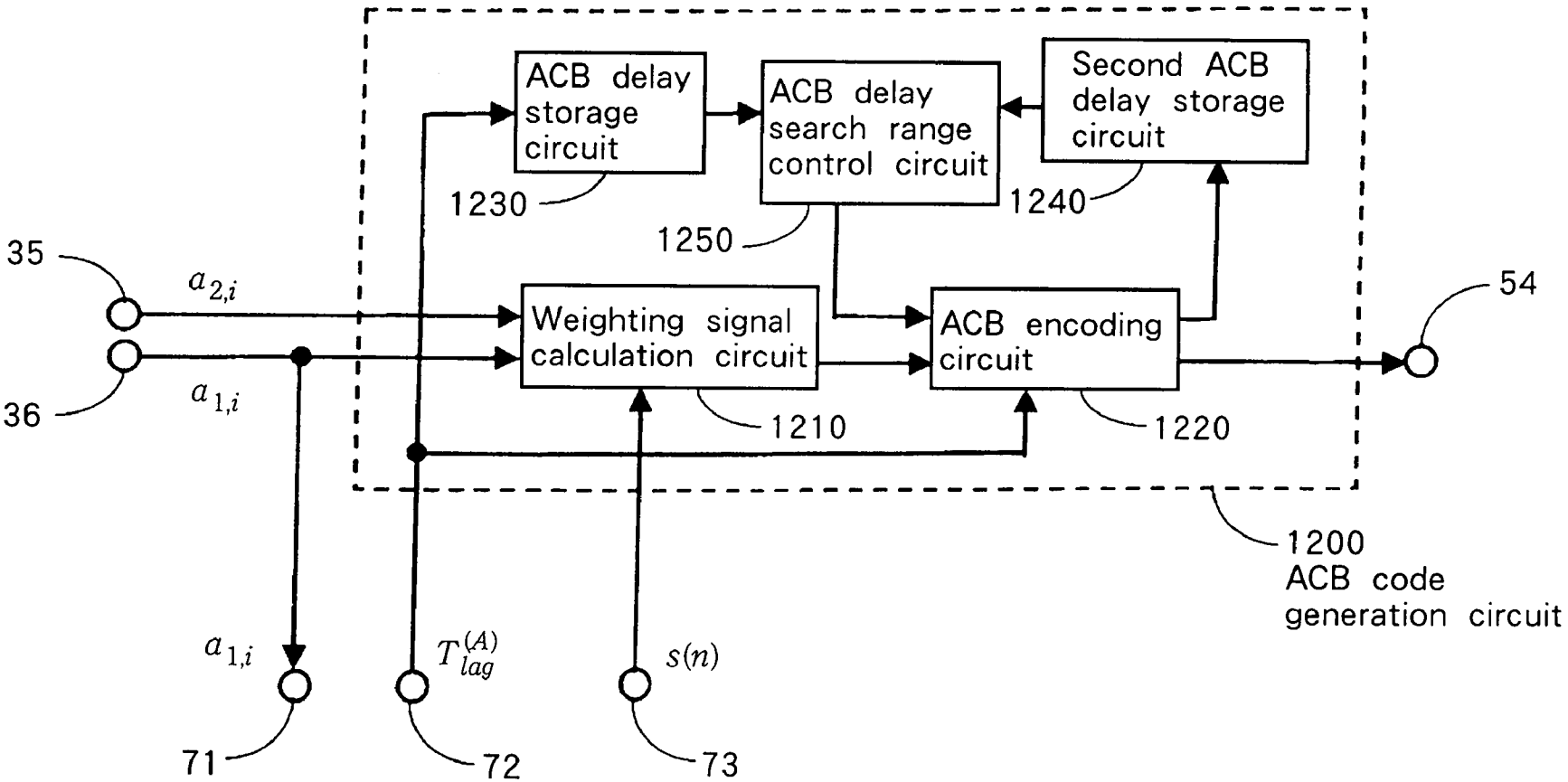
FIG. 7 is a view of the configuration of the ACB code generation circuit in the first working example and the second working example of the code conversion device according to the present invention.

FIG. 7 is a view showing the configuration of ACB code generation circuit 1200. Referring to FIG. 7, ACB code generation circuit 1200 is provided with: weighting signal calculation circuit 1210, ACB encoding circuit 1220, ACB delay storage circuit 1230, second ACB delay storage circuit 1240, and ACB delay search range control circuit 1250. The following explanation regards each of these components.

ACB delay storage circuit 1230 receives the first ACB delay that is supplied from ACB decoding circuit 1510 (refer to FIG. 6) of speech decoding circuit 1500 by way of input terminal 72 and stores and holds this first ACB delay.

ACB delay storage circuit 1230 supplies a first ACB delay that has been previously received, stored and held to ACB delay search range control circuit 1250.

Weighting signal calculation circuit 1210 receives the speech signal s(n) that is supplied from compound filter 1580 by way of input terminal 73, and receives the first LP coefficient and second LP coefficient that are supplied from LSP-LPC conversion circuit 1110 by way of input terminals 36 and 35, respectively.

Weighting signal calculation circuit 1210 next uses the first LP coefficient to make up an auditory weighting filter. Weighting signal calculation circuit 1210 then supplies an auditory weighting speech signal that is obtained by driving the auditory weighting filter by means of the speech signal s(n) to ACB encoding circuit 1220. The transfer function w(z) of the auditory weighting filter in this case is represented by the following equation (1):

$$W(z) = \frac{A_1(z/\gamma_1)}{A_1(z/\gamma_2)} = \frac{1 + \sum_{i=1}^{P} \gamma_1^i a_{1,i} z^{-i}}{1 + \sum_{i=1}^{P} \gamma_2^i a_{1,i} z^{-i}} \tag{1}$$

where:

$$\frac{1}{A_1(z)} = \frac{1}{1 + \sum_{i=1}^{P} a_{1,i} z^{-i}} \tag{2}$$

$A_1(z)$ is the transfer function of a linear prediction filter having a first LP coefficient $a_{1,i}$ (i=1, . . . P), and P is a linear prediction degree for example, 10). γ1 and γ2 are coefficients for controlling the weighting (for example, 0.94 and 0.6). The auditory weighting speech signal $s_w(n)$ is found from the following equation (3):

$$s_w(n) = s(n) + \sum_{i=1}^{P} a_{1,i}\gamma_1^i s(n-i) - \sum_{i=1}^{P} a_{1,i}\gamma_2^i s_w(n-i), \quad n = 0, \ldots, L_{sfr}^{(A)} - 1 \tag{3}$$

Here, s(n) is the speech signal, and a second LP coefficient may be used in place of the first LP coefficient. In addition, to reduce the computation load, the calculation of the auditory weighting speech signal can be abbreviated and the speech signal used without alteration. Alternatively, the excitation signal (the input to compound filter 1580) that is supplied from excitation signal calculation circuit 1540 may be used in place of the speech signal.

ACB encoding circuit 1220 receives as input the auditory weighting speech signal that is supplied from weighting signal calculation circuit 1210, receives the first ACB delay that is supplied from ACB decoding circuit 1510 by way of input terminal 72, and receives the search range control value that is supplied from ACB delay search range control circuit 1250.

ACB encoding circuit 1220 calculates autocorrelation from the auditory weighting speech signal for delay that is within a range of values that is stipulated by the search range control value and that centers on the first ACB delay, selects the delay for which the autocorrelation is a maximum, and takes this selected delay as the second ACB delay. In this case, autocorrelation R(k) is represented by the following equation (4):

$$R(k) = \sum_{n=0}^{L_{sfr}^{(A)}-1} s_w(n)s_w(n-k), \quad T_{lag}^{(A)} - d_{range} \le k \le T_{lag}^{(A)} + d_{range} \tag{4}$$

where k represents delay, $d_{range}$ represents the search range control value, and $T^{(A)}$lag represents the first ACB delay. The normalized autocorrelation may be used in place of autocorrelation, this normalized autocorrelation R'(k) being represented by the following equation (5):

$$R(k) = \frac{R(k)}{\sqrt{\sum_{n=0}^{L_{sfr}^{(A)}-1} s_w^2(n-k)}} \tag{5}$$

In this case, in order to reduce the computation load, a preliminary selection may first be carried out using autocorrelation, and a final selection then performed using the normalized autocorrelation from the plurality of candidates that have been found in the preliminary selection.

As with the above-described prior art, ACB encoding circuit 1220 next obtains the second ACB code that corresponds to the second ACB delay using the correlation between ACB code and the ACB delay in System B that is shown in FIG. 2. ACB encoding circuit 1220 then supplies the second ACB code by way of output terminal 54 to code multiplexing circuit 1020, and further, supplies the second ACB delay to second ACB delay storage circuit 1240.

Second ACB delay storage circuit 1240 receives the second ACB delay that has been supplied from ACB encoding circuit 1220 and stores and holds second this ACB delay. Second ACB delay storage circuit 1240 then supplies second ACB delay that has been previously received, stored, and held to ACB delay search range control circuit 1250.

ACB delay search range control circuit 1250 receives the past first ACB delay that is supplied from ACB delay storage circuit 1230, and receives the past second ACB delay that is supplied from second ACB delay storage circuit 1240.

ACB delay search range control circuit 1250 then calculates a search range control value from the past first ACB delay and the past second ACB delay. If the $m^{th}$ subframe of the $n^{th}$ frame is simply represented by time t in this calculation, the search range control value $d_{range}$(t) at time t is calculated by the following equation (6):

$$d(t)=\alpha\cdot|T_{lag}^{(A)}(t-1)-T_{lag}^{(B)}(t-1)|\ d_{range}(t)=d(t),\ d(t)<C_{rangemax}\ d_{range}(t)=C_{rangemax},\ d(t)\geqq C_{rangemax} \tag{6}$$

where $T^{(A)}$lag(t) is the first ACB delay at time t, $T^{(B)}$lag(t) is the second ACB delay at time t, α is a coefficient (such as 2), and $C_{rangemax}$ is a constant (such as 4). These constants can be determined from the average values of a large number of d(t) that are obtained in advance.

Alternatively, d(t) can be represented by the following equation (7):

$$d(t) = \frac{a}{N_{range}} \cdot \sum_{k=1}^{N_{range}} w(k)\,|\,T_{lag}^{(A)}(t-k) - T_{lag}^{(B)}(t-k)\,| \tag{7}$$

where $N_{range}$ is a constant (such as 2), and w(k) is a weighting coefficient (for example, w(1)=1.0, w(2)=0.8). Finally, the search range control value that has been found by the above-described calculation is supplied to ACB encoding circuit 1220. This completes the explanation of ACB code generation circuit 1200.

Figure 21:
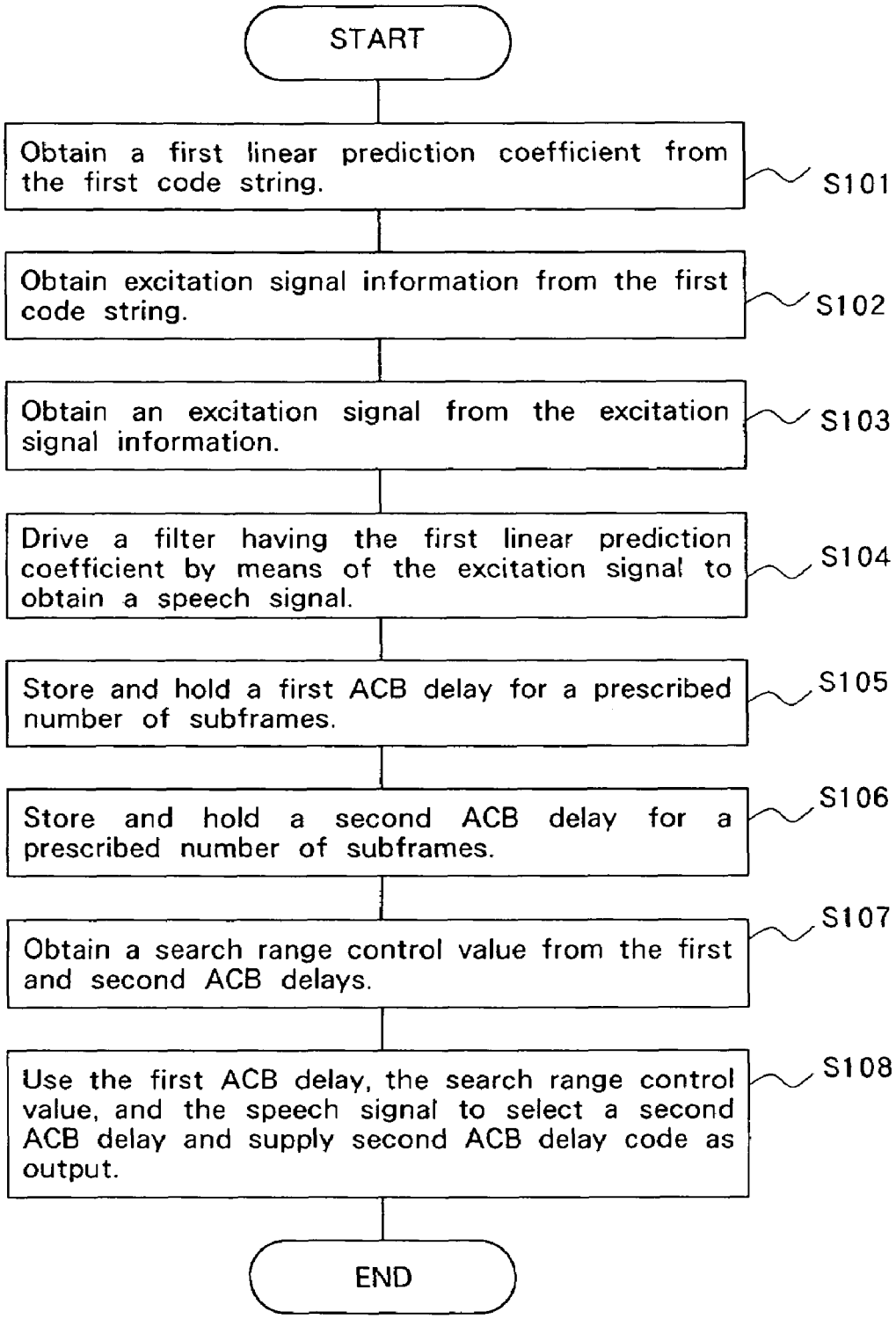
FIG. 21 is an explanatory view of the processes of the first working example of the method according to the present invention.

Explanation next regards the code conversion method for converting a first code string to a second code string in the above-described first working example with reference to FIGS. 4 to 7 and FIG. 21. FIG. 21 is a flow chart for explaining the operation of the first working example of the method according to the present invention.

The first LP coefficient is obtained from code (LP coefficient code) of the first code string that has been separated by code separation circuit 1010 (Step S101).

In speech decoding circuit 1500, excitation signal information is obtained from the first code string in excitation signal information decoding circuit 1600, and an excitation signal is obtained from the excitation signal information in excitation signal calculation circuit 1540 (Steps S102 and S103).

In speech decoding circuit 1500, the speech signal s(n) is generated by driving compound filter 1580 having the first LP coefficient by means of the obtained excitation signal (Step S104).

In ACB code generation circuit 1200, the first ACB delay $T^{(A)}$lag that is contained in the excitation signal information that was obtained in speech decoding circuit 1500 is received and stored and held in ACB delay storage circuit 1230 (Step S105).

Second ACB delay that corresponds to the ACB code in the second code string that was obtained in ACB encoding circuit 1220 is stored and held in second ACB delay storage circuit 1240 (Step S106).

In ACB code generation circuit 1200, ACB delay search range control circuit 1250 calculates a search range control value from first ACB delay that has been stored and held and second ACB delay that has been stored and held (Step S107).

ACB encoding circuit 1220 uses the speech signal s(n) to select a second ACB delay from delay that is within the range stipulated by the search range control value and the first ACB delay, and supplies code that corresponds to the second ACB delay to code multiplexing circuit 1020 as the code of the ACB delay in the second code string (Step S108).

In Step S105, the first ACB delay is successively stored for each subframe and the first ACB delay of a prescribed number of subframes is held; and in Step S106, second ACB delay is successively stored for each subframe and the second ACB delay of a prescribed number of subframes is held.

In Step S107, ACB encoding circuit 1220 calculates the absolute value of the difference between the first ACB delay and the second ACB delay that correspond to the same subframe for all of the first ACB delays and the second ACB delays that are held, and takes as the search range control value a value that is obtained by adding, for the number of subframes, values obtained by multiplying the absolute values by the weighting coefficient.

SECOND WORKING EXAMPLE

Figure 8:
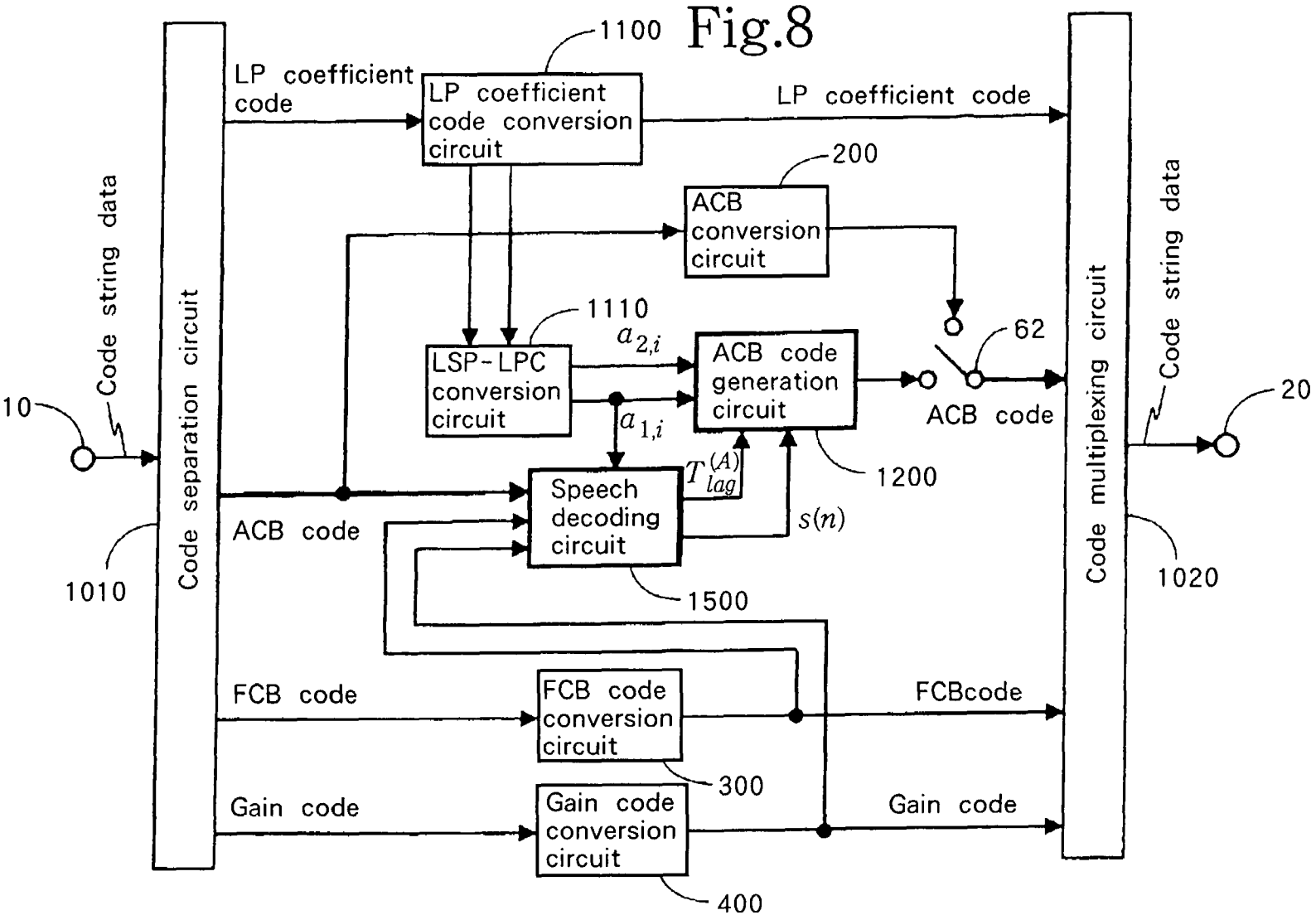
FIG. 8 is a view of the configuration of the second working example of the code conversion device according to the present invention.

FIG. 8 shows the configuration of the second working example of the code conversion device according to the present invention. Referring to FIG. 8, the second working example is a configuration for selecting second ACB code that is supplied from ACB code conversion circuit 200 and second ACB code that is supplied from ACB code generation circuit 1200.

The point of difference between the second working example and the first working example that is shown in FIG. 4 is the further provision of switch 62 and ACB code conversion circuit 200. The following explanation principally regards the points of difference, and explanation regarding the configuration of components that are identical or equivalent to components shown in FIG. 4 will be omitted.

ACB code conversion circuit 200 is composed of components that are equivalent to those of ACB code conversion circuit 200 of the prior art that was shown in FIG. 1. ACB code conversion circuit 200 finds second ACB code in, for example, a first subframe and supplies the second ACB code to switch 62.

ACB code generation circuit 1200 is equivalent to ACB code generation circuit 1200 in the first working example. ACB code generation circuit 1200 finds a second ACB delay in, for example, a second subframe, and supplies the second ACB code that corresponds to the second ACB delay to switch 62.

Switch 62 receives second ACB code that is supplied from ACB code conversion circuit 200 in the first subframe, receives second ACB code that is supplied from ACB code generation circuit 1200 in the second subframe, and supplies a second ACB code to code multiplexing circuit 1020.

Figure 22:
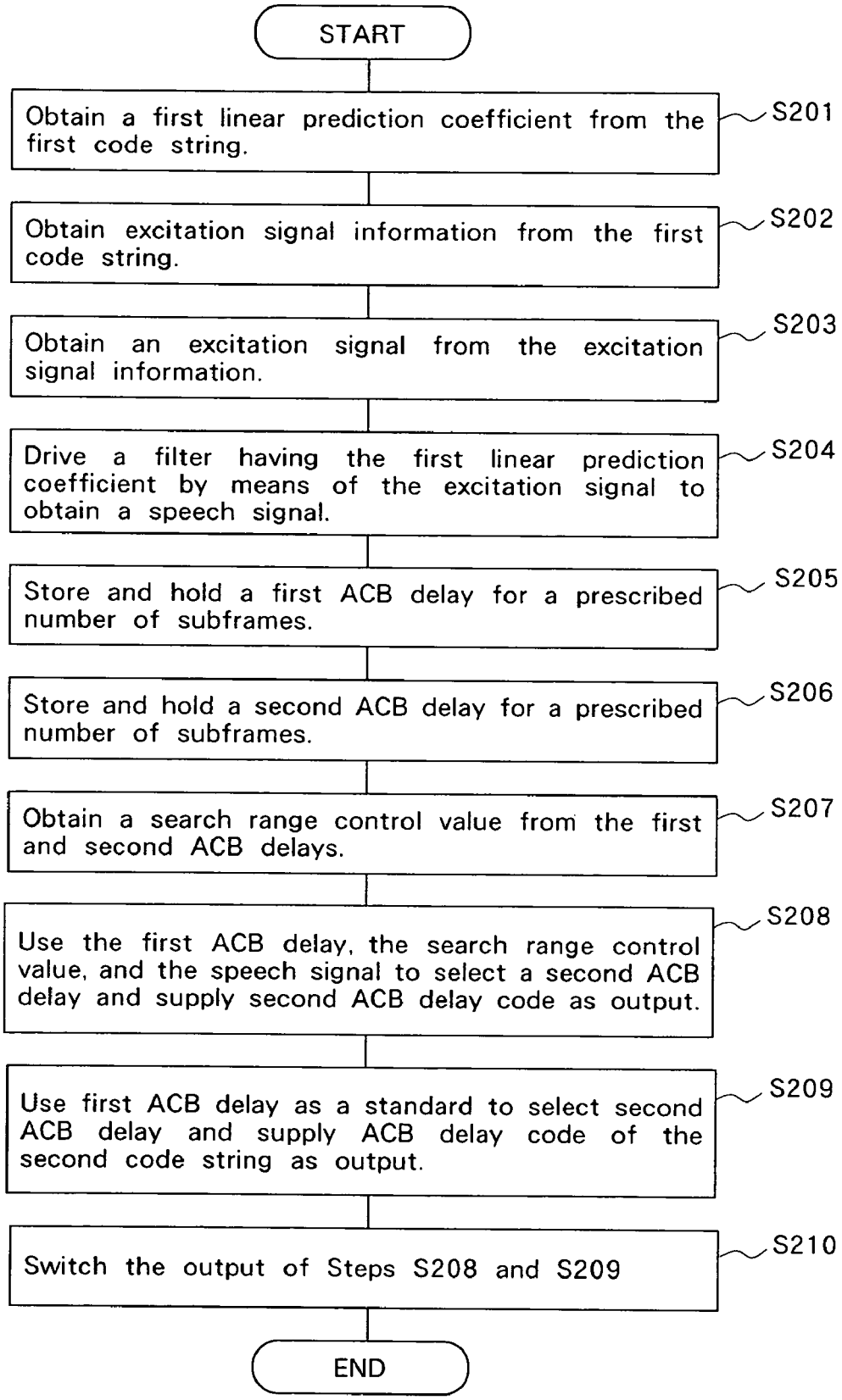
FIG. 22 is an explanatory view of the processes of the second working example of the method according to the present invention.

Referring now to FIG. 8 and FIG. 22, the following explanation regards the code conversion method for converting a first code string to a second code string in the above-described second working example. FIG. 22 is a flow chart for explaining the operations of the second working example of the method according to the present invention.

A first LP coefficient is obtained from the code (LP coefficient code) of a first code string that has been separated by code separation circuit 1010 (Step S201). As in the first working example, excitation signal information is obtained from the first code string and an excitation signal is obtained from the excitation signal information in speech decoding circuit 1500 (Steps S202 and S203).

In speech decoding circuit 1500, the obtained excitation signal is used to drive compound filter 1580 having the first LP coefficient to generate a speech signal s(n) (Step S204).

In ACB code generation circuit 1200, as in the first working example, the first ACB delay $T^{(A)}$lag that is contained in the excitation signal information that was obtained in speech decoding circuit 1500 is received and then stored and held (Step S205).

ACB code generation circuit 1200 stores and holds a second ACB delay that corresponds to the code of the ACB delay in the second code string (Step S206).

ACB code generation circuit 1200 calculates the absolute value of the difference between the first ACB delay that is stored and held and the second ACB delay that is stored and held that correspond to the same subframe for all first ACB delays and second ACB delays that are held, and takes as the search range control value a value that is obtained by adding, for each of the number of subframes, values that are obtained by multiplying the absolute values by the weighting coefficient (Step S207).

ACB code conversion circuit 1200 uses the speech signal s(n) to select a second ACB delay from delay that is within a range that is stipulated by the search range control value and the first ACB delay in at least one subframe, for example, the second subframe, in a frame, and supplies to switch 62 the code that corresponds to the second ACB delay as the code of an ACB delay in the second code string (Step S208).

ACB code generation circuit 200 receives the ACB code of the first code string, and in at least one subframe, for example, the first subframe, in a frame, uses the relation between first ACB delay and a first delay code that corresponds to this first ACB delay and the relation between the second ACB delay and a second delay code that corresponds to this second ACB delay to place the first ACB delay and the second ACB delay in correspondence and thus convert from the first delay code to the second delay code, and supplies the second delay code to switch 62 as code of the ACB delay in the second code string (Step S209).

Switch 62 switches the output from ACB code conversion circuit 200 in, for example, the first subframe to the output from ACB code generation circuit 1200 in, for example, the second subframe, and supplies this output to code multiplexing circuit 1020 (Step S209).

THIRD WORKING EXAMPLE

Figure 9:
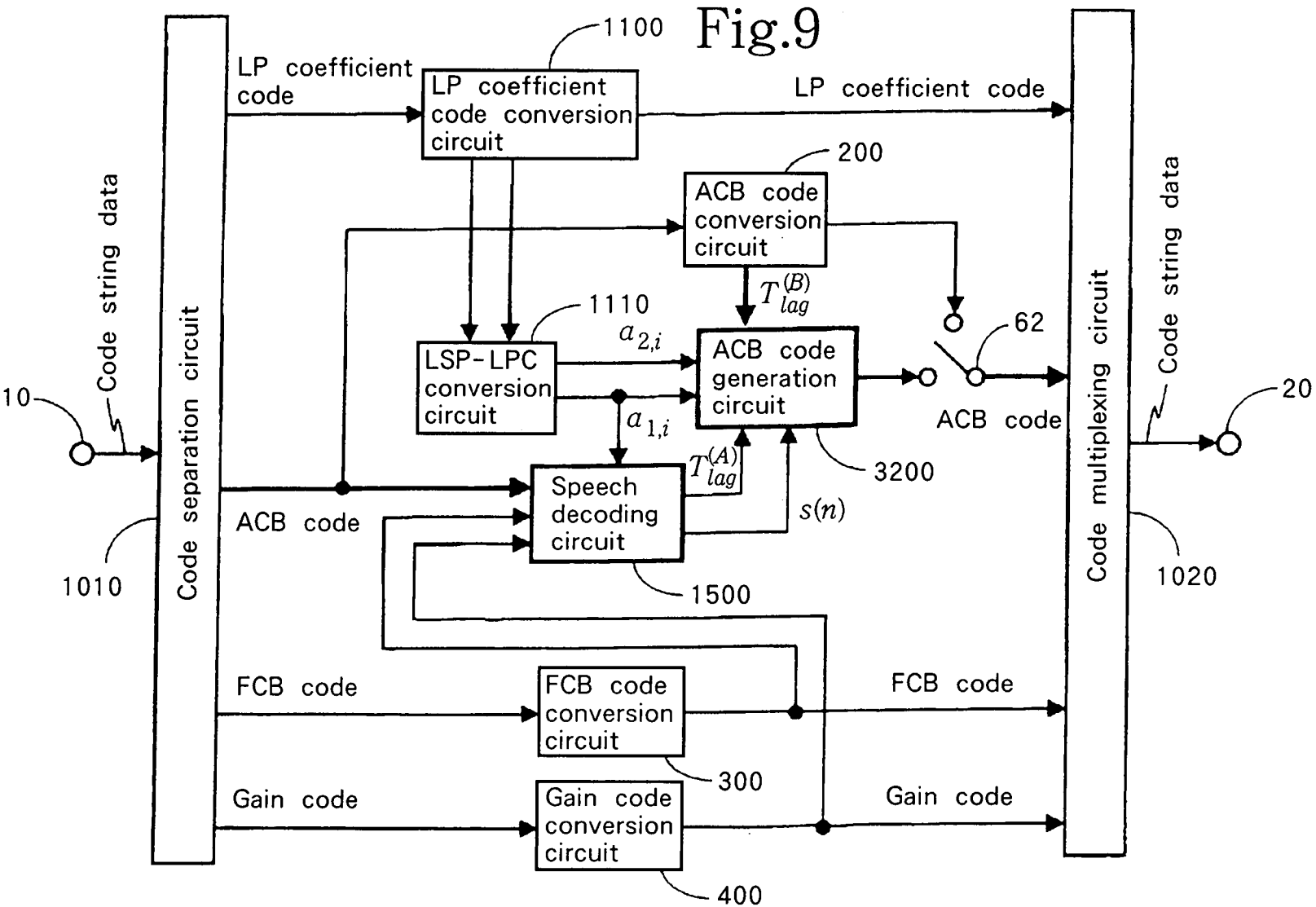
FIG. 9 is a view of the configuration of the third working example of the code conversion device according to the present invention.

FIG. 9 shows the configuration of the third working example of the code conversion device according to the present invention. Referring to FIG. 9, this third working example selects second ACB code that is supplied from ACB code conversion circuit 200 and second ACB code that is supplied from ACB code generation circuit 3200. In the third working example, ACB code generation circuit 1200 of the second working example is replaced by ACB code generation circuit 3200, and the following explanation principally regards this point of difference.

With the exception of additional output lines, ACB code conversion circuit 200 is equivalent to the above-described prior art. ACB code conversion circuit 200 finds second ACB code in a first subframe, supplies the second ACB code to switch 62, and supplies ACB delay that corresponds to the second ACB code, i.e., the second ACB delay, to ACB code generation circuit 3200.

ACB code generation circuit 3200 receives the second ACB delay that is supplied from ACB code conversion circuit 200 in the first subframe and stores and holds this second ACB delay. In the second subframe, ACB code generation circuit 3200 receives the first LP coefficient and second LP coefficient that are supplied from LSP-LPC conversion circuit 1110, receives the speech signal and the first ACB delay that are supplied from speech decoding circuit 1500, and then finds the second ACB delay based on these inputs.

ACB code generation circuit 3200 then supplies code that corresponds to the second ACB delay and that can be decoded by System B to switch 62 as the second ACB code.

Figure 10:
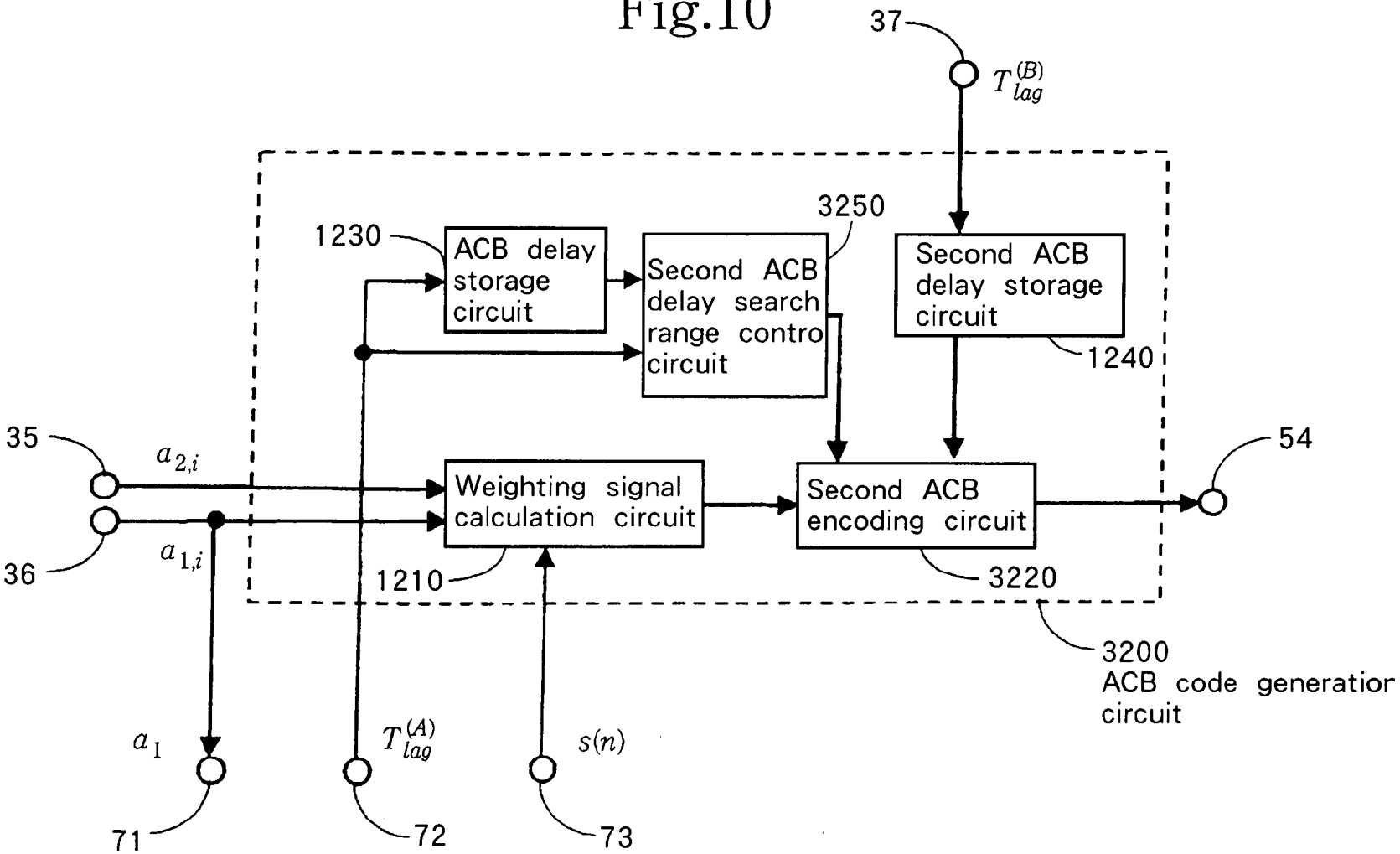
FIG. 10 is a view of the configuration of the ACB code generation circuit in the third working example of the code conversion device according to the present invention.

FIG. 10 shows the configuration of ACB code generation circuit 3200 in the third working example of the present invention. Referring to FIG. 10, ACB code generation circuit 3200 is provided with weighting signal calculation circuit 1210, second ACB encoding circuit 3220, ACB delay storage circuit 1230, second ACB delay storage circuit 1240, and second ACB delay search range control circuit 3250. The following explanation regards each of the components of ACB code generation circuit 3200.

As for the points of difference between ACB code generation circuit 3200 and ACB code generation circuit 1200 shown in FIG. 7, ACB delay search range control circuit 1250 of FIG. 7 is second ACB delay search range control circuit 3250, and ACB encoding circuit 1220 of FIG. 7 is second ACB encoding circuit 3220. Other than the method of connection, the other components are equivalent to those of ACB code generation circuit 1200, and only the above-described points of difference will be explained. Second ACB delay search range control circuit 3250 receives a past first ACB delay that is supplied from ACB delay storage circuit 1230, and further, receives the first ACB delay (the current delay) that is supplied from ACB decoding circuit 1510. Second ACB delay search range control circuit 3250 then calculates the search range control value from the past first ACB delay and the current first ACB delay. If the $m^{th}$ subframe of the $n^{th}$ frame is simply represented by time t, search range control value $d_{range}(t)$ at time t is calculated by the following equation (8):

$$d(t)=\alpha\cdot|T_{lag}^{(A)}(t)-T_{lag}^{(A)}(t-1)|$$

$$d_{range}(t)=d(t),\ d(t)<C_{rangemax}$$

$$d_{range}(t)=C_{rangemax},\ d(t)\geqq C_{rangemax} \tag{8}$$

where $T^{(A)}$lag represents the first ACB delay at time t, α is a coefficient (for example, 2), and $C_{rangemax}$ is a constant (for example, 4). These constants can also be determined from the average values of a large number of d(t) that are obtained beforehand.

In addition, d(t) can be represented by the following equation (9):

$$d(t)=\frac{a}{N_{range}}\cdot\sum_{k=1}^{N_{range}} w(k)|T_{lag}^{(A)}(t-(k-1))-T_{lag}^{(A)}(t-k)| \tag{9}$$

where $N_{range}$ is a constant (for example, 2), and w(k) is a weighing coefficient (for example, w(1)=1.0 and w(2)=0.8).

Second ACB delay search range control circuit 3250 supplies the search range control value that is found by the above-described calculation to second ACB encoding circuit 3220.

In the second subframe, second ACB encoding circuit 3220 receives the second ACB delay that is supplied from second ACB delay storage circuit 1240, receives an auditory weighting speech signal that is supplied from weighting signal calculation circuit 1210, and receives the search range control value that is supplied from second ACB delay search range control circuit 3250.

Second ACB encoding circuit 3220 calculates autocorrelation from the auditory weighting speech signal for delay that is within a range of values that are stipulated by the search range control value and that centers on the second ACB delay, selects the delay for which the autocorrelation is a maximum, and takes the selected delay as the second ACB delay. As in the first working example, a normalized autocorrelation may also be used in place of the autocorrelation. The method of calculating the autocorrelation and the normalized autocorrelation is the same as in the above-described first working example.

Second ACB encoding circuit 3220 next uses the correlation between the ACB code and the ACB delay in System B that is shown in FIG. 2 to obtain the second ACB code that corresponds to the second ACB delay, as in the above-described prior art. Second ACB encoding circuit 3220 then supplies the second ACB code to code multiplexing circuit 1020 by way of output terminal 54.

Other than the method of connection, second ACB delay storage circuit 1240 of this working example is equivalent to that of the above-described first working example. Second ACB delay storage circuit 1240 receives the second ACB delay that is supplied from ACB code conversion circuit 200 in the first subframe and stores and holds this delay. Second ACB delay storage circuit 1240 then supplies the second ACB delay that has been stored and held to second ACB encoding circuit 3220 in the second subframe.

Figure 23:
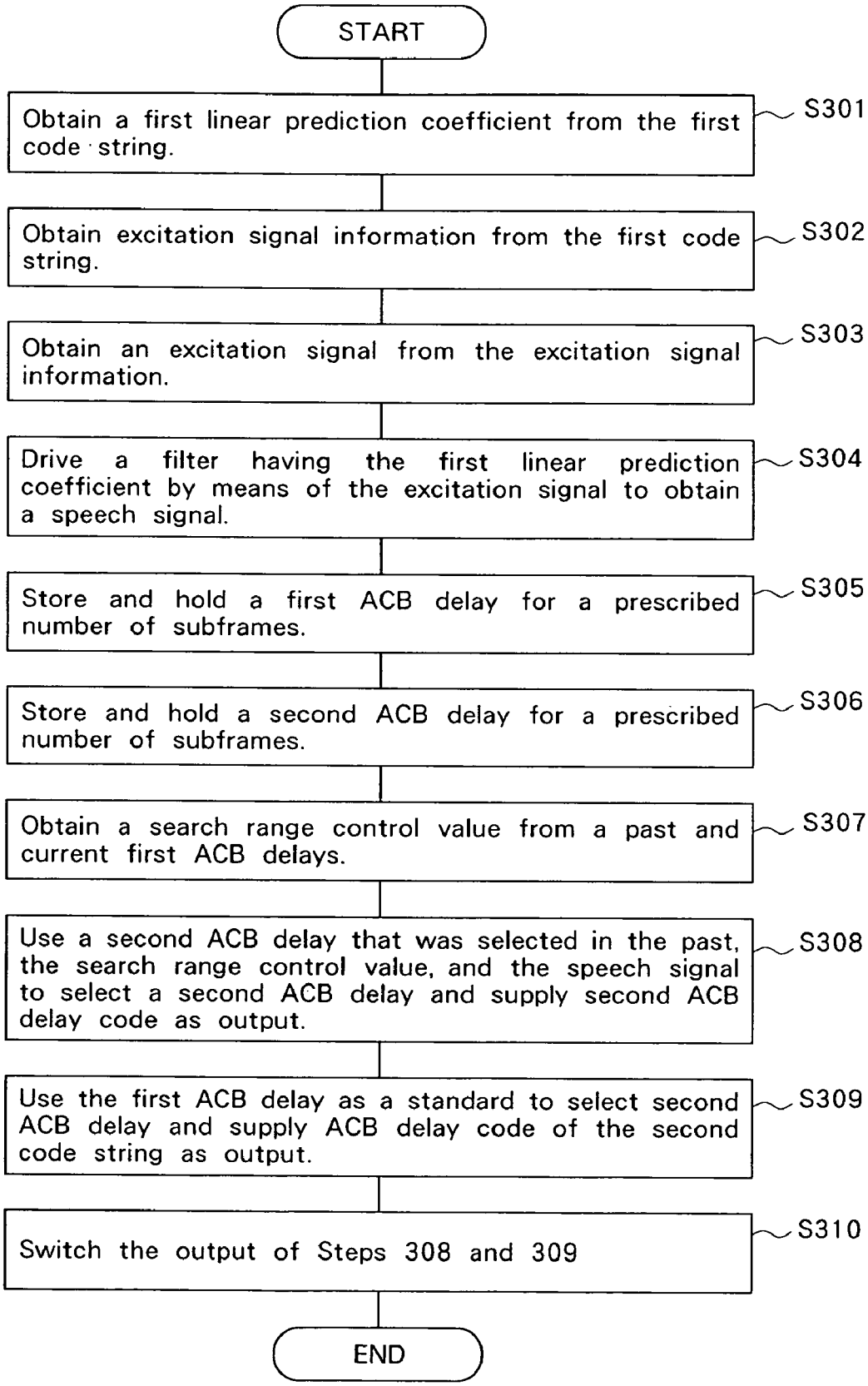
FIG. 23 is an explanatory view of the processes of the third working example of the method according to the present invention.

Referring now to FIG. 9 and the flow chart of FIG. 23, the following explanation regards the code conversion method for converting a first code string to a second code string in the above-described third working example. FIG. 23 is a flow chart for explaining the operations of the third working example of the method according to the present invention.

A first LP coefficient is obtained from the code of the first code string (LP coefficient code) that has been separated by code separation circuit 1010 (Step S301).

In speech decoding circuit 1500, excitation signal information is obtained from the first code string, and an excitation signal is obtained from the excitation signal information as in the first working example (Steps S302 and S303).

In speech decoding circuit 1500, a speech signal s(n) is generated by driving a compound filter 1580 having the first LP coefficient by means of the obtained excitation signal (Step S304), and a first ACB delay that is contained in the excitation signal information is successively stored, and the first ACB delay of a predetermined number of subframes is held (Step S305).

Further, in speech decoding circuit 1500, a second ACB delay that corresponds to the code of the ACB delay in the second code string is successively stored for each subframe, and the second ACB delay of a predetermined number of subframes is held (Step S306).

In ACB code generation circuit 3200, the difference between the first ACB delay of consecutive subframes is calculated with respect to a past first ACB delay that has been stored and held and the first ACB delay of the current subframe, the absolute value of this difference is calculated, and a value that is obtained by adding, for the number of subframes, values obtained by multiplying the absolute values by a weighting coefficient is taken as the search range control value (Step S307).

In ACB code generation circuit 3200, in at least one subframe of a frame, the speech signal is used to select a second adaptive codebook delay from delay that is within a range that is stipulated by the search range control value and a second ACB delay that has been previously found, stored, and held; and code that corresponds to the second adaptive codebook delay is supplied as code of an adaptive codebook delay in the second code string (Step S308).

In ACB code conversion circuit 200, the relation between first ACB delay and a first delay code that corresponds to this first ACB delay and the relation between second ACB delay and a second delay code that corresponds to this second ACB delay are used to place the first ACB delay in correspondence with second ACB delay in at least one subframe in the frame (for example, the first frame) and thus perform conversion from the first delay code to the second delay code, and the second delay code is then supplied as the code of ACB delay in the second code string (Step S309).

Second ACB delay $T^{(B)}$lag from ACB code conversion circuit 200 is supplied to ACB code generation circuit 3200, and stored and held in Step S306.

Switch 62 switches between the code of ACB delay that is supplied from ACB code conversion circuit 200 and code of the ACB delay that is supplied from ACB code generation circuit 3200 and supplies output to code multiplexing circuit 1020 (Step S310).

FOURTH WORKING EXAMPLE

Explanation next regards the fourth working example of the code conversion device according to the present invention with reference to FIG. 4. As previously explained, FIG. 4, which was referred to in the first working example, is also used in the explanation of this fourth working example. The point of difference between the configuration of the fourth working example and that of the first working example is the use of ACB code generation circuit 4200 for ACB code generation circuit 1200.

Figure 11:
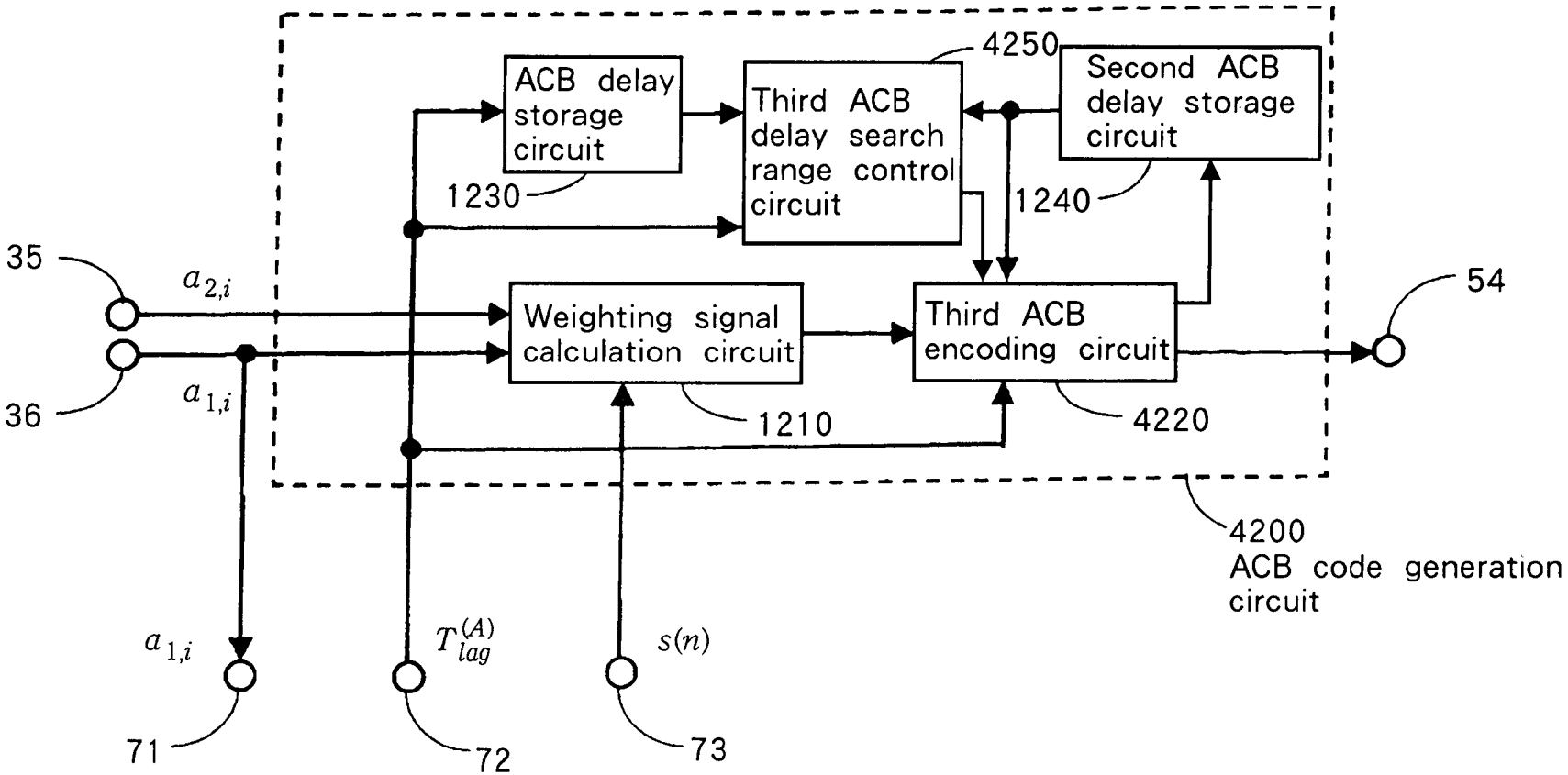
FIG. 11 is a view of the configuration of the ACB code generation circuit in the fourth working example of the code conversion device according to the present invention.

Regarding the points of difference between the configuration that is shown in FIG. 7, which shows ACB code generation circuit 1200 of FIG. 4, and the configuration of ACB code generation circuit 4200 that is shown in FIG. 11, ACB delay search range control circuit 1250 in FIG. 7 is replaced by third ACB delay search range control circuit 4250 of FIG. 11, and ACB encoding circuit 1220 in FIG. 7 is replaced by third ACB encoding circuit 4220 of FIG. 11. Other than the method of connection, the components of ACB code generation circuit 4200 are otherwise equivalent to those of ACB code generation circuit 1200.

Referring to FIG. 11, the following explanation regards third ACB delay search range control circuit 4250 and second ACB encoding circuit 4220 in the fourth working example. Third ACB delay search range control circuit 4250 receives as input (the current) first ACB delay that is supplied from ACB decoding circuit 1510, past first ACB delay that is supplied from ACB delay storage circuit 1230, and past second ACB delay that is supplied from second ACB delay storage circuit 1240.

In the first subframe, third ACB delay search range control circuit 4250 calculates a search range control value from the past first ACB delay and the past second ACB delay. In this case, when the $m^{th}$ subframe of the $n^{th}$ frame is simply represented by time t, search range control value $d_{range}(t)$ at time t is calculated by the following equation (10):

$$d(t)=\alpha_1\cdot|T_{lag}^{(A)}(t-1)-T_{lag}^{(B)}(t-1)|$$

$$d_{range}(t)=d(t),\ d(t)<C_{rangemax1}$$

$$d_{range}(t)=C_{rangemax1},\ d(t)\geqq C_{rangemax1} \tag{10}$$

where $T^{(A)}$lag represents the first ACB delay at time t, $T^{(B)}$lag represents the second ACB delay at time t, $\alpha_1$ is a coefficient (for example, 2), and $c_{rangemax1}$ is a constant (for example, 4). These constants can be determined from the average value of a large number of d(t) that are obtained beforehand, or d(t) can be represented by the following equation (11):

$$d(t)=\frac{a_1}{N_{range}}\cdot\sum_{k=1}^{N_{range1}} w_1(k)|T_{lage}^{(A)}(t-k)-T_{lag}^{(B)}(t-k)| \tag{11}$$

where $N_{range1}$ is a constant (for example, 2), and $w_1(k)$ is a weighting coefficient (for example, $w_1(1)=1.0$, and $w_1(2)=0.8$).

In the second subframe, third ACB delay search range control circuit 4250 calculates the search range control value from a past first ACB delay and the current first ACB delay. Search range control value $d_{range}(t)$ at time (t) is calculated from the following equation (12):

$$d(t)=\alpha_2\cdot|T_{lag}^{(A)}(t)-T_{lag}^{(A)}(t-1)|$$

$$d_{range}(t)=d(t),\ d(t)<C_{rangemax2}$$

$$d_{range}(t)=C_{rangemax2},\ d(t)\geqq C_{rangemax2} \tag{12}$$

where $\alpha_2$ is a coefficient (for example, 2), and $c_{rangemax2}$ is a constant (for example, 4). These constants can be determined from the average value of a large number of d(t) that are obtained beforehand. Alternatively, d(t) can be represented by the following equation (13):

$$d(t)=\frac{a_2}{N_{range}}\cdot\sum_{k=1}^{N_{range2}} w_2(k)|T_{lag}^{(A)}(t-(k-1))-T_{lag}^{(A)}(t-k)| \tag{13}$$

where $N_{range2}$ is a constant (for example, 2), and $w_2(k)$ is a weighting coefficient (for example, $w_2(1)=1.0$ and $w_2(2)=0.8$).

As a final step, third ACB delay search range control circuit 4250 supplies the search range control value that has been found by the above-described calculation to third ACB encoding circuit 4220.

Third ACB encoding circuit 4220 receives an auditory weighting speech signal that is supplied from weighting signal calculation circuit 1210, receives the first ACB delay that is supplied from ACB decoding circuit 1510 by way of input terminal 72, receives the past second ACB delay that is supplied from second ACB delay storage circuit 1240, and receives the search range control value that is supplied from third ACB delay search range control circuit 4250.

In the first subframe, third ACB encoding circuit 4220 calculates autocorrelation from the auditory weighting speech signal for delay that is within a range of values that is stipulated by the search range control value and that centers on the first ACB delay, selects the delay for which the autocorrelation is a maximum, and takes the selected delay as the second ACB delay.

In the second subframe, third ACB encoding circuit 4220 calculates autocorrelation from the auditory weighting speech signal for delay that is within a range of values that is stipulated by the search range control value and that centers on the past second ACB delay, selects the delay for which the autocorrelation is a maximum, and takes the selected delay as the second ACB delay.

In this case, a normalized autocorrelation may be used in place of the autocorrelation, as in the above-described first working example. The method of calculating the autocorrelation and the normalized autocorrelation is the same as in the first working example.

Third ACB encoding circuit 4220 next uses the correlation between the ACB code and ACB delay in System B that is shown in FIG. 2 to obtain a second ACB code that corresponds to the second ACB delay, as in the above-described prior art. Third ACB encoding circuit 4220 then supplies the second ACB code by way of output terminal 54 to code multiplexing circuit 1020, and further, supplies the second ACB delay to second ACB delay storage circuit 1240.

Figure 24:
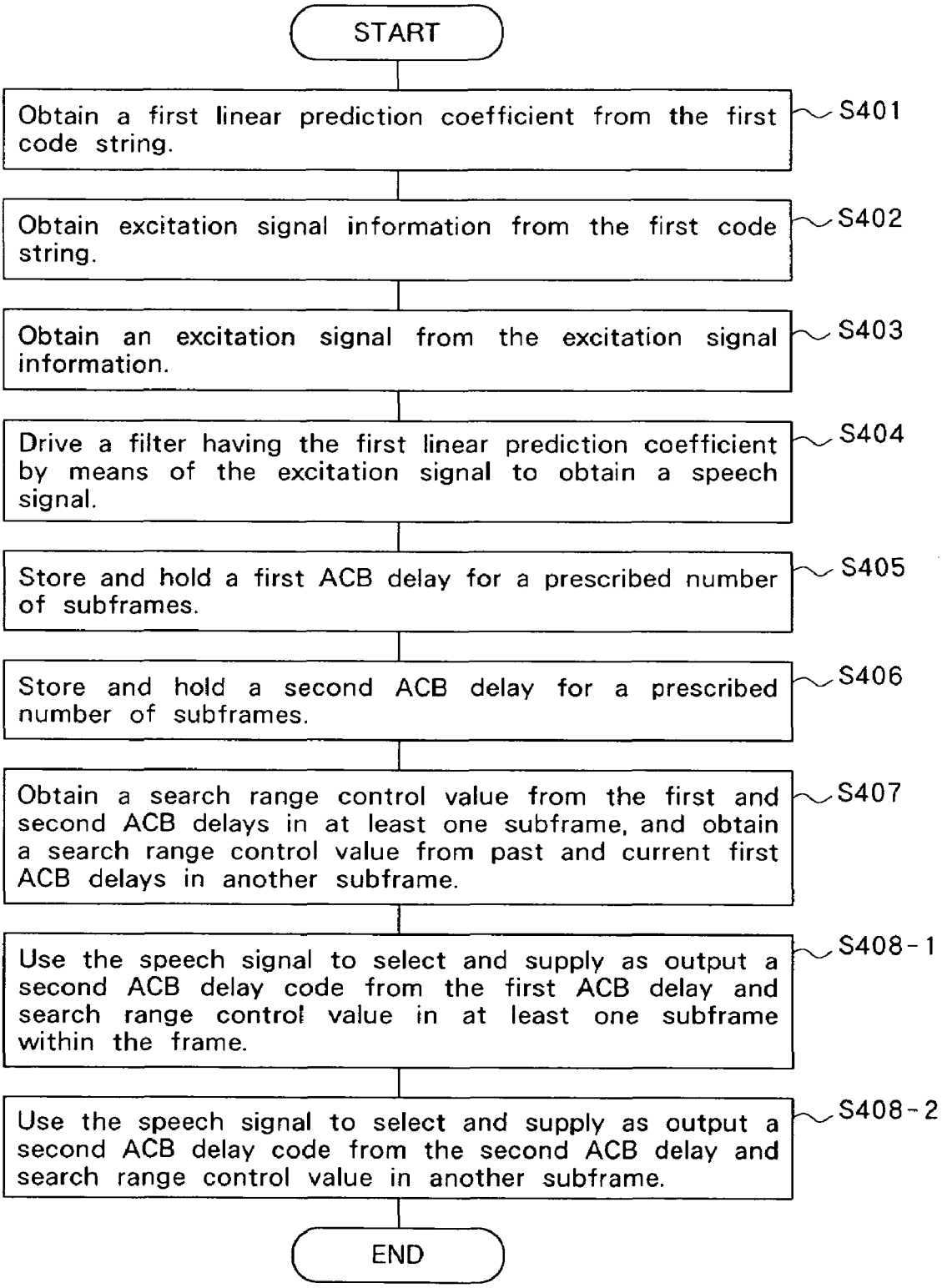
FIG. 24 is an explanatory view of the processes of the fourth working example of the method according to the present invention.

Referring now to FIG. 4, FIG. 11, and the flow chart of FIG. 24, the following explanation regards the code conversion method for converting a first code string to a second code string in the above-described fourth working example. FIG. 24 is a flow chart for explaining the operation of the fourth working example of the method according to the present invention.

A first LP coefficient is obtained from the code (LP coefficient code) of a first code string that has been separated by code separation circuit 1010 (Step S401).

In speech decoding circuit 1500, excitation signal information is obtained from the first code string, and an excitation signal is obtained from the excitation signal information (Steps S402 and S403).

In speech decoding circuit 1500, a speech signal s(n) is generated by driving a compound filter having the first LP coefficient by means of the obtained excitation signal (Step S404).

The first ACB delay that is contained in the excitation signal information is successively stored, and the first ACB delay is held for a number of subframes that has been determined in advance (Step S405).

Second ACB delay that corresponds to the code of ACB delay in the second code string is successively stored for each subframe, and the second ACB delay is held for a number of subframes that has been determined in advance (Step S406).

In ACB code generation circuit 4200, in at least one subframe in a frame, the absolute value of the difference between the first ACB delay that has been stored and held and the second ACB delay that has been stored and held that correspond to the same subframe is calculated for all of the first ACB delays and the second ACB delays that are held, and a value that is obtained by adding, for the number of subframes, values that are obtained by multiplying the absolute values by a weighting coefficient is taken as the search range control value.

In other subframes, the difference between the first adaptive codebook delay of consecutive subframes is calculated with respect to a past first ACB delay that has been stored and held and the first ACB delay of the current subframe, the absolute value of this difference is calculated, and a value that is obtained by adding, for the number of subframes, values that are obtained by multiplying the absolute values by a weighting coefficient is taken as the search range control value (Step S407).

In at least one subframe of the frame, ACB code generation circuit 4200 uses the speech signal s(n) to select a second ACB delay from delay that is within a range that is stipulated by the above-described search range control value and the first ACB delay, and supplies code that corresponds to the second ACB delay as codes of ACB delays in the second code string (Step S408-1).

In other subframes, ACB code generation circuit 4200 uses the speech signal s(n) to select a second ACB delay from delay that is within a range that is stipulated by the search range control value and the second ACB delay that has been previously found, stored and held, and supplies code that corresponds to the second ACB delay as code of the ACB delay in the second code string (Step S408-2).

FIFTH WORKING EXAMPLE

Figure 12:
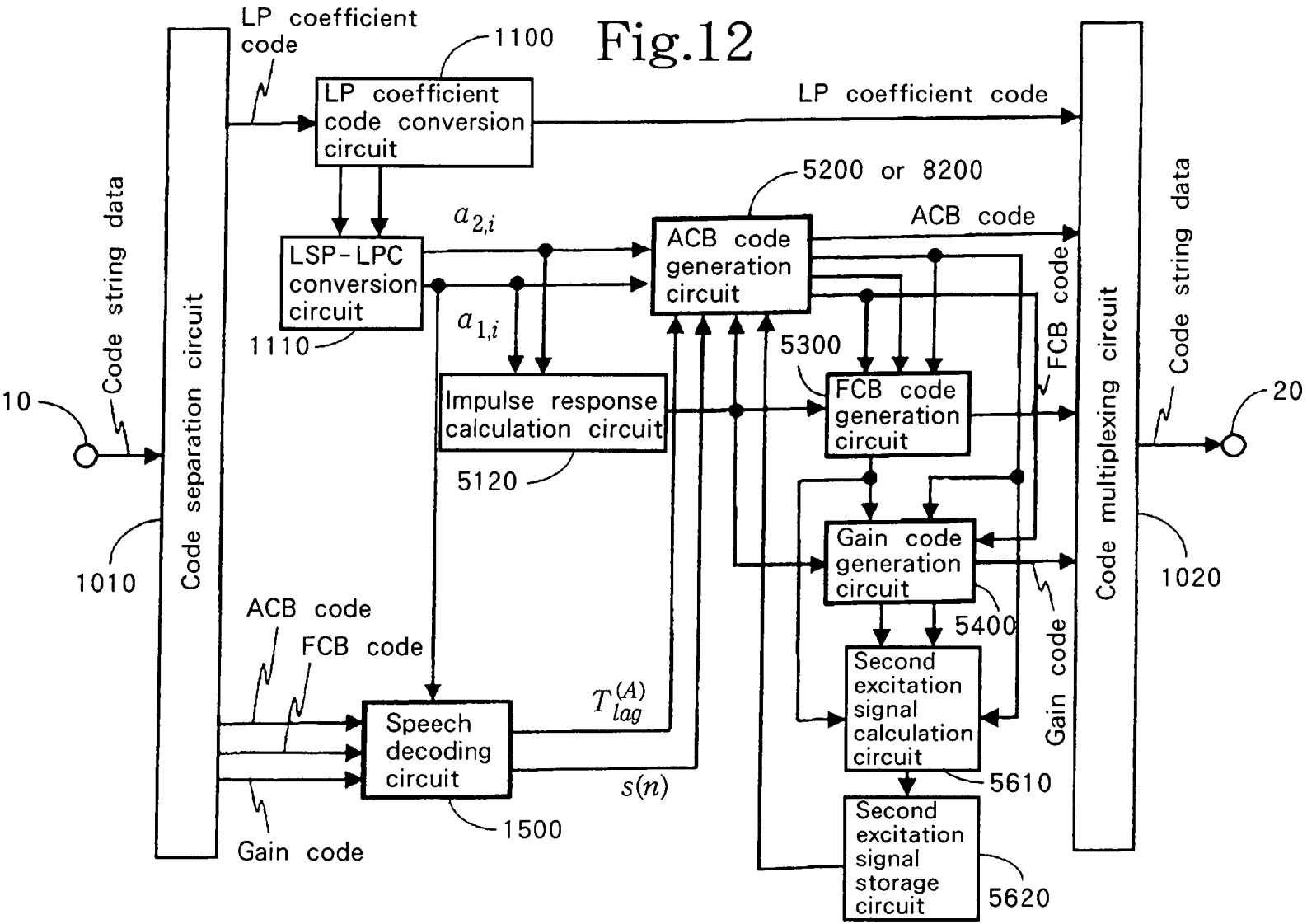
FIG. 12 is a view of the configuration of the fifth working example and the eighth working example of the code conversion device according to the present invention.

FIG. 12 shows the configuration of the fifth working example of the code conversion device according to the present invention. FIG. 12 shows a configuration for finding ACB code, FCB code, and gain code from the speech signal (decoded speech) and LP coefficients that correspond to code following code conversion.

Regarding the points of difference between this fifth working example and the first working example that is shown in FIG. 4: FCB code conversion circuit 300 and gain code conversion circuit 400 of FIG. 4 have been omitted; ACB code generation circuit 1200 is constituted by ACB code generation circuit 5200; and impulse response calculation circuit 5120, FCB code generation circuit 5300, gain code generation circuit 5400, and second excitation signal calculation circuit 5610, and second excitation signal storage circuit 5620 have been added.

The following explanation principally regards the above-described points of difference, and explanation regarding components that are identical or equivalent to the components shown in FIG. 4 has been omitted.

In addition, the principal point of difference between the present working example and the eighth working example that is to be explained hereinbelow is the provision of ACB code generation circuit 8200 for ACB code generation circuit 5200. The reference numeral 8200 is therefore shown together with 5200, and FIG. 12 is used in the explanations of the two working examples.

ACB code generation circuit 5200 receives the first LP coefficient and the second LP coefficient from LSP-LPC conversion circuit 1110, receives decoded speech and the first ACB delay that corresponds to first ACB code from speech decoding circuit 1500, receives an impulse response signal from impulse response calculation circuit 5120, and receives a past second excitation signal that has been stored and held by second excitation signal storage circuit 5620.

ACB code generation circuit 5200 calculates a first target signal from decoded speech and from the first LP coefficient and the second LP coefficient.

ACB code generation circuit 5200 next finds a second ACB delay, a second ACB signal, and the optimum ACB gain from the past second excitation signal, the impulse response signal, and the first target signal.

ACB code generation circuit 5200 then: supplies the first target signal to FCB code generation circuit 5300 and gain code generation circuit 5400; supplies the optimum ACB gain to FCB code generation circuit 5300; supplies the second ACB signal to FCB code generation circuit 5300, gain code generation circuit 5400, and second excitation signal calculation circuit 5610; and supplies code that corresponds to the second ACB delay and that can be decoded by System B to code multiplexing circuit 1020 as the second ACB code.

Impulse response calculation circuit 5120 receives first LP coefficient and second LP coefficient that are supplied from LSP-LPC conversion circuit 1110, uses the first LP coefficient and second LP coefficient to compose an auditory weighting compound filter. Impulse response calculation circuit 5120 then supplies the impulse response signal of the auditory weighting compound filter to ACB code generation circuit 5200, FCB code generation circuit 5300, and gain code generation circuit 5400. In this case, the transfer function W(z) of the auditory weighting compound filter is represented by the following equation (14):

$$\frac{W(z)}{A_2(z)} = \frac{A_1(z/\gamma_1)}{A_2(z)A_1(z/\gamma_2)} \tag{14}$$

$$\frac{1}{A_2(z)} = \frac{1}{1 + \sum_{i=1}^{P} a_{2,i} z^{-i}} \tag{15}$$

is the transfer function of the linear prediction filter having the second LP coefficient $\alpha_{2,i}$, where i=1, . . . , P.

FCB code generation circuit 5300 receives the first target signal, the second ACB signal, and the optimum ACB gain from ACB code generation circuit 5200, and receives the impulse response signal that is supplied from impulse response calculation circuit 5120.

FCB code generation circuit 5300 calculates a second target signal from the first target signal, the second ACB signal, the optimum ACB gain, and the impulse response signal.

Next, based on the second target signal, an FCB signal that is stored in a table that is incorporated in FCB code generation circuit 5300, and the impulse response signal, FCB code generation circuit 5300 finds an FCB signal such that the distance from the second target signal is a minimum.

FCB code generation circuit 5300 next supplies code that corresponds to the FCB signal and that can be decoded by System B to code multiplexing circuit 1020 as the second FCB code, and supplies the FCB signal as the second FCB signal to gain code generation circuit 5400 and second excitation signal calculation circuit 5610.

Gain code generation circuit 5400 receives the first target signal and the second ACB signal that are supplied from ACB code generation circuit 5200, receives the second FCB signal that is supplied from FCB code generation circuit 5300, and receives impulse response signal that is supplied from impulse response calculation circuit 5120.

Gain code generation circuit 5400 then finds ACB gain and FCB gain that minimize the weighting square error between the first target signal and the reconstructed speech signal, this ACB gain and FCB gain being calculated based on the first target signal, the second ACB signal, the second FCB signal, and the impulse response signal, and ACB gain and FCB gain that are stored in a table that is incorporated in gain code generation circuit 5400.

Gain code generation circuit 5400 then supplies code that corresponds to the ACB gain and FCB gain and that can be decoded by System B to code multiplexing circuit 1020 as the second gain code; and supplies the ACB gain and FCB gain to second excitation signal calculation circuit 5610 as second ACB gain and second FCB gain, respectively.

Second excitation signal calculation circuit 5610 receives the second ACB signal that is supplied from ACB code generation circuit 5200, receives the second FCB signal that is supplied from FCB code generation circuit 5300, and receives the second ACB gain and second FCB gain that are supplied from gain code generation circuit 5400.

Second excitation signal calculation circuit 5610 then obtains a second excitation signal by adding a signal that is obtained by multiplying the second ACB signal by the second ACB gain to a signal that is obtained by multiplying the second FCB signal by the second FCB gain. Second excitation signal calculation circuit 5610 then supplies the second excitation signal to the second excitation signal storage circuit 5620.

Second excitation signal storage circuit 5620 receives the second excitation signal that is supplied from second excitation signal calculation circuit 5610, and stores and holds this signal. Second excitation signal storage circuit 5620 then supplies a second excitation signal that was received, stored, and held in the past to ACB code generation circuit 5200.

The following explanation regards the details of the configurations of ACB code generation circuit 5200, FCB code generation circuit 5300, and gain code generation circuit 5400.

Figure 13:
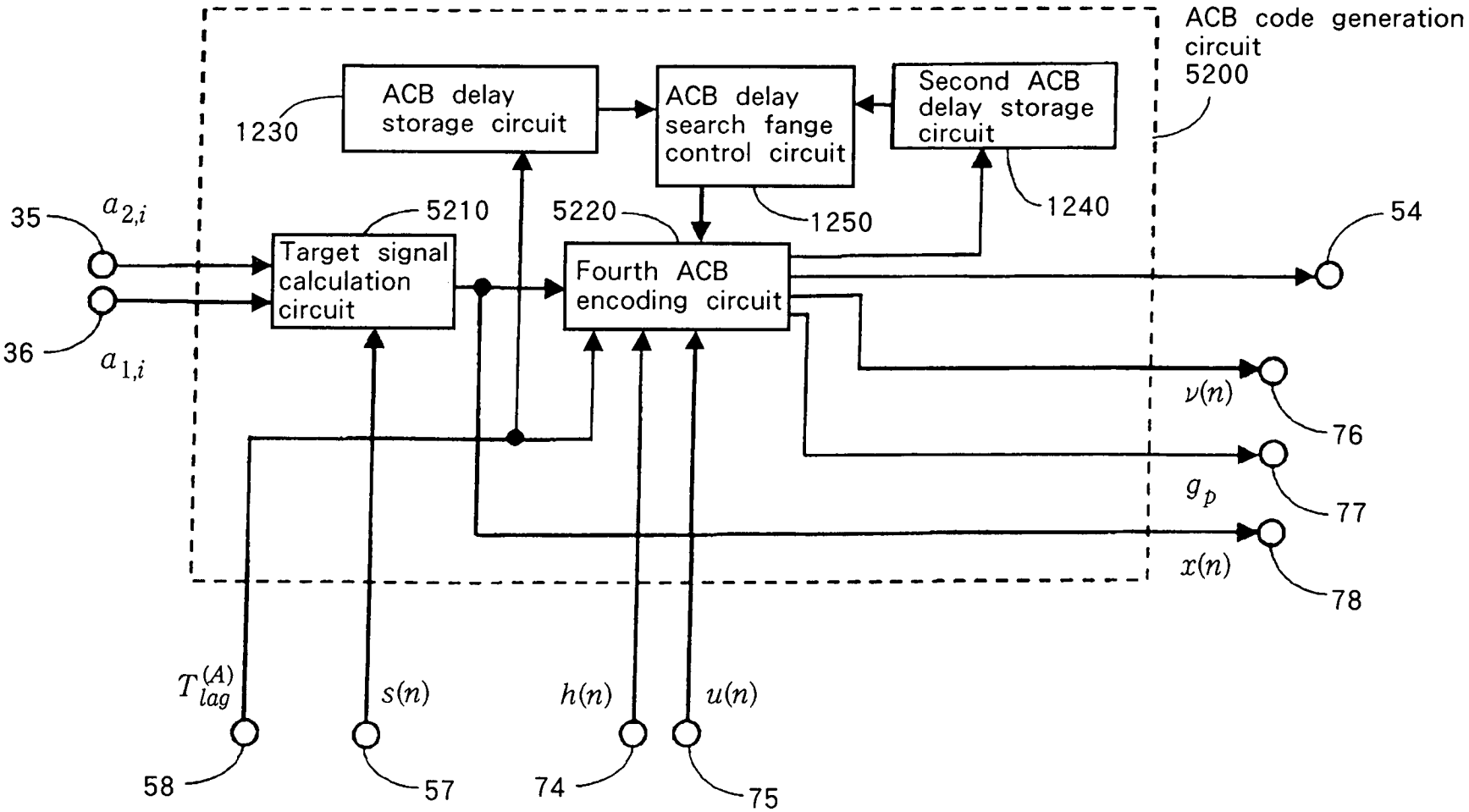
FIG. 13 is a view of the configuration of the ACB code generation circuit in the fifth working example and the sixth working example of the code conversion device according to the present invention.

FIG. 13 shows the configuration of ACB code generation circuit 5200. The following explanation regards each of the constituent elements of ACB code generation circuit 5200 with reference to FIG. 13.

Referring now to FIG. 13, compared with the configuration of ACB code generation circuit 1200 that was shown in FIG. 7, ACB code generation circuit 5200 is provided with target signal calculation circuit 5210 and fourth ACB encoding circuit 5220 in place of weighting signal calculation circuit 1210 and ACB encoding circuit 1220 in FIG. 7. The components are otherwise similar to the components of ACB code generation circuit 1200, and the following explanation regarding ACB code generation circuit 5200 therefore regards only the points of difference with ACB code generation circuit 1200.

Target signal calculation circuit 5210 receives decoded speech that is supplied from compound filter 1580 by way of input terminal 57, and receives the first LP coefficient and the second LP coefficient that are supplied from LSP-LPC conversion circuit 1110 by way of input terminal 36 and input terminal 35, respectively.

Target signal calculation circuit 5210 first uses the first LP coefficient to make up an auditory weighting filter. Target signal calculation circuit 5210 then generates an auditory weighted speech signal by driving the auditory weighting filter by means of the decoded speech. The transfer function of the auditory weighting filter in this case is represented by W(z), as with the transfer function in weighting signal calculation circuit 1210.

Target signal calculation circuit 5210 next uses the first LP coefficient and second LP coefficient to make up an auditory weighting compound filter. Target signal calculation circuit 5210 both supplies a first target signal, which is obtained by subtracting the zero input response of the auditory weighting compound filter from the auditory weighting speech signal, to fourth ACB encoding circuit 5220 and supplies the first target signal to second target signal calculation circuit 5310 and gain encoding circuit 5410 by way of output terminal 78. The transfer function of the auditory weighting compound filter in this case is represented by the following equation (16):

$$\frac{W(z)}{A_2(z)} = \frac{A_1(z/\gamma_1)}{A_2(z)A_1(z/\gamma_2)} \tag{16}$$

Fourth ACB encoding circuit 5220 receives the first target signal that is supplied from target signal calculation circuit 5210, receives the first ACB delay that is supplied from ACB decoding circuit 1510 by way of input terminal 58, receives the search range control value that is supplied from ACB delay search range control circuit 1250, receives the impulse response signal that is supplied from impulse response calculation circuit 5120 by way of input terminal 74, and receives a past second excitation signal that is supplied from second excitation signal storage circuit 5620 by way of input terminal 75.

Fourth ACB encoding circuit 5220 calculates past excitation signal $y_k(n)$, n=0, . . . $L^{(B)}sfr-1$ of delay k that has been filter-processed by convolution of an impulse response signal and a signal that is obtained by cutting delay k from a past second excitation signal.

Fourth ACB encoding circuit 5220 next calculates the normalized cross-correlation from $y_k(n)$ and the first target signal x(n) for delay k that is within a range of values that is stipulated by the search range control value and that center on the first ACB delay, and selects the delay having the maximum normalized cross-correlation. This corresponds to selecting the delay having the minimum square difference between x(n) and $y_k(n)$.

The selected delay is taken as the second ACB delay, and a signal that is obtained by cutting the second ACB delay from the past second excitation signal is taken as the second ACB signal v(n). In this case, normalized cross-correlation $R_{xy}(k)$ is represented by the following equation:

$$R_{xy}(k) = \frac{\sum_{n=0}^{L_{sfr}^{(B)}-1} x(n)y_k(n)}{\sqrt{\sum_{n=0}^{L_{sfr}^{(B)}-1} y_k(n)y_k(n)}} \tag{17}$$

Fourth ACB encoding circuit 5220 also calculates the optimum ACB gain gp from the second ACB signal by means of the following equation (18):

$$g_P = \frac{\sum_{n=0}^{L_{sfr}^{(B)}-1} x(n)y_k(n)}{\sum_{n=0}^{L_{sfr}^{(B)}-1} y_k(n)y_k(n)} \tag{18}$$

Finally, as in the above-described prior art, fourth ACB encoding circuit 5220 uses the correlation between the ACB signal and the ACB delay in System B shown in FIG. 2 to find code that corresponds to the second ACB delay and that can be decoded by System B and supplies this code as second ACB code to code multiplexing circuit 1020 by way of output terminal 54.

Fourth ACB encoding circuit 5220 also supplies the second ACB delay to second ACB delay storage circuit 1240, supplies the second ACB signal to second target signal calculation circuit 5310 (refer to FIG. 14), to gain encoding circuit 5410 (refer to FIG. 15), and to second excitation signal calculation circuit 5610 by way of output terminal 76, and supplies the optimum ACB gain to second target signal calculation circuit 5310 by way of output terminal 77. In addition, details regarding the method of finding the second ACB delay, the method of calculating the second ACB signal, and the method of calculating the optimum ACB gain are provided in the description of Section 3.7 of Reference 3. This completes the explanation of ACB code generation circuit 5200.

Figure 14:
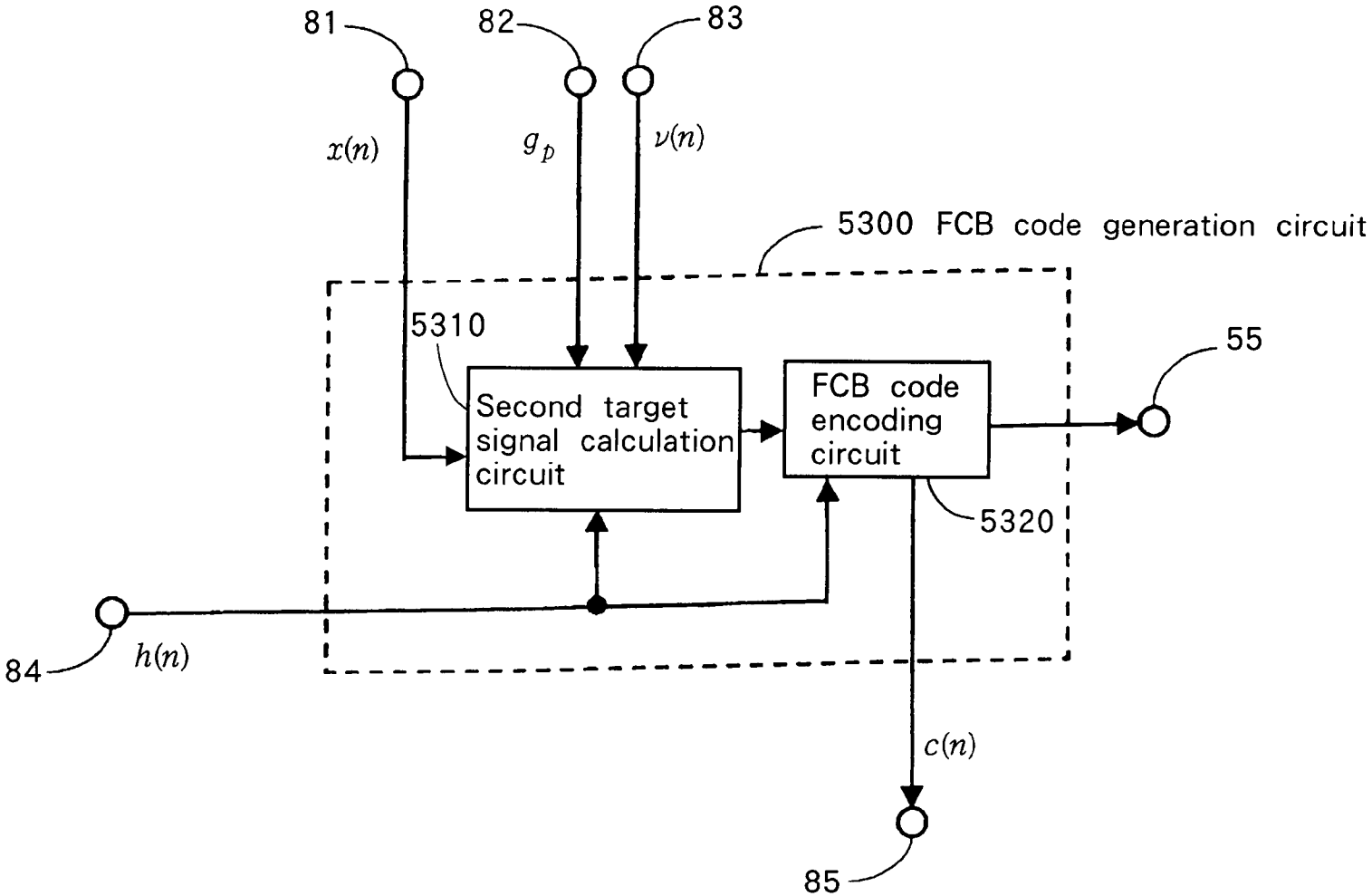
FIG. 14 is a view of the configuration of the FCB code generation circuit in a working example of the code conversion device according to the present invention.

FIG. 14 shows the configuration of FCB code generation circuit 5300. Referring to FIG. 14, the following explanation regards each of the components of FCB code generation circuit 5300.

Second target signal calculation circuit 5310 receives the first target signal that is supplied from target signal calculation circuit 5210 by way of input terminal 81, receives the impulse response signal that is supplied from impulse response calculation circuit 5120 by way of input terminal 84, and receives the second ACB signal and the optimum ACB gain that are supplied from fourth ACB encoding circuit 5220 by way of input terminals 83 and 82, respectively.

Second target signal calculation circuit 5310 calculates a filter-processed second ACB signal y(n), n=0, . . . , $L^{(B)}sfr-1$ by convolution of the second ACB signal and the impulse response signal, and obtains a second target signal x'(n) by cutting a signal that is obtained by multiplying the optimum ACB gain by y(n) from the first target signal.

Second target signal calculation circuit 5310 then supplies the second target signal to FCB encoding circuit 5320.

FCB encoding circuit 5320 receives the second target signal that is supplied from second target signal calculation circuit 5310, and receives the impulse response signal that is supplied from impulse response calculation circuit 5210 by way of input terminal 84. FCB encoding circuit 5320 incorporates a table in which a plurality of FCB signals are stored and successively reads FCB signals from this table; and successively calculates a filter-processed FCB signal z(n), n=0, . . . , $L^{(B)}sfr-1$ by convolution of the FCB signal and the impulse response signal.

FCB encoding circuit 5320 next successively calculates the normalized cross-correlation of z(n) and second target signal x'(n), and selects the FCB signal for which the normalized cross-correlation is a maximum. This corresponds to selecting the FCB signal for which the squared error of x'(n) and z(n) is a minimum. The normalized cross-correlation $R_{xy}(k)$ is here represented by the following equation (19):

$$R_{x'z}(k) = \frac{\sum_{n=0}^{L_{sfr}^{(B)}-1} x'(n)z(n)}{\sqrt{\sum_{n=0}^{L_{sfr}^{(B)}-1} z(n)z(n)}} \tag{19}$$

Assuming that the selected FCB signal is second FCB signal c(n), FCB encoding circuit 5320 then supplies code that can be decoded by System B and that corresponds to the second FCB signal as second FCB code to code multiplexing circuit 1020 by way of output terminal 55, and further supplies the second FCB signal to gain encoding circuit 5410 and second excitation signal calculation circuit 5610 by way of output terminal 85.

Regarding the method of representing the FCB signal, as with the first FCB signal in the above-described first working example, a method may be employed in which the FCB signal is efficiently represented by a multi-pulse signal that is composed of a plurality of pulses and is stipulated by the pulse position and pulse polarity, and in such a case, the second FCB code corresponds to the pulse position and pulse polarity. For details regarding the encoding method when the FCB signal is represented by a multi-pulse, reference can be made to Section 3.8 of Reference 3. This completes the explanation of FCB code generation circuit 5300.

Figure 15:
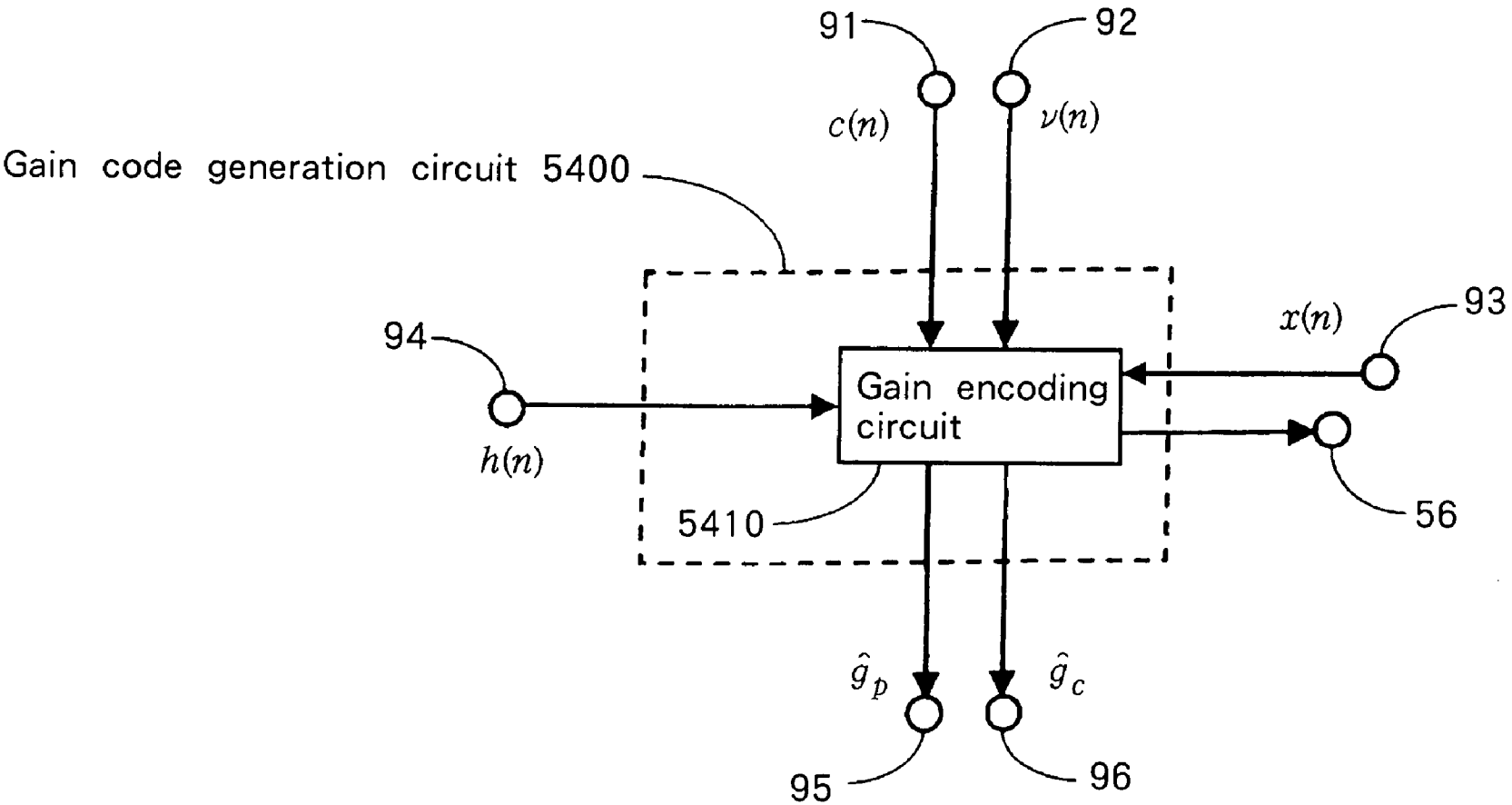
FIG. 15 is a view of the configuration of the gain code generation circuit in a working example of the code conversion device according to the present invention.

FIG. 15 shows the configuration of gain code generation circuit 5400. Referring to FIG. 15, the following explanation regards gain encoding circuit 5410, which is a component of gain code generation circuit 5400.

Gain encoding circuit 5410 receives the first target signal that is supplied from target signal calculation circuit 5210 by way of input terminal 93, receives the second ACB signal that is supplied from fourth ACB encoding circuit 5220 by way of input terminal 92, receives the second FCB signal that is supplied from FCB encoding circuit 5320 by way of input terminal 91, and receives the impulse response signal that is supplied from impulse response calculation circuit 5120 by way of input terminal 94.

Gain encoding circuit 5410 incorporates a table (not shown in the figure) in which a plurality of ACB gain and a plurality of FCB gain are stored; successively reads ACB gain and FCB gain from the table; successively calculates weighted reconstructed speech from the second ACB signal, the second FCB signal, the impulse response signal, and the ACB gain and FCB gain; successively calculates the weighted squared error between the weighted reconstructed speech and the first target signal; and selects the ACB gain and FCB gain for which the weighted squared error is a minimum. The weighted squared error E is here represented by the following equation (20):

$$E = \sum_{n=0}^{L_{sfr}^{(B)}-1} (x(n) - \hat{g}_p \cdot z(n) - \hat{g}_c \cdot y(n))^2 \tag{20}$$

where ^gp and ^gc are ACB gain and FCB gain, respectively. In addition, y(n) is filter-processed second ACB signal that is obtained by convolution of the second ACB signal and the impulse response signal; and z(n) is the filter-processed second FCB signal that is obtained by convolution of the second FCB signal and the impulse response signal. The weighted reconstructed speech is represented by the following equation (21):

$$\hat{s}(n)=\hat{g}_p \cdot z(n)+\hat{g}_c \cdot y(n) \tag{21}$$

Finally, gain encoding circuit 5410 supplies code that corresponds to ACB gain and FCB gain and that can be decoded by System B as second gain code to code multiplexing circuit 1020 by way of output terminal 56; and supplies ACB gain and FCB gain as second ACB gain and second FCB gain, respectively, to second excitation signal calculation circuit 5610 by way of output terminals 95 and 96, respectively. This completes the explanation of gain code generation circuit 5400.

Figure 25:
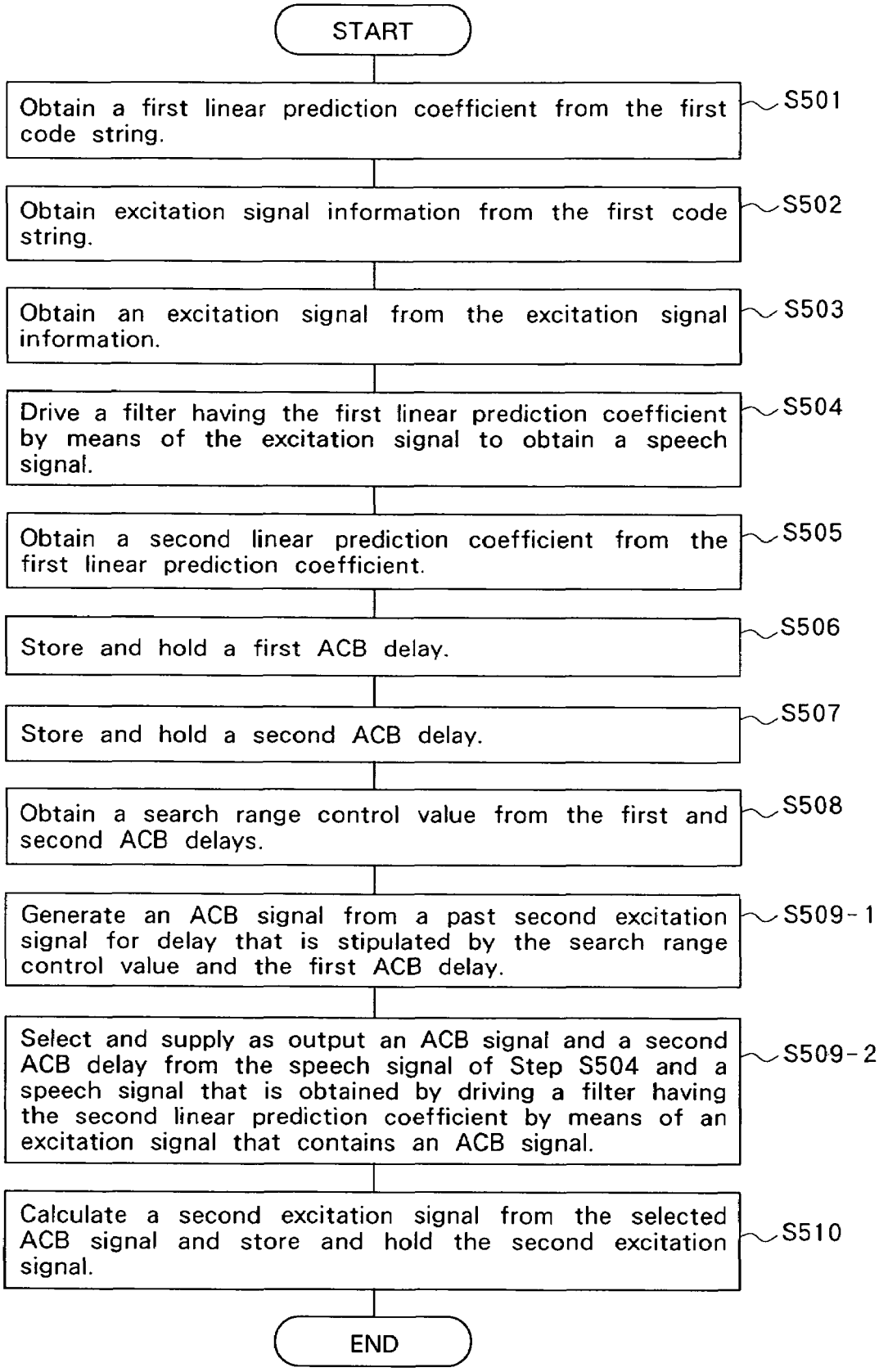
FIG. 25 is an explanatory view of the processes of the fifth working example of the method according to the present invention.

Referring now to FIG. 12, FIG. 13, and the flow chart of FIG. 25, the following explanation regards the code conversion method for converting from a first code string to a second code string in the above-described fifth working example. FIG. 25 is a flow chart for explaining the operations of the fifth working example of the method according to the present invention.

A first LP coefficient is obtained from the code (LP coefficient code) of a first code string that has been separated by code separation circuit 1010 (Step S501). In speech decoding circuit 1500, excitation signal information is obtained from the first code string, and an excitation signal is obtained from the excitation signal information (Steps S502 and S503). In speech decoding circuit 1500, a speech signal s(n) is generated by driving a compound filter having the first LP coefficient by means of the obtained excitation signal (Step S504).

In LP coefficient code conversion circuit 1100, a second LP coefficient is obtained from the first LP coefficient (Step S505).

In ACB code conversion circuit 5200, the first ACB delay that is contained in the obtained excitation signal information is stored and held (Step S506).

In ACB code generation circuit 5200, a second ACB delay that corresponds to the code of the ACB delay in the second code string is stored and held (Step S507).

In ACB code generation circuit 5200, a search range control value is calculated from the first ACB delay that has been stored and held and the second ACB delay that has been stored and held (Step S508); and an ACB signal is successively generated from the second excitation signal that was previously calculated, stored, and held for delay that is within a range that is stipulated by the search range control value and the first ACB delay (Step S509-1).

In ACB code generation circuit 5200, the speech signal and a first reconstructed speech signal that is successively generated by driving a compound filter having the second LP coefficient by means of the ACB signal are used to select an ACB signal and a second ACB delay, and code that corresponds to the second ACB delay is supplied as code of the ACB delay in the second code string (Step S509-2).

In second excitation signal calculation circuit 5610, a second excitation signal is obtained from the selected ACB signal, and the second excitation signal is stored and held (Step S510).

SIXTH WORKING EXAMPLE

Figure 16:
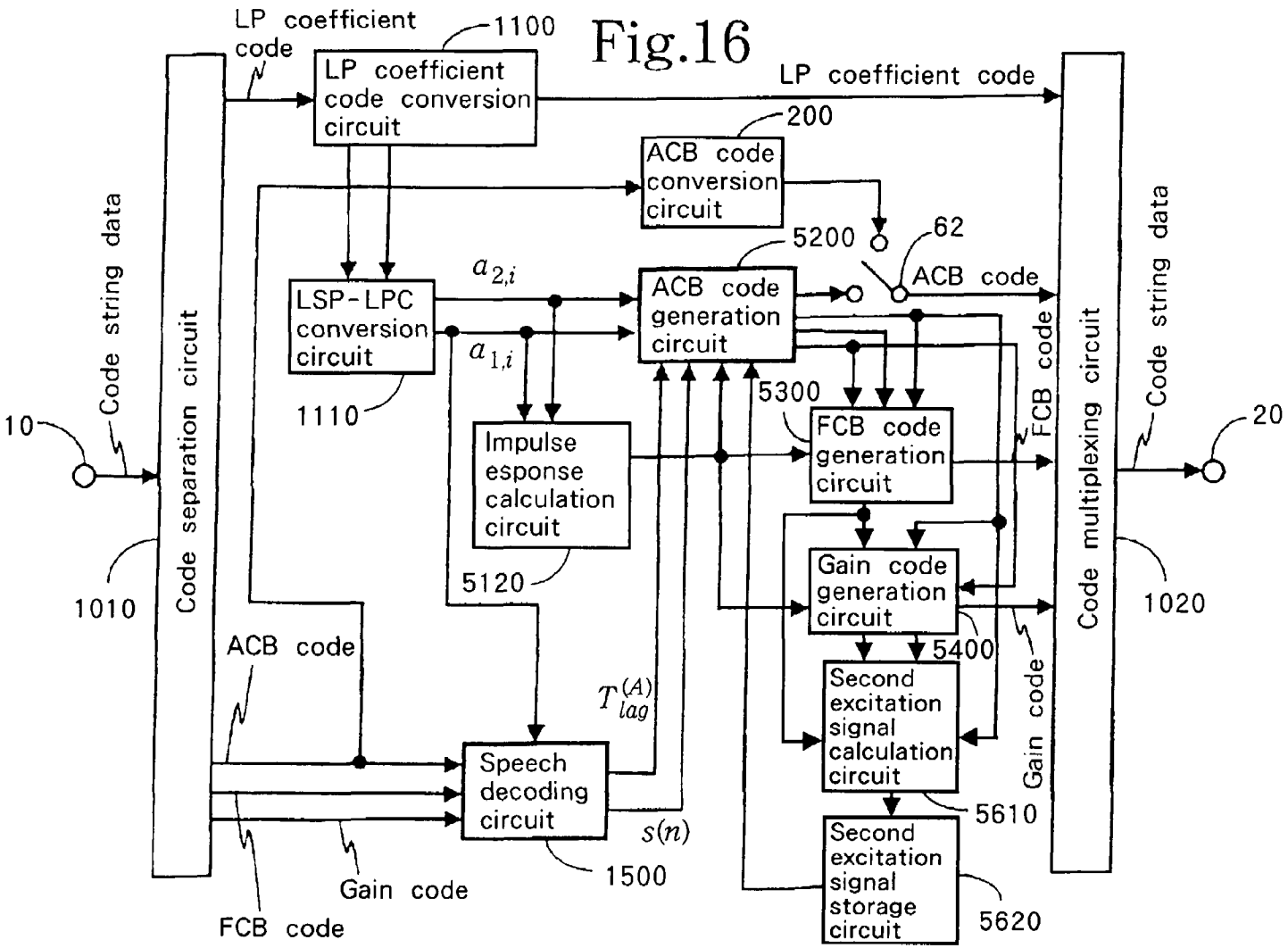
FIG. 16 is a view of the configuration of the sixth working example of the code conversion device according to present invention.

FIG. 16 shows the configuration of the sixth working example of the code conversion device according to the present invention. FIG. 16 shows a configuration for selecting between a second ACB code that is supplied from ACB code conversion circuit 200 and a second ACB code that is supplied from ACB code generation circuit 5200. Referring to FIG. 16, the points of difference between the configuration of the sixth working example and the configuration that is shown in FIG. 12 are the addition of ACB code conversion circuit 200 and second switch 62. The following description omits explanation of components that are identical or equivalent to components that are shown in FIG. 12.

In FIG. 16, ACB code conversion circuit 200 is made up of the same components as ACB code conversion circuit 200 of the prior art that is shown in FIG. 1. ACB code conversion circuit 200 finds the second ACB code in, for example, the first subframe, and supplies the second ACB code to switch 62.

ACB code generation circuit 5200 finds the second ACB delay in, for example, the second subframe, and supplies the second ACB code that corresponds to the second ACB delay to switch 62.

Switch 62 receives the second ACB code that is supplied from ACB code conversion circuit 200 in the first subframe, receives the second ACB code that is supplied from ACB code generation circuit 5200 in the second subframe, and supplies second ACB code to code multiplexing circuit 1020.

Figure 26:
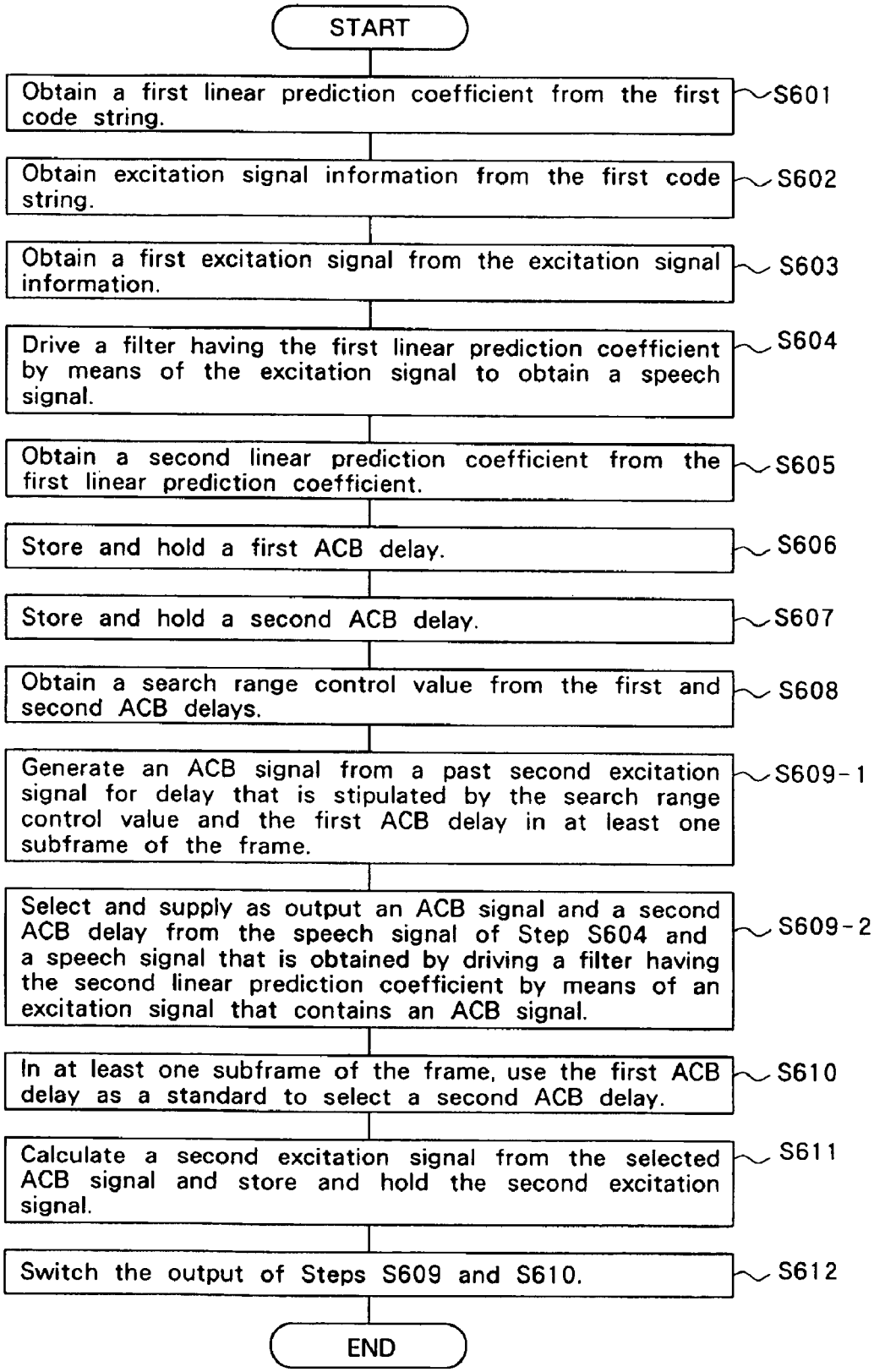
FIG. 26 is an explanatory view of the processes of the sixth working example of the method according to the present invention.

The following explanation regards the code conversion method for converting a first code string to a second code string in the above-described sixth working example with reference to FIG. 13, FIG. 16, and the flow chart of FIG. 26. FIG. 26 is a flow chart for explaining the operations of the sixth working example of the method according to the present invention.

A first LP coefficient is obtained from code (LP coefficient code) of the first code string that was separated by code separation circuit 1010 (Step S601). In speech decoding circuit 1500, excitation signal information is obtained from the first code string, and an excitation signal is obtained from the excitation signal information (Steps S602 and S603). In speech decoding circuit 1500, a speech signal s(n) is generated by driving a compound filter having the first LP coefficient by means of the obtained excitation signal (Step S604). In LP coefficient code conversion circuit 1100, a second LP coefficient is obtained from the first LP coefficient (Step S605).

For each subframe, a first ACB delay that is contained in the excitation signal information is successively stored, and the first ACB delay is held for a number of subframes that has been determined in advance (Step S606).

For each of the subframes, a second adaptive codebook delay is successively stored that corresponds to code of the adaptive codebook delay in the second code string, and the second ACB delay is held for a number of subframes that is determined in advance (Step 607).

In ACB code generation circuit 5200, the absolute value of the difference between the first ACB delay that has been stored and held and the second ACB delay that has been stored and held that correspond to the same subframe is calculated for all of the first ACB delays and the second ACB delays that are held, and a value that is obtained by adding, for the number of subframes, values that are obtained by multiplying the absolute values by a weighting coefficient is taken as the search range control value (Step S608).

In at least one subframe in a frame, an ACB signal is successively generated from the second excitation signal that has been previously calculated, stored and held for delay that is within a range that is stipulated by the search range control value and the first ACB delay (Step S609-1); the speech signal and a first reconstructed speech signal that is successively generated by driving a compound filter having the second LP coefficient by means of the generated ACB signal are used to select an ACB signal and a second ACB delay; and code that corresponds to the second ACB delay is supplied as code of the ACB delay in the second code string (Step S609-2).

In ACB code conversion circuit 200, in at least one subframe in a frame, a second ACB delay is selected with the first ACB delay as a standard. In other words, the relation between the first ACB delay and the first delay code that corresponds to this first ACB delay and the relation between the second ACB delay and a second delay code that corresponds to this second ACB delay are used to place the first ACB delay in correspondence with the second ACB delay and thereby convert from the first delay code to the second delay code, and the second delay code is supplied as the code of the ACB delay in the second code string (Step S610).

A second excitation signal is obtained from the selected adaptive codebook signal, and the second excitation signal is stored and held (Step S611).

The output of ACB code conversion circuit 200 and ACB code generation circuit 5200 is switched by switch 62 and supplied to code multiplexing circuit 1020 (Step S611).

SEVENTH WORKING EXAMPLE

Figure 17:
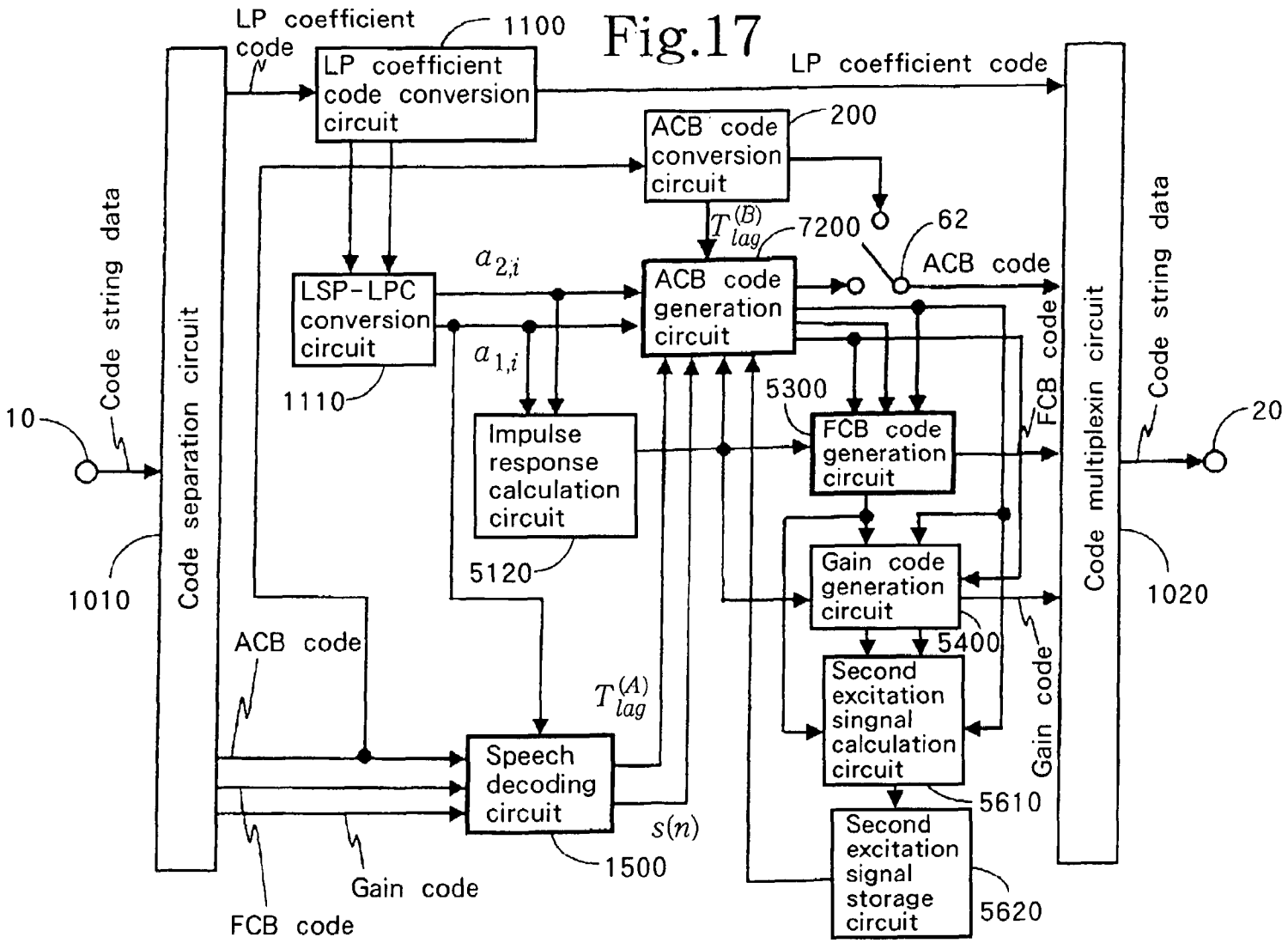
FIG. 17 is a view of the configuration of the seventh working example of the code conversion device according to the present invention.

FIG. 17 shows the configuration of the seventh working example of the code conversion device according to the present invention. FIG. 17 shows a configuration for selecting between the second ACB code that is supplied from ACB code conversion circuit 200 and the second ACB code that is supplied from ACB code generation circuit 7200. In this case, ACB code conversion circuit 200 is equivalent to ACB code conversion circuit 200 in the above-described third working example, and the point of difference between the configurations of the present working example and the sixth working example is the replacement of ACB code generation circuit 5200 by ACB code generation circuit 7200. The following explanation relates to the configuration of ACB code generation circuit 7200.

ACB code generation circuit 7200 receives the second ACB delay that is supplied from ACB code conversion circuit 200, receives the first LP coefficient and the second LP coefficient from LSP-LPC conversion circuit 1110, receives the first ACB delay and decoded speech from speech decoding circuit 1500, receives the impulse response signal from impulse response calculation circuit 5120, and receives a past second excitation signal that is stored and held in second excitation signal storage circuit 5620.

ACB code generation circuit 7200 calculates a first target signal from the decoded speech, the first LP coefficient, and the second LP coefficient.

Next, in the first subframe, ACB code generation circuit 7200 finds a second ACB signal and the optimum ACB gain from the second ACB delay, a past second excitation signal, and the impulse response signal and stores and holds the second ACB delay.

In the second subframe, ACB code generation circuit 7200 next finds a second ACB delay, a second ACB signal, and the optimum ACB gain from the second ACB delay that has been stored and held, the past second excitation signal, the impulse response signal, and the first target signal.

ACB code generation circuit 7200 then supplies the first target signal to FCB code generation circuit 5300 and gain code generation circuit 5400, supplies the optimum ACB gain to FCB code generation circuit 5300, and supplies the second ACB signal to FCB code generation circuit 5300, gain code generation circuit 5400, and second excitation signal calculation circuit 5610. In the second subframe, ACB code generation circuit 7200 also supplies code that corresponds to the second ACB delay and that can be decoded by System B as the second ACB code to switch 62.

Figure 18:
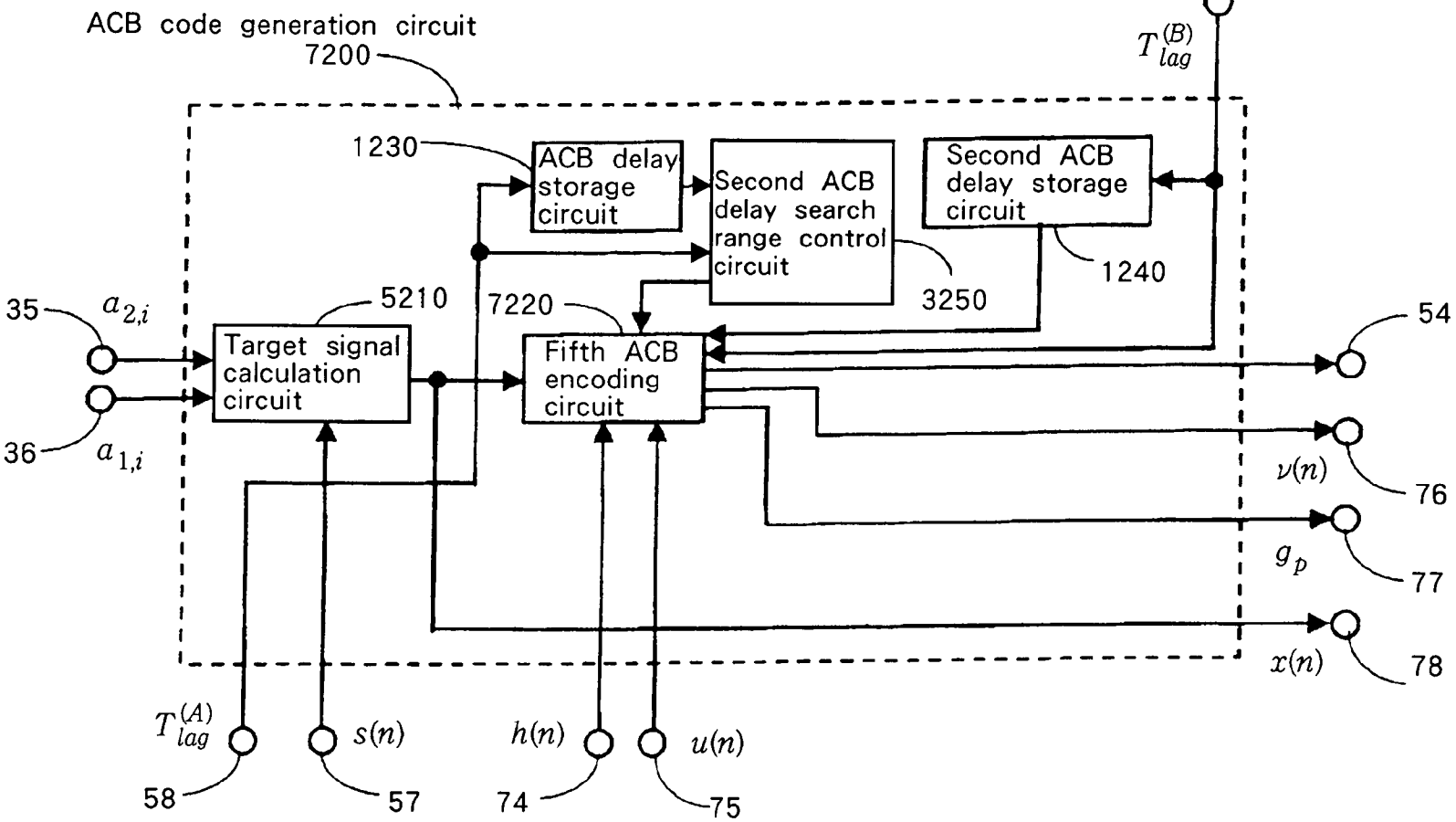
FIG. 18 is a view of the configuration of the ACB code generation circuit in the seventh working example of the code conversion device according to the present invention.

FIG. 18 shows the configuration of ACB code generation circuit 7200. The following explanation regards each of the components of ACB code generation circuit 7200 with reference to FIG. 18.

The points of difference between the configuration of ACB code generation circuit 7200 and the configuration of ACB code generation circuit 5200 that is shown in FIG. 13 include: the replacement of ACB delay search range control circuit 1250 of FIG. 13 with second ACB delay search range control circuit 3250, and the replacement of fourth ACB encoding circuit 5220 with fifth ACB encoding circuit 7220. Other than the mode of connection, the other components are identical to those in ACB code generation circuit 5200. In addition, second ACB delay search range control circuit 3250 is identical to second ACB delay search range control circuit 3250 of the third working example that is shown in FIG. 10. The following explanation regards fifth ACB encoding circuit 7220.

Fifth ACB encoding circuit 7220 receives the first target signal that is supplied from target signal calculation circuit 5210, receives the search range control value that is supplied from second ACB delay search range control circuit 3250, receives the impulse response signal that is supplied from impulse response calculation circuit 5120 by way of input terminal 74, and receives a past second excitation signal that is supplied from second excitation signal storage circuit 5620 by way of input terminal 75. In the first subframe, fifth ACB encoding circuit 7220 further receives the second ACB delay that is supplied from ACB code conversion circuit 200 by way of input terminal 37, and in the second subframe, receives the past second ACB delay that is supplied from second ACB delay storage circuit 1240.

In the first subframe, fifth ACB encoding circuit 7220 takes as the second ACB signal v(n) a signal in which the second ACB delay is cut from the past second excitation signal. Fifth ACB encoding circuit 7220 also calculates the optimum ACB gain gp from the second ACB signal.

In the second subframe, fifth ACB encoding circuit 7220 first calculates filter-processed past excitation signal $y_k(n)$, $n=0, \ldots, L^{(B)}sfr-1$ of a delay k by means of the convolution of the impulse response signal and a signal in which delay k is cut from the past second excitation signal.

Fifth ACB encoding circuit 7220 next calculates the normalized cross-correlation from $y_k(n)$ and the first target signal x(n) for delay k that is within a range of values that is stipulated by the search range control value and that center on past second ACB delay and selects the delay for which the normalized cross-correlation is a maximum. This selection corresponds to the selection of the delay for which the squared error between x(n) and $y_k(n)$ is a minimum. The selected delay is taken as the second ACB delay, and a signal in which the second ACB delay is cut from the past second excitation signal is taken as the second ACB signal v(n).

Fifth ACB encoding circuit 7220 also calculates the optimum ACB gain gp from the second ACB signal.

Finally, as in the above-described prior art, fifth ACB encoding circuit 7220 uses the correlation between ACB code and the ACB delay in System B that is shown in FIG. 2 to find code that corresponds to the second ACB delay and that can be decoded by System B and supplies this code as the second ACB code to switch 62 by way of output terminal 54.

Fifth ACB encoding circuit 7220 also supplies the second ACB signal to second target signal calculation circuit 5310, gain encoding circuit 5410, and second excitation signal calculation circuit 5610 by way of output terminal 76; and supplies the optimum ACB gain to second target signal calculation circuit 5310 by way of output terminal 77. This completes the explanation of FIG. 18 and the explanation of the seventh working example.

Figure 27:
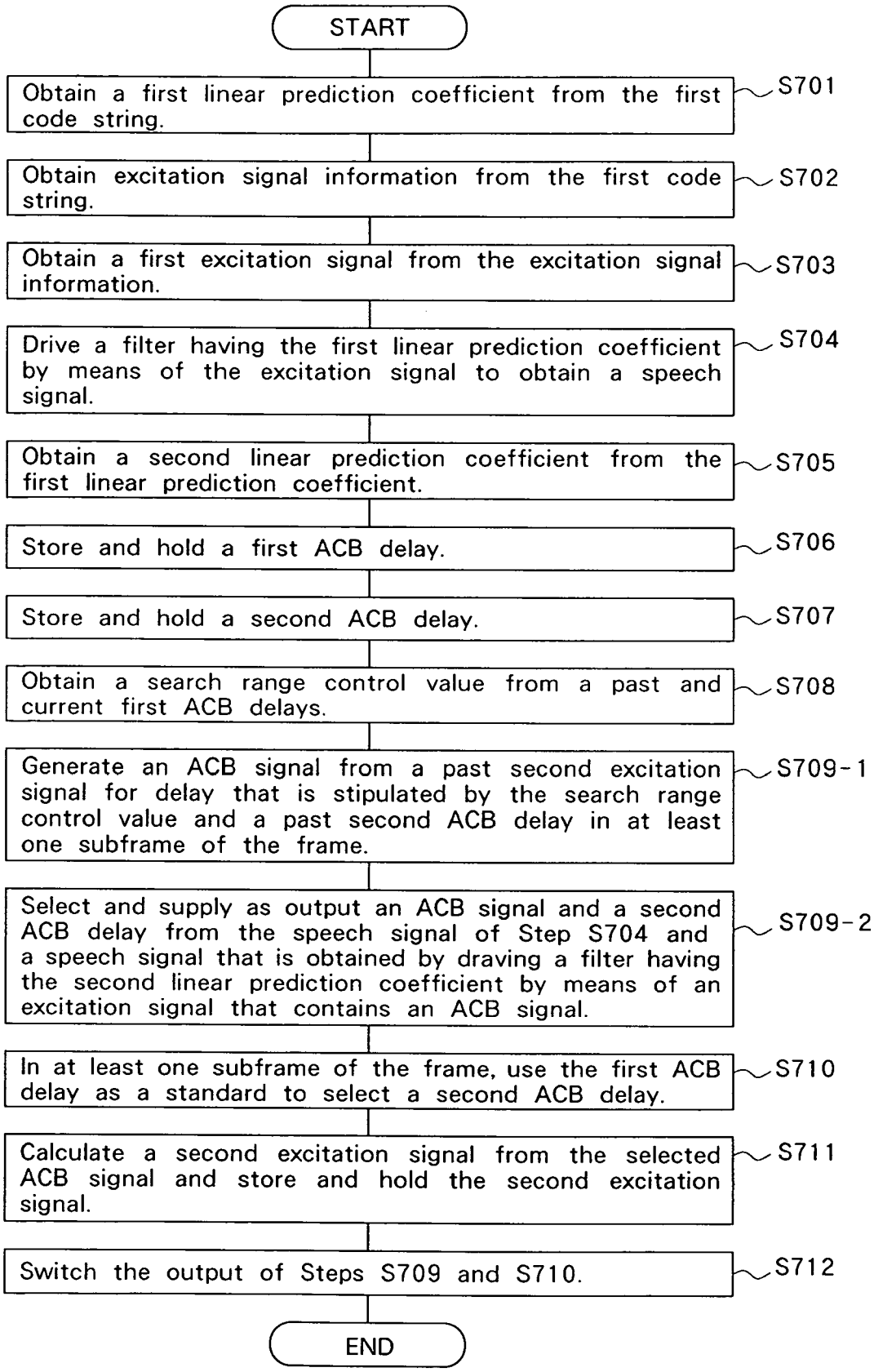
FIG. 27 is an explanatory view of the processes of the seventh working example of the method according to the present invention.

The following explanation regards a code conversion method for converting a first code string to a second code string in the above-described seventh working example with reference to FIG. 17, FIG. 18, and the flow chart of FIG. 27. FIG. 27 is a flow chart for explaining the operations of the seventh working example of the method according to the present invention.

A first LP coefficient is obtained from the first code string (Step S701). Excitation signal information is obtained from the first code string, a first excitation signal is obtained from the excitation signal information, and a speech signal is generated by driving a filter having the first LP coefficient by means of the first excitation signal (Steps S702-S704). In LP coefficient code conversion circuit 1100, a second LP coefficient is obtained from the first LP coefficient (Step S705).

In ACB code generation circuit 7200, a first ACB delay that is contained in the excitation signal information is successively stored for each subframe, and the first ACB delay is held for a number of subframes that has been determined in advance (Step S706). For each subframe, a second ACB delay that corresponds to code of the ACB delay in the second code string is successively stored, and the second ACB delay is held for a number of subframes that is determined in advance (Step S707).

In ACB code generation circuit 7200, the difference between the first ACB delay of consecutive subframes is calculated for a past first ACB delay that is stored and held and the first ACB delay of the current subframe, the absolute value of the difference is calculated, and a value that is obtained by adding, for the number of subframes, values that are obtained by multiplying the absolute values by a weighting coefficient is taken as the search range control value (Step S708).

In at least one subframe of the frame, an ACB signal is successively generated from a second excitation signal that has been previously calculated, stored, and held for a delay that is within a range that is stipulated by the search range control value and the second ACB delay that has been previously found, stored and held (Step S709-1).

In ACB code generation circuit 7200, the speech signal and a first reconstructed speech signal that is successively generated by driving a compound filter having the second LP coefficient by means of the ACB signal are used to select an ACB signal and a second ACB delay, and code that corresponds to the second ACB delay is supplied as code of the ACB delay in the second code string (Step S709-2).

In at least one subframe of the frame, ACB code conversion circuit 200 uses the relation between the first ACB delay and a delay code that corresponds to this first ACB delay and the relation between the second ACB delay and a delay code that corresponds to this second ACB delay to place the first ACB delay in correspondence with the second ACB delay and thus convert from the first delay code to the second delay code, and supplies the second delay code as code of the ACB delay in the second code string (Step S710). The second ACB delay $T^{(B)}lag$ that is supplied from ACB code conversion circuit 200 is supplied to ACB code generation circuit 7200.

A second excitation signal is obtained from the selected ACB signal in second excitation signal calculation circuit 5620, and the second excitation signal is stored and held (Step S711).

Output from ACB code conversion circuit 200 and output from ACB code generation circuit 7200 are switched by switch 62 and supplied to code multiplexing circuit 1020.

EIGHTH WORKING EXAMPLE

FIG. 12 shows the configuration of the eighth working example of the code conversion device according to the present invention. As previously explained, this working example shares FIG. 12 with the fifth working example. The point of difference between this eighth working example and the fifth working example is the use of ACB code generation circuit 8200 for ACB code generation circuit 5200. The following explanation regards the configuration of ACB code generation circuit 8200.

Figure 19:
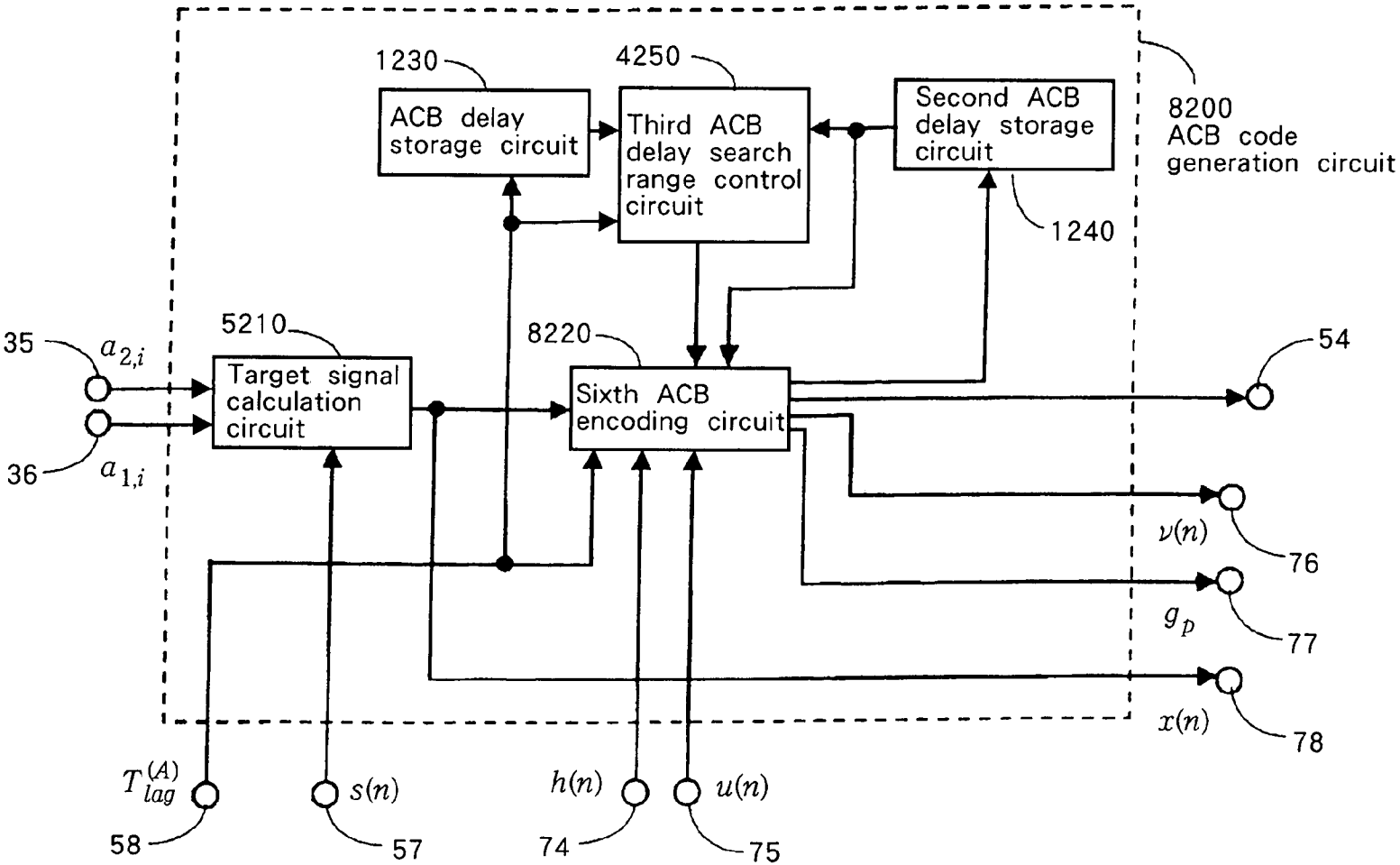
FIG. 19 is a view of the configuration of the ACB code generation circuit in the eighth working example of the code conversion device according to the present invention.

FIG. 19 shows the configuration of ACB code generation circuit 8200. The following explanation regards each of the components of ACB code generation circuit 8200 with reference to FIG. 19.

The points of difference between the configuration of ACB code generation circuit 8200 and ACB code generation circuit 5200 shown in FIG. 13 are the use of third ACB delay search range control circuit 4250 in place of ACB delay search range control circuit 1250, and the use of sixth ACB encoding circuit 8220 in place of fourth ACB encoding circuit 5220. Other than the mode of connection, the other components are identical to the components of ACB code generation circuit 5200. In addition, third ACB delay search range control circuit 4250 is equivalent to third ACB delay search range control circuit 4250 in the fourth working example that is shown in FIG. 11. The following explanation regards sixth ACB encoding circuit 8220.

Sixth ACB encoding circuit 8220 receives the first target signal that is supplied from target signal calculation circuit 5210, receives the first ACB delay that is supplied from ACB decoding circuit 1510 by way of input terminal 58; receives a past second ACB delay that is supplied from second ACB delay storage circuit 1240; receives the search range control value that is supplied from the third ACB delay search range control circuit 4250, receives the impulse response signal that is supplied from impulse response calculation circuit 5120 by way of input terminal 74, and receives a past second excitation signal that is supplied from second excitation signal storage circuit 5620 by way of input terminal 75.

Sixth ACB encoding circuit 8220 next calculates the past excitation signal $y_k(n)$, n=0, . . . , $L^{(B)}$sfr−1 of delay k that has been filter-processed by means of the convolution of the impulse response signal and a signal in which delay k is cut from the past second excitation signal.

In the first subframe, sixth ACB encoding circuit 8220 calculates the normalized cross-correlation based on $y_k(n)$ and the first target signal x(n) for delay hat is within a range of values that is stipulated by the search range control value and that centers on the first ACB delay and selects the delay for which the normalized cross-correlation is a maximum. This selection corresponds to selecting the delay for which the squared error between x(n) and $y_k(n)$ is a minimum.

In the second subframe, sixth ACB encoding circuit 8220 calculates the normalized cross-correlation based on $y_k(n)$ and first target signal x(n) for delay k that is within a range of values that is stipulated by the search range control value and that centers on a past second ACB delay, and selects the delay for which the normalized cross-correlation is a maximum. The selected delay is taken as the second ACB delay, and the past second excitation signal in this case is the second ACB signal v(n).

Sixth ACB encoding circuit 8220 also calculates the optimum ACB gain gp from the second ACB signal.

Finally, as in the above-described prior art, sixth ACB encoding circuit 8220 uses the correlation between the ACB code and ACB delay in System B that is shown in FIG. 2 to supply code that corresponds to the second ACB delay and that can be decoded by System B as second ACB code by way of output terminal 54 to code multiplexing circuit 1020.

Sixth ACB encoding circuit 8220 also supplies the second ACB delay to second ACB delay storage circuit 1240; supplies the second ACB signal to second target signal calculation circuit 5310, gain encoding circuit 5410, and second excitation signal calculation circuit 5610 by way of output terminal 76; and supplies the optimum ACB gain to second target signal calculation circuit 5310 by way of output terminal 77. This completes the explanation of FIG. 19, and further, completes the explanation of the eighth working example.

Figure 28:
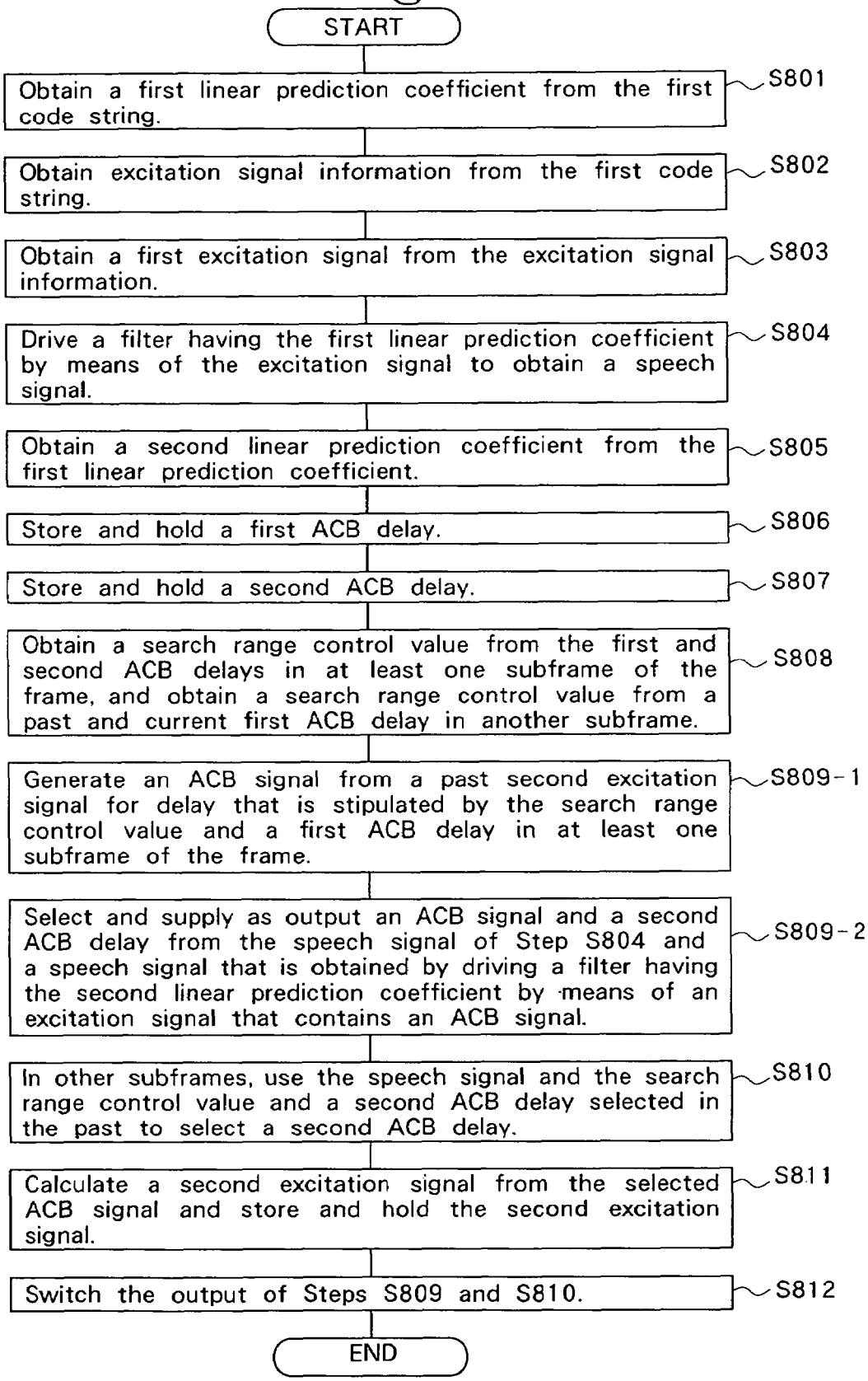
FIG. 28 is an explanatory view of the processes of the eighth working example of the method according to the present invention.

The following explanation regards the code conversion method for converting a first code string to a second code string in the above-described eighth working example with reference to FIG. 12, FIG. 19 and the flow chart of FIG. 28. FIG. 28 is a flow chart for explaining the operations of the eighth working example of the method according to the present invention.

A first LP coefficient is obtained from the first code string (Step S801). Excitation signal information is obtained from the first code string, a first excitation signal is obtained from the excitation signal information, and a speech signal is generated by driving a filter having the first LP coefficient by means of the first excitation signal (Steps S802-S804). A second LP coefficient is obtained from the first LP coefficient (Step S805).

In ACB code generation circuit 8200, a first ACB delay that is contained in the excitation signal information is successively stored for each subframe, and the first ACB delay is held for a predetermined number of subframes (Step S806). For each subframe, a second ACB delay that corresponds to code of the ACB delay in the second code string is successively stored, and the second ACB delay is held for a predetermined number of subframes (Step S807).

In at least one subframe in the frame, ACB code generation circuit 8200, calculates the absolute value of the difference between the first ACB delay that has been stored and held and the second ACB delay that has been stored and held that correspond to the same subframe for all of the first ACB delays and the second ACB delays that are held, and takes as a search range control value a value that is obtained by adding, for the number of subframes, values that are obtained by multiplying the absolute values by a weighting coefficient.

For other subframes in the frame, ACB code generation circuit 8200 calculates the difference between the first ACB delay of consecutive subframes for the first adaptive codebook delay that has been stored and held and the first adaptive codebook delay of the current subframe, calculates the absolute value of the difference, and takes as the search range control value a value that is obtained by adding, for the number of subframes, values that are obtained by multiplying the absolute values by a weighting coefficient (Step S808).

In at least one subframe in the frame, ACB code generation circuit 8200 successively generates an ACB signal from a second excitation signal that has been previously calculated, stored, and held for delay that is within a range that is stipulated by the search range control value and the first ACB delay (Step S809-1). ACB code generation circuit 8200 uses the speech signal and a first reconstructed speech signal that is successively generated by driving a compound filter that has the second LP coefficient by means of the ACB signals to select an adaptive codebook signal and a second ACB delay, and supplies code that corresponds to the second ACB delay as code of an adaptive codebook delay in the second code string (Step S809-2).

In ACB code generation circuit 8200, an ACB signal is successively generated from the second excitation signal that has been previously calculated, stored and held for delay that is within a range that is stipulated by the search range control value and a second ACB delay that has been previously found, stored and held, and the speech signal and a first reconstructed speech signal that is successively generated by driving a compound filter having the second LP coefficient by means of the ACB signal are used to select an ACB signal and second adaptive codebook delay; and code that corresponds to the second adaptive codebook delay is supplied as code of an adaptive codebook delay in the second code string (Step S810). A second excitation signal is obtained from the selected ACB signal in second excitation signal calculation circuit 5610, and the second excitation signal is stored and held (Step S811).

The above-described code conversion devices of each of the working examples of the present invention may be realized through the control of a computer such as a digital signal processor (DSP) that is in turn controlled by a program. The processing of the ninth to sixteenth working examples of computer programs described below corresponds to each the above-described first to eighth working examples.

NINTH WORKING EXAMPLE

Figure 20:
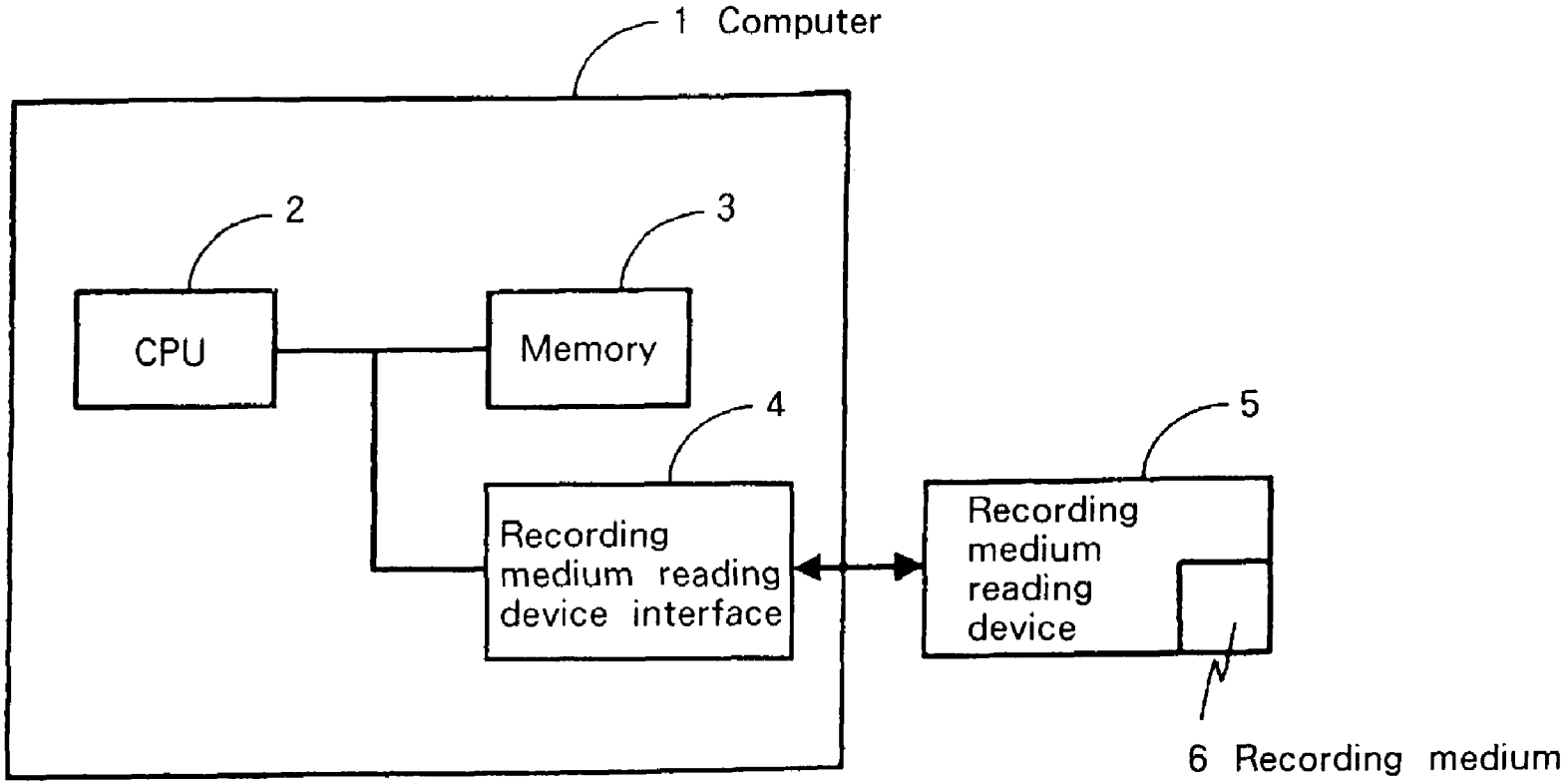
FIG. 20 is a view of the configuration of the ninth to sixteenth working examples of the code conversion device according to the present invention.

As the ninth working example of the present invention, FIG. 20 shows a schematic view of the configuration of a device in which the code conversion process of each of the above-described working examples is realized by a computer. When a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining an excitation signal from the excitation signal information;

(d) driving a filter having the first linear prediction coefficient by means of the excitation signal to generate a speech signal;

(e) for each of subframes, which are divisions of frames that are the time units of converting a code string, successively storing a first adaptive codebook delay that is contained in the excitation signal information and holding the first adaptive codebook delay of a predetermined number of subframes;

(f) for each subframe, successively storing a second adaptive codebook delay and holding the second adaptive codebook delay of a predetermined number of subframes;

(g) calculating the absolute value of the difference between the first adaptive codebook delay that has been stored and held and the second adaptive codebook delay that has been stored and held that correspond to the same subframe for all first adaptive codebook delays and second adaptive codebook delays that are held, and taking as the search range control value a value that is obtained by adding, for the number of subframes, values that are obtained by multiplying the absolute values by a weighting coefficient; and (h) calculating the autocorrelation or the normalized autocorrelation from the speech signal for delay that is within a range that is stipulated by the search range control value and the first adaptive codebook delay, selecting delay for which the autocorrelation or the normalized autocorrelation is a maximum, taking the selected delay as the second adaptive codebook delay, and supplying code that corresponds to the second adaptive codebook delay as code of an adaptive codebook delay in the second code string.

This program is read from recording medium 6 to memory 3 by way of recording medium reading device 5 and interface 4 and then executed. The above-described program may be stored in nonvolatile memory such as a mask ROM or flash memory.

The recording medium, in addition to nonvolatile memory, may include mediums such as a CD-ROM, FD, Digital Versatile Disk (DVD), magnetic tape (MT), and transportable HDD.

In cases in which, for example, the program is transmitted from a server over a communication medium by computer, the recording medium may also include the communication medium that conveys the program by wire or by radio.

TENTH WORKING EXAMPLE

In the tenth working example of the present invention, when a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining an excitation signal from the excitation signal information;

(d) driving a filter having the first LP coefficient by means of the excitation signal to generate speech signals;

(e) for each of subframes, which are divisions of frames that are the time units of converting a code string, successively storing a first adaptive codebook delay and holding the first adaptive codebook delay of a predetermined number of subframes;

(f) for each subframe, successively storing a second adaptive codebook delay that corresponds to code of an adaptive codebook delay in the second code string and holding the second adaptive codebook delay of a predetermined number of subframes;

(g) calculating the absolute value of the difference between the first adaptive codebook delay that has been stored and held and the second adaptive codebook delay that has been stored and held that correspond to the same subframe for all first adaptive codebook delays and second adaptive codebook delays that are held, and taking as a search range control value a value that is obtained by adding, for the number of subframes, values that are obtained by multiplying the absolute values by a weighting coefficient;

(h) in at least one subframe in the frame, calculating the autocorrelation or the normalized autocorrelation from the speech signal for delay that is within a range that is stipulated by the search range control value and the first adaptive codebook delay, selecting the delay for which the autocorrelation or the normalized autocorrelation is a maximum, taking the selected delay as the second adaptive codebook delay, and supplying code that corresponds to the second adaptive codebook delay as code of an adaptive codebook delay in the second code string; and (i) in at least one subframe in the frame, using the relation between the first adaptive codebook delay and a first delay code that corresponds to this first adaptive codebook delay and the relation between second adaptive codebook delay and a second delay code that corresponds to this second adaptive codebook delay to place the first adaptive codebook delay in correspondence with second adaptive codebook delay and thereby converting from the first delay code to the second delay code, and supplying the second delay code as code of an adaptive codebook delay in the second code string.

ELEVENTH WORKING EXAMPLE

In the eleventh working example of the present invention, when a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining an excitation signal from the excitation signal information;

(d) driving a filter having the first LP coefficient by means of the excitation signal to generate a speech signal;

(e) for each of subframes, which are divisions of frames that are the time units for converting code strings, successively storing a first adaptive codebook delay that is contained in the excitation signal information, and holding the first adaptive codebook delay for a predetermined number of subframes;

(f) for each of the subframes, successively storing a second adaptive codebook delay that corresponds to code of an adaptive codebook delay in the second code string, and holding the second adaptive codebook delay of a predetermined number of subframes;

(g) calculating the difference between the first adaptive codebook delay of consecutive subframes for a first adaptive codebook delay that has been stored and held and the first adaptive codebook delay of the current subframe, calculating the absolute value of the difference, and taking as a search range control value a value that is obtained by adding, for the number of subframes, values that are obtained by multiplying the absolute values by a weighting coefficient;

(h) in at least one subframe of the frame, calculating the autocorrelation or the normalized autocorrelation from the speech signal for delay that is within a range that is stipulated by the search range control value and the second adaptive codebook delay that has been previously found, stored and held, selecting the delay for which the autocorrelation or the normalized autocorrelation is a maximum, taking the selected delay as the second adaptive codebook delay, and supplying code that corresponds to the second adaptive codebook delay as code of an adaptive codebook delay in the second code string; and (i) in at least one subframe of the frame, using the relation between first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string.

TWELFTH WORKING EXAMPLE

In the twelfth working example of the present invention, when a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining an excitation signal from the excitation signal information;

(d) driving a filter having the first LP coefficient by means of the excitation signal to generate a speech signal;

(e) for each of subframes, which are divisions of frames that are the time units for converting code strings, successively storing a first adaptive codebook delay that is contained in the excitation signal information; and holding the first adaptive codebook delay for a predetermined number of subframes;

(f) for each of the subframes, successively storing a second adaptive codebook delay that corresponds to code of an adaptive codebook delay in the second code string, and holding the second adaptive codebook delay of a predetermined number of subframes;

(g) in at least one subframe in the frame, calculating the absolute value of the difference between the first adaptive codebook delay that has been stored and held and the second adaptive codebook delay that has been stored and held that correspond to the same subframe for all of the first adaptive codebook delays and second adaptive codebook delays that are held, and taking as a search range control value a value that is obtained by adding, for the number of subframes, values obtained by multiplying the absolute values by a weighting coefficient; and in other subframes, calculating the difference between the first adaptive codebook delay of consecutive subframes for the first adaptive codebook delay that has been stored and held and the first adaptive codebook delay of the current subframe, calculating the absolute value of the difference, and taking as a search range control value a value that is obtained by adding, for the number of subframes, values obtained by multiplying the absolute values by a weighting coefficient; and (h) in at least one subframe in the frame, calculating an autocorrelation or a normalized autocorrelation from the speech signal for delay that is within a range that is stipulated by the search range control value and the first adaptive codebook delay, selecting delay for which the autocorrelation or normalized autocorrelation is a maximum, taking the selected delay as second adaptive codebook delay, and supplying code that corresponds to the second adaptive codebook delay as code of an adaptive code book delay in the second code string; and in other subframes, calculating an autocorrelation or a normalized autocorrelation from the speech signal for delay that is within a range that is stipulated by the search range control value and second adaptive codebook delay that has been previously found, stored, and held, selecting delay for which the autocorrelation or normalized autocorrelation is a maximum, taking the selected delay as the second adaptive codebook delay, and supplying code that corresponds to the second adaptive codebook delay as code of an adaptive codebook delay in the second code string.

THIRTEENTH WORKING EXAMPLE

In the thirteenth working example of the present invention, when a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining a first excitation signal from the excitation signal information;

(d) driving a filter having the first LP coefficient by means of the first excitation signal to generate a speech signal;

(e) obtaining a second LP coefficient from the first LP coefficient;

(f) for each of subframes, which are divisions of frames that are the time units for converting code strings, successively storing a first adaptive codebook delay, and holding the first adaptive codebook delay for a predetermined number of subframes;

(g) for each of the subframes, successively storing a second adaptive codebook delay and holding the second adaptive codebook delay of a predetermined number of subframes;

(h) calculating the absolute value of the difference between the first adaptive codebook delay that has been stored and held and the second adaptive codebook delay that has been stored and held that correspond to the same subframe for all of the first adaptive codebook delays and second adaptive codebook delays that are held, and taking as the search range control value a value that is obtained by adding, for the number of subframes, values obtained by multiplying the absolute values by a weighting coefficient;

(i) successively generating an adaptive codebook signal from the second excitation signal that has been previously calculated, stored and held for delay that is within a range stipulated by the search range control value and the first adaptive codebook delay, selecting an adaptive codebook signal and delay such that the squared error between the speech signal and a first reconstructed speech signal that is successively generated by driving a compound filter having the second LP coefficient by means of the adaptive codebook signal is a minimum, taking the selected delay as the second adaptive codebook delay, and supplying code that corresponds to the second adaptive codebook delay as code of an adaptive codebook delay in the second code string;

(j) obtaining a second excitation signal from the selected adaptive codebook signal; and (k) storing and holding the second excitation signal.

FOURTEENTH WORKING EXAMPLE

In the fourteenth working example of the present invention, when a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining a first excitation signal from the excitation signal information;

(d) driving a filter having the first LP coefficient by means of the first excitation signal to generate a speech signal;

(e) obtaining a second LP coefficient from the first LP coefficient;

(f) for each of subframes, which are divisions of frames that are the time units for converting code strings, successively storing a first adaptive codebook delay that is contained in the excitation signal information, and holding the first adaptive codebook delay for a predetermined number of subframes;

(g) for each of the subframes, successively storing a second adaptive codebook delay that corresponds to code of an adaptive codebook delay in the second code string and holding the second adaptive codebook delay of a predetermined number of subframes;

(h) calculating the absolute value of the difference between the first adaptive codebook delay that has been stored and held and the second adaptive codebook delay that has been stored and held that correspond to the same subframe for all of the first adaptive codebook delays and second adaptive codebook delays that have been held, and taking as the search range control value a value that is obtained by adding, for the number of subframes, values obtained by multiplying the absolute values by a weighting coefficient;

(i) in at least one subframe in the frame, successively generating an adaptive codebook signal from a second excitation signal that has been previously calculated, stored and held for delay that is within a range stipulated by the search range control value and the first adaptive codebook delay, selecting an adaptive codebook signal and delay such that the squared error between the speech signal and a first reconstructed speech signal that is successively generated by driving a compound filter having the second LP coefficient by means of the adaptive codebook signal is a minimum, taking the selected delay as the second adaptive codebook delay, and supplying code that corresponds to the second adaptive codebook delay as code of an adaptive codebook delay in the second code string;

(j) in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string;

(k) obtaining a second excitation signal from the selected adaptive codebook signal; and (l) storing and holding the second excitation signal.

FIFTEENTH WORKING EXAMPLE

In the fifteenth working example of the present invention, when a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining a first excitation signal from the excitation signal information;

(d) driving a filter having the first LP coefficient by means of the first excitation signal to generate a speech signal;

(e) obtaining a second LP coefficient from the first LP coefficient;

(f) for each of subframes, which are divisions of frames that are the time units for converting code strings, successively storing a first adaptive codebook delay that is contained in the excitation signal information, and holding the first adaptive codebook delay for a predetermined number of subframes;

(g) for each of the subframes, successively storing a second adaptive codebook delay that corresponds to code of an adaptive codebook delay in the second code string and holding the second adaptive codebook delay of a predetermined number of subframes;

(h) calculating the difference between the first adaptive codebook delay of consecutive subframes for a first adaptive codebook delay that has been stored and held and the first adaptive codebook delay of the current subframe, calculating the absolute value of the difference, and taking as the search range control value a value that is obtained by adding, for the number of subframes, values obtained by multiplying the absolute values by a weighting coefficient;

(i) in at least one subframe in the frame, successively generating an adaptive codebook signal from a second excitation signal that has been previously calculated, stored and held for delay that is within a range that is stipulated by the search range control value and a second adaptive codebook delay that has been previously found, stored, and held, selecting an adaptive codebook signal and delay such that the squared error between the speech signal and a first reconstructed speech signal that is successively generated by driving a compound filter having the second LP coefficient by means of the adaptive codebook signal is a minimum, taking the selected delay as the second adaptive codebook delay, and supplying code that corresponds to the second adaptive codebook delay as code of an adaptive codebook delay in the second code string;

(j) in at least one subframe in the frame, using the relation between the first adaptive codebook delay and a first delay code that corresponds to this first adaptive codebook delay and the relation between the second adaptive codebook delay and a second delay code that corresponds to this second adaptive codebook delay to place the first adaptive codebook delay in correspondence with the second adaptive codebook delay and thus convert from the first delay code to the second delay code, and supplying the second delay code as code of an adaptive codebook delay in the second code string;

(k) obtaining a second excitation signal from the selected adaptive codebook signal; and (l) storing and holding the second excitation signal.

SIXTEENTH WORKING EXAMPLE

In the sixteenth working example of the present invention, when a code conversion process for converting a first code that is obtained by encoding speech by means of a first encoding/decoding device to a second code that can be decoded by a second encoding/decoding device is to be executed in computer 1, which executes a program that is read from recording medium 6, a program is recorded on recording medium 6 for causing the execution of processes of:

(a) obtaining a first LP coefficient from the first code string;

(b) obtaining excitation signal information from the first code string;

(c) obtaining a first excitation signal from the excitation signal information;

(d) driving a filter having the first LP coefficient by means of the first excitation signal to generate a speech signal;

(e) obtaining a second LP coefficient from the first LP coefficient;

(f) for each of subframes, which are divisions of frames that are the time units for converting code strings, successively storing a first adaptive codebook delay that is contained in the excitation signal information and holding the first adaptive codebook delay for a predetermined number of subframes;

(g) for each of the subframes, successively storing a second adaptive codebook delay that corresponds to code of an adaptive codebook delay in the second code string and holding the second adaptive codebook delay of a predetermined number of subframes;

(h) in at least one subframe in the frame, calculating the absolute value of the difference between the first adaptive codebook delay that has been stored and held and the second adaptive codebook delay that has been stored and held that correspond to the same subframe for all of the first adaptive codebook delays and second adaptive codebook delays that are held, and taking as a search range control value a value that is obtained by adding, for the number of subframes, values obtained by multiplying the absolute values by a weighting coefficient; and in other subframes, calculating the difference between the first adaptive codebook delay of consecutive subframes for a first adaptive codebook delay that has been stored and held and the first adaptive codebook delay of the current subframe, calculating the absolute value of the difference, and taking as a search range control value a value obtained by adding, for the number of subframes, values obtained by multiplying the absolute values by a weighting coefficient;

(i) in at least one subframe in the frame, successively generating an adaptive codebook signal from a second excitation signal that has been previously calculated, stored and held for delay that is within a range that is stipulated by the search range control value and the first adaptive codebook delay, selecting an adaptive codebook signal and delay such that the squared error between the speech signal and a first reconstructed speech signal that is successively generated by driving a compound filter having the second LP coefficient by means of adaptive codebook signal is a minimum, taking the selected delay as the second adaptive codebook delay, and supplying code that corresponds to the second adaptive codebook delay as code of an adaptive codebook delay in the second code string; and in other subframes, successively generating an adaptive codebook signal from a second excitation signal that has been previously calculated, stored, and held for delay that is within a range that is stipulated by the search range control value and the second adaptive codebook delay that has been previously found, stored and held, and selecting an adaptive codebook signal and delay such that the squared error between the speech signal and a first reconstructed speech signal that has been successively generated by driving a compound filter having the second linear prediction coefficient by means of the adaptive codebook signal is a minimum, taking the selected delay as the second adaptive codebook delay, and supplying code that corresponds to the second adaptive codebook delay as code of an adaptive codebook delays in the second code string;

(j) obtaining a second excitation signal from selected adaptive codebook signal; and (k) storing and holding the second excitation signal.

Although examples were described in which a CELP encoding method was employed as the speech encoding method in the above-described working examples, the present invention can be applied to any encoding method that conforms to a method including, for example, VSELP (Vector Sum Excited Linear Prediction) and PSI-CELP (Pitch Synchronous Innovation CELP), in which a speech signal is subjected to spectral analysis, resolved into a spectral envelope component and a residual component, the spectral envelope component expressed by spectral parameters, and code that corresponds to the signal component that is closest to the residual waveform of the speech signal that is to be encoded is selected from a codebook that includes signal components that represent the residual components. In the foregoing explanation, the present invention was described according to each of the working examples, but the present invention is not limited to the configurations of the above-described working examples and naturally includes variations and modifications that can be realized by a person skilled in the art within the scope of the inventions of each of the claims.

As described hereinabove, the present invention has the effect of, when converting ACB codes that correspond to adaptive codebook (ACB) delays of a first system to ACB codes that correspond to ACB delays of a second system, enabling suppression of the occurrence of allophones in the decoded speech of a second system that is generated using ACB delays that are obtained from the ACB codes following code conversion. These allophones that occur in decoded speech arise because the ACB delay that is found by the first system is not appropriate as the ACB delay used in the second system.

This suppression of allophones is achieved because the present invention is configured such that, in order to avoid mismatching between ACB delays, LP coefficients, and gain in the second system that occurs when the ACB delays that have been found in the first system are used directly in the second system, ACB delays are found by using decoded speech that is generated from an LP coefficient and gain that correspond to codes following code conversion, i.e., information that includes the LP coefficient and gain, and codes that correspond to these ACB delays are taken as the ACB codes of the second system.

Moreover, the present invention allows a reduction of the computational load that is required for searching for ACB delays when using decoded speech to find ACB delays.

This reduction of the computational load is achieved because the present invention is realized such that, when finding an ACB delay, the search range is not determined beforehand, but rather, is determined adaptively using the ACB delay of the first system and the ACB delay of the second system that were found previously.

While preferred embodiments of the present invention have been described using specific terms, such description is for illustrative purposes only, and it is to be understood that changes and variations may be made without departing from the spirit or scope of the following claims.

What is claimed is:

1. A code conversion method for converting a first code string to a second code string, the method comprising steps of:

obtaining a first linear prediction coefficient and excitation signal information from said first code string and generating an excitation signal from said excitation signal information;

outputting said excitation signal or a speech signal that is generated from said excitation signal, and a first adaptive codebook delay that is contained in said excitation signal information, to an adaptive codebook generation circuit;

selecting, via said adaptive codebook generation circuit, a second adaptive codebook delay based on said excitation signal or said speech signal that is generated from said excitation signal, and said first adaptive codebook delay; and supplying code that corresponds to said second adaptive codebook delay as code of an adaptive codebook delay in said second code string.

2. A code conversion method for converting a first code string to a second code string, the method comprising steps of:

obtaining a first linear prediction coefficient and excitation signal information from said first code string, and generating an excitation signal from said excitation signal information;

storing and holding a second adaptive codebook delay previously selected, that corresponds to code of an adaptive codebook delay in said second code string;

outputting said second adaptive codebook delay stored and held, and said excitation signal or a speech signal that is generated from said excitation signal and said first linear prediction coefficient, to an adaptive codebook generation circuit;

selecting a new second adaptive codebook delay, via said adaptive codebook generation circuit, based on said second adaptive codebook delay stored and held, and said excitation signal or said speech signal; and supplying code that corresponds to said second adaptive codebook delay as code of an adaptive codebook delay in said second code string.

3. A code conversion device for receiving a first code string as input, converting to a second code string, and supplying said second code string as output, the device comprising:

a speech decoding circuit for obtaining a first linear prediction coefficient and excitation signal information from said first code string and driving a filter having said first linear prediction coefficient by means of an excitation signal that is obtained from said excitation signal information to generate a speech signal; and an adaptive codebook code generation circuit for receiving said speech signal and a first adaptive codebook delay that is contained in said excitation signal, and using said speech signal and said first adaptive codebook delay to select a second adaptive codebook delay, and supplying code that corresponds to said second adaptive codebook delay as code of an adaptive codebook delay in said second code string.

4. A computer readable medium storing a program for causing a computer, which constitutes a code conversion device for converting a first code string to a second code string, to execute processes of:

obtaining a first linear prediction coefficient and excitation signal information from said first code string and generating an excitation signal from said excitation signal information;

outputting said excitation signal or a speech signal that is generated from said excitation signal, and a first adaptive codebook delay that is contained in said excitation signal information, to an adaptive codebook generation circuit;

selecting, via said adaptive codebook generation circuit, a second adaptive codebook delay based on said excitation signal or said speech signal that is generated from said excitation signal, and said first adaptive codebook delay; and supplying code that corresponds to said second adaptive codebook delay as code of an adaptive codebook delay in said second code string.

5. A computer readable medium storing a program for causing a computer, which constitutes a code conversion device for converting a first code string to a second code string, to execute processes of:

obtaining a first linear prediction coefficient and excitation signal information from said first code string, and generating an excitation signal from said excitation signal information;

storing and holding a second adaptive codebook delay previously selected, that corresponds to code of an adaptive codebook delay in said second code string;

outputting said second adaptive codebook delay stored and held, and said excitation signal or a speech signal that is generated from said excitation signal and said first linear prediction coefficient, to an adaptive codebook generation circuit;

selecting a new second adaptive codebook delay, via said adaptive codebook generation circuit, based on said second adaptive codebook delay stored and held, and said excitation signal or said speech signal; and supplying code that corresponds to said second adaptive codebook delay as code of an adaptive codebook delay in said second code string.

6. A code conversion device for converting a first code string to a second code string, said code conversion device comprising:

a speech decoding circuit for obtaining a first linear prediction coefficient and excitation signal information from said first code string, and generating an excitation signal from said excitation signal information;

a second adaptive codebook delay storage circuit for, storing and holding a second adaptive codebook delay previously selected, that corresponds to code of an adaptive codebook delay in said second code string;

a adaptive codebook generation circuit for receiving said second adaptive codebook delay stored and held, and said excitation signal or a speech signal that is generated from said excitation signal and said first linear prediction coefficient and for selecting a new second adaptive codebook delay based on said second adaptive codebook delay stored and held, and said excitation signal or said speech signal; and an adaptive codebook encoding circuit for supplying code that corresponds to said second adaptive codebook delay as code of an adaptive codebook delay in said second code string.

* * * * *